US007528331B2

(12) United States Patent
Bricaud et al.

(10) Patent No.: US 7,528,331 B2
(45) Date of Patent: May 5, 2009

(54) MANUALLY OPERATED CONTROL

(75) Inventors: Herve' Bricaud, Dole (FR); Yves Pizard, Dole (FR); David Ferraton, Crissey (FR)

(73) Assignee: CoActive Technologies, Inc., Newton, MA (US)

( * ) Notice: Subject to any disclaimer, the term of this patent is extended or adjusted under 35 U.S.C. 154(b) by 449 days.

(21) Appl. No.: 11/285,657

(22) Filed: Nov. 16, 2005

(65) Prior Publication Data

US 2006/0109244 A1 May 25, 2006

Related U.S. Application Data

(63) Continuation-in-part of application No. PCT/EP2004/051095, filed on Jun. 11, 2004.

(51) Int. Cl.
*H01H 3/00* (2006.01)

(52) U.S. Cl. ..... 200/18

(58) Field of Classification Search ..... 200/400, 200/61.54, 18, 4, 14, 417, 6 A, 543–545, 200/564, 553, 557, 558, 559, 561, 339, 567, 200/568, 569, 572, 336
See application file for complete search history.

(56) References Cited

U.S. PATENT DOCUMENTS 6,211,474 B1 4/2001 Takahashi
6,333,473 B1 * 12/2001 Sawada et al. ..... 200/4
6,388,212 B1 * 5/2002 Ishihara et al. ..... 200/18
6,555,768 B2 4/2003 Deruginsky et al.
6,794,589 B2 9/2004 Kubat et al.

FOREIGN PATENT DOCUMENTS

| | | | |
|---|---|---|---|
| EP | 1 182 852 | A1 | 2/2002 |
| FR | 2 792 486 | | 4/1999 |
| WO | WO 02/075641 | A1 | 9/2002 |
| WO | WO 03/043040 | A2 | 5/2003 |
| WO | WO 2004/112070 | A1 | 12/2004 |

* cited by examiner

*Primary Examiner*—Edwin A. Leon
(74) *Attorney, Agent, or Firm*—Pepper Hamilton LLP

(57) ABSTRACT

A control includes a drum (36) that is rotatably mounted in a housing (22), and includes devices for generating signals to indicate the direction in which the drum is turning and for generating signals to indicate which end of the drum is depressed. A gear (100) is fixed to the drum, and as the drum rotates a deflectable contact element (T6) is repeatedly deflected by teeth of the gear to repeatedly engage a stationary contact (T4, T5). The deflectable contact element is in the form of a wire with a deflectable part (104) deflected by gear teeth, a mount part (110) mounted on the housing, and a contacting part (108) that repeatedly engages the stationary contact, all being part of the wire. Depression of one end of the drum results in depression of a corresponding end of a sheet metal trigger member (30) that is free to snap down against a stationary contact (T2, T3). Stationary contacts that are repeatedly contacted, are in the form of wires with fixed first end and with free or fixed second ends.

14 Claims, 55 Drawing Sheets

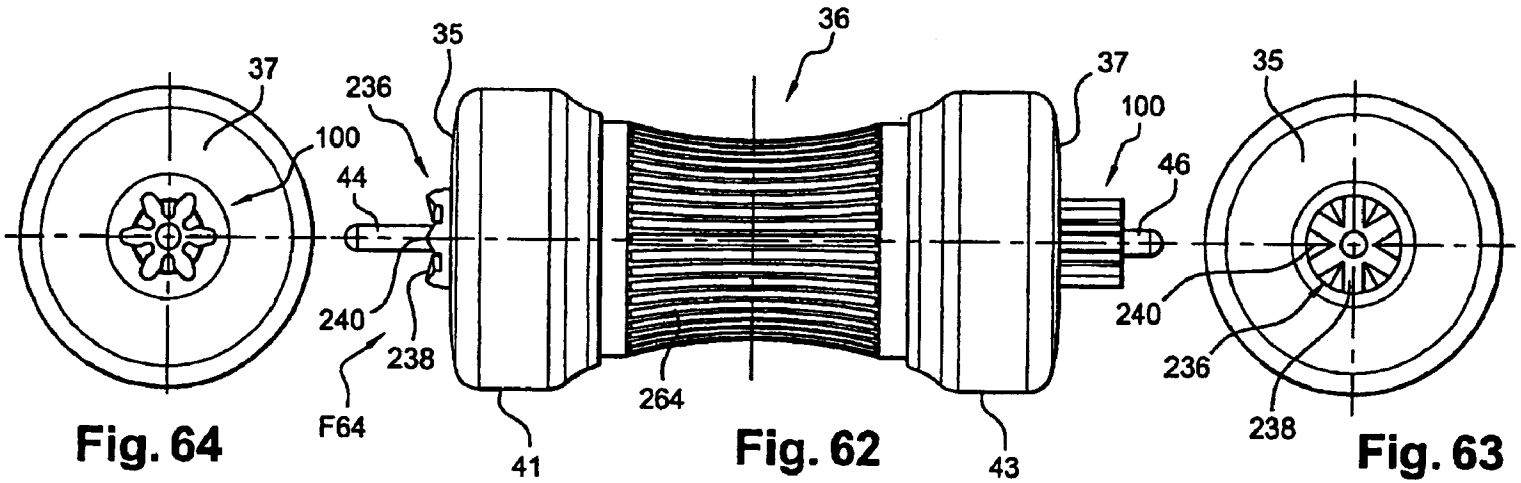
Fig. 63
Fig. 62
Fig. 64
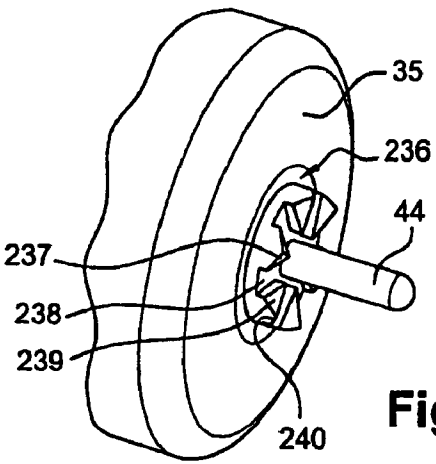
Fig. 64 b

MANUALLY OPERATED CONTROL

CROSS-REFERENCE

This is a continuation-in-part of PCT application PCT/EP2004/051095 filed 11 Jun. 2004 and naming the United States, which claimed priority from French patent application 0306972 filed 11 Jun. 2003.

BACKGROUND OF THE INVENTION

One type of control, or "navigator", includes a control member such as a drum that can be rotated in opposite directions and that has opposite ends that each or both can be depressed. Signal generators generate signals indicating such drum rotations and depressions to control an electronic circuit such as one on a mobile telephone or computer. It is desirable to make the control as small as possible and to provide tactile and sound feedback to the user, such as "clicks", to assure him/her that the rotations and depressions have been detected. It is also desirable to make the control as small and low cost as possible.

SUMMARY OF THE INVENTION

In accordance with one embodiment of the invention, a control is provided which has a member such as a drum that can be rotated in opposite directions in a housing and that has opposite ends that each or both can be depressed, to generate signals that control an electronic circuit, that is of simple and reliable construction. A gear, or multi-tooth wheel, is fixed to the drum, and a deflectable contact element detects drum rotation. The deflectable contact element has a mount portion mounted on the housing, a deflectable portion lying in the path of the teeth, and a contacting portion that lies between a pair of stationary contacts to engage one of them. The deflectable contact element is formed of a wire. The mount portion is formed by a section of the wire that lies in a groove of the housing to allow wire pivoting in the groove. The wire also has a biasing portion with a near end extending from the contacting portion and with a far end that is fixed to the housing and to an electrical terminal. The stationary contacts that are engaged by the contacting portion of the deflectable contact element, are formed of wires. Some of the wires each has one end fixed to the housing and to an electrical terminal and an opposite end that is free to be deflected.

Downward deflection of each end of the drum is detected by a sheet metal trigger member that has a middle supported on the housing and that has opposite ends that each supports an opposite end portion of the drum. When an end of the drum is depressed, a corresponding trigger member end is depressed against a stationary contact. Each end of the trigger member is unobstructed in downward movement to facilitate its rapid downward movement. Each of these stationary contacts is formed by a wire with opposite ends mounted on the housing and with an unsupported middle lying under a trigger member end.

The novel features of the invention are set forth with particularity in the appended claims. The invention will be best understood from the following description when read in conjunction with the accompanying drawings.

BRIEF DESCRIPTION OF THE DRAWINGS

FIGS. 62 to 64 are three views showing details of the design of the drum.

FIG. 64*b* is a detailed isometric view of the left end of the drum of FIG. 62.

DESCRIPTION OF THE PREFERRED EMBODIMENTS

1. Limited Description of the Invention

Figure 1:
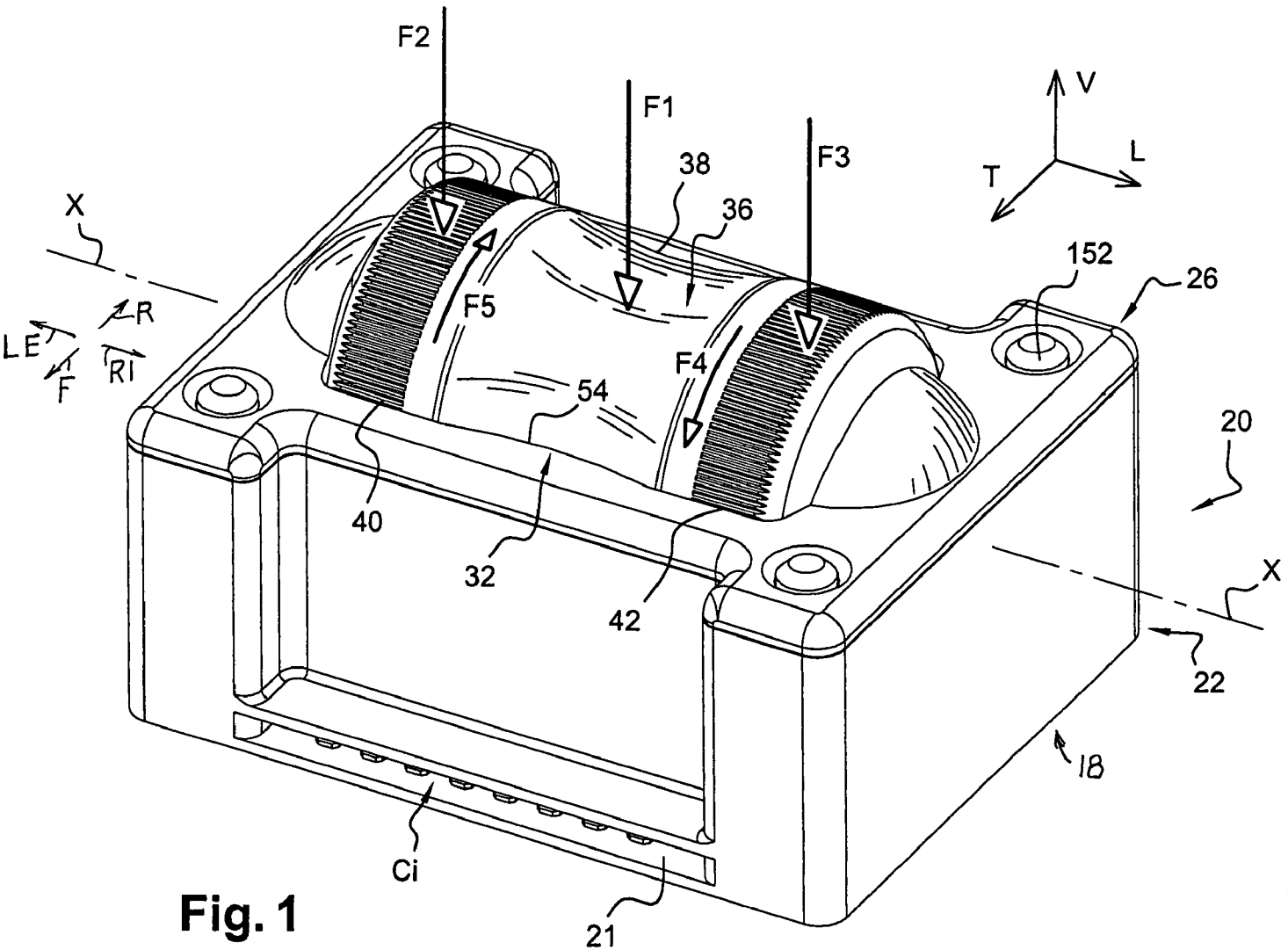
FIG. 1 is a top and right side isometric view of a control device of a first embodiment of the invention.

FIG. 1 illustrates a control or navigator 20 which includes a rotatable control member 32 that includes a drum 36 that can rotate about a control member axis X-X. Much of the control member lies in a housing 18 formed by a lower housing member 22 and a lid 26. The control device, or control generates electrical signals that sense five forces applied to the drum, including downward forces applied along arrows F1, F2 and F3, and rotational forces applied along arrows F4 and F5. Arrows L, T and V indicate longitudinal, transverse, and vertical directions. Arrows LE and RI indicate left and right longitudinal directions, while arrows F and R indicate front and rear transverse directions.

Figure 2:
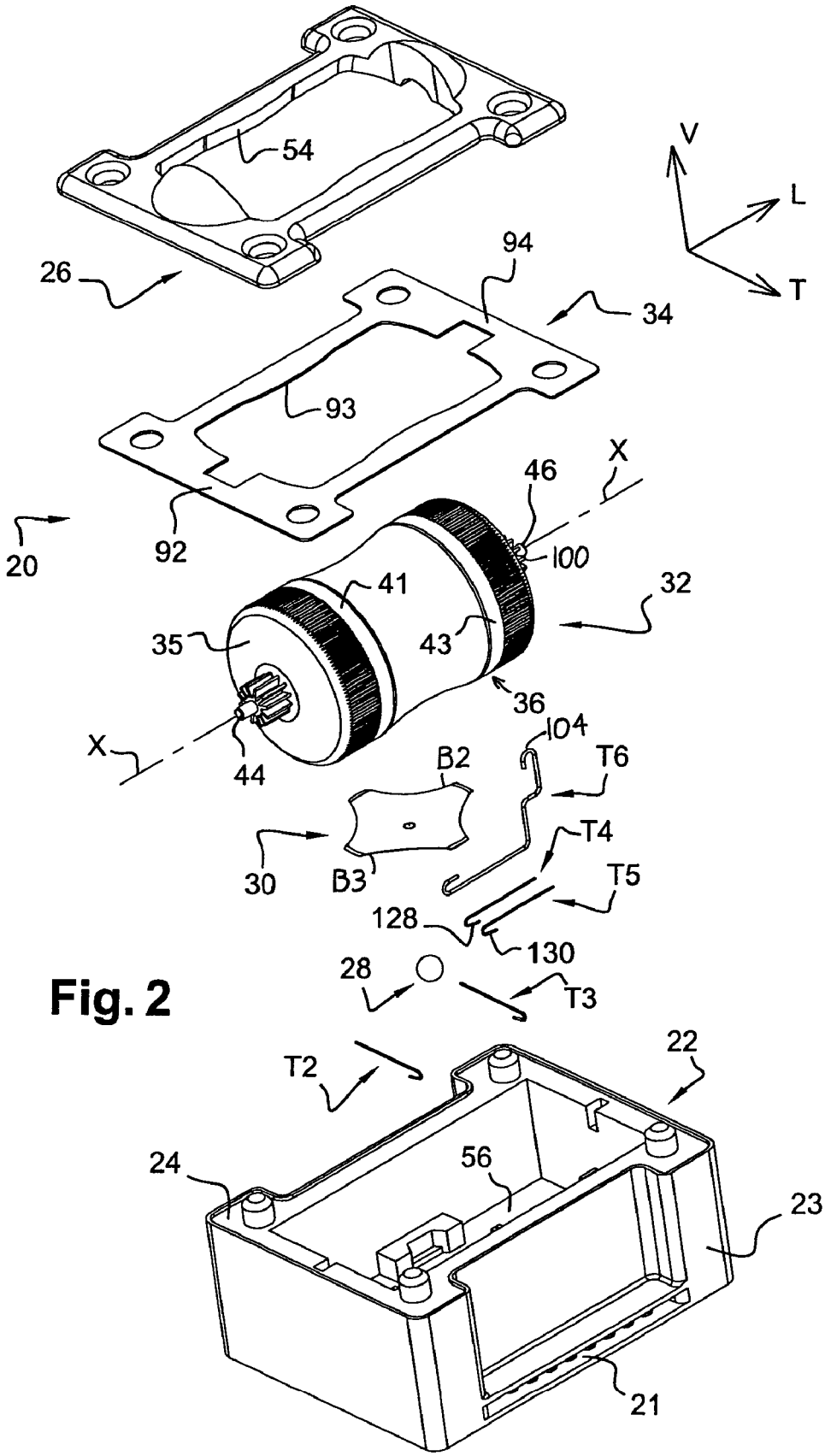
FIG. 2 is an exploded isometric view showing components of the device of FIG. 1.
Figure 3:
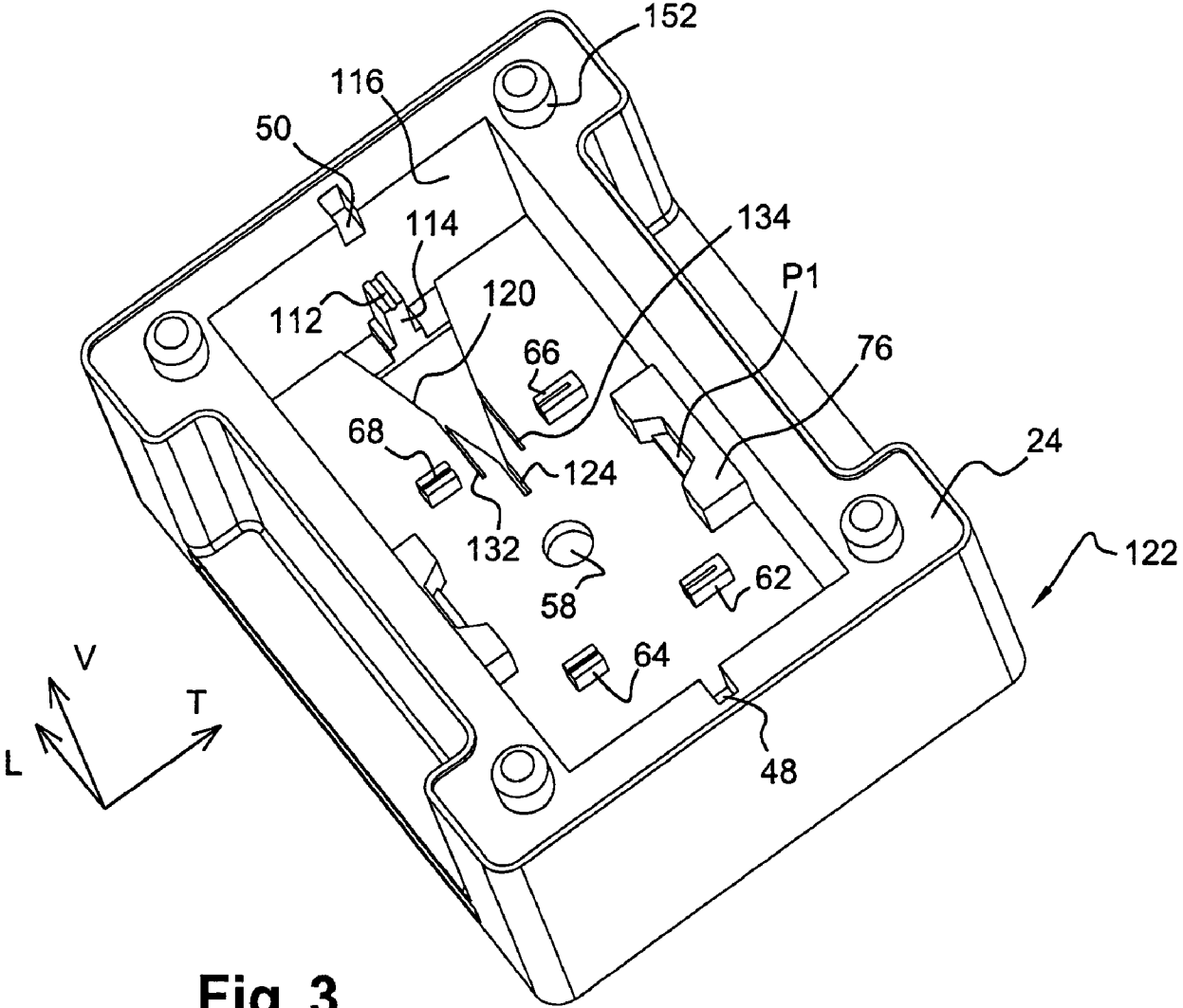
FIG. 3 is a top and left side isometric view of the lower housing of the device of FIG. 1.

FIG. 2 shows that the drum 32 has shaft ends 46, 44 and has multi-tooth wheels fixed to the shaft ends. A deflectable contact element T6 has a deflectable part 104 that is repeatedly deflected by the teeth of a multi-tooth wheel 100 as the drum is rotated. The deflectable contact element is used to generate electrical signals that indicate drum rotation and its direction. Downward deflection of each or both ends of the drum is detected by a sheet metal trigger member 30 with opposite ends B2 and B3. The ends of the trigger member engage one or both of two stationary contacts T2 and T3 formed of wire that are mounted on the housing.

Figure 12:
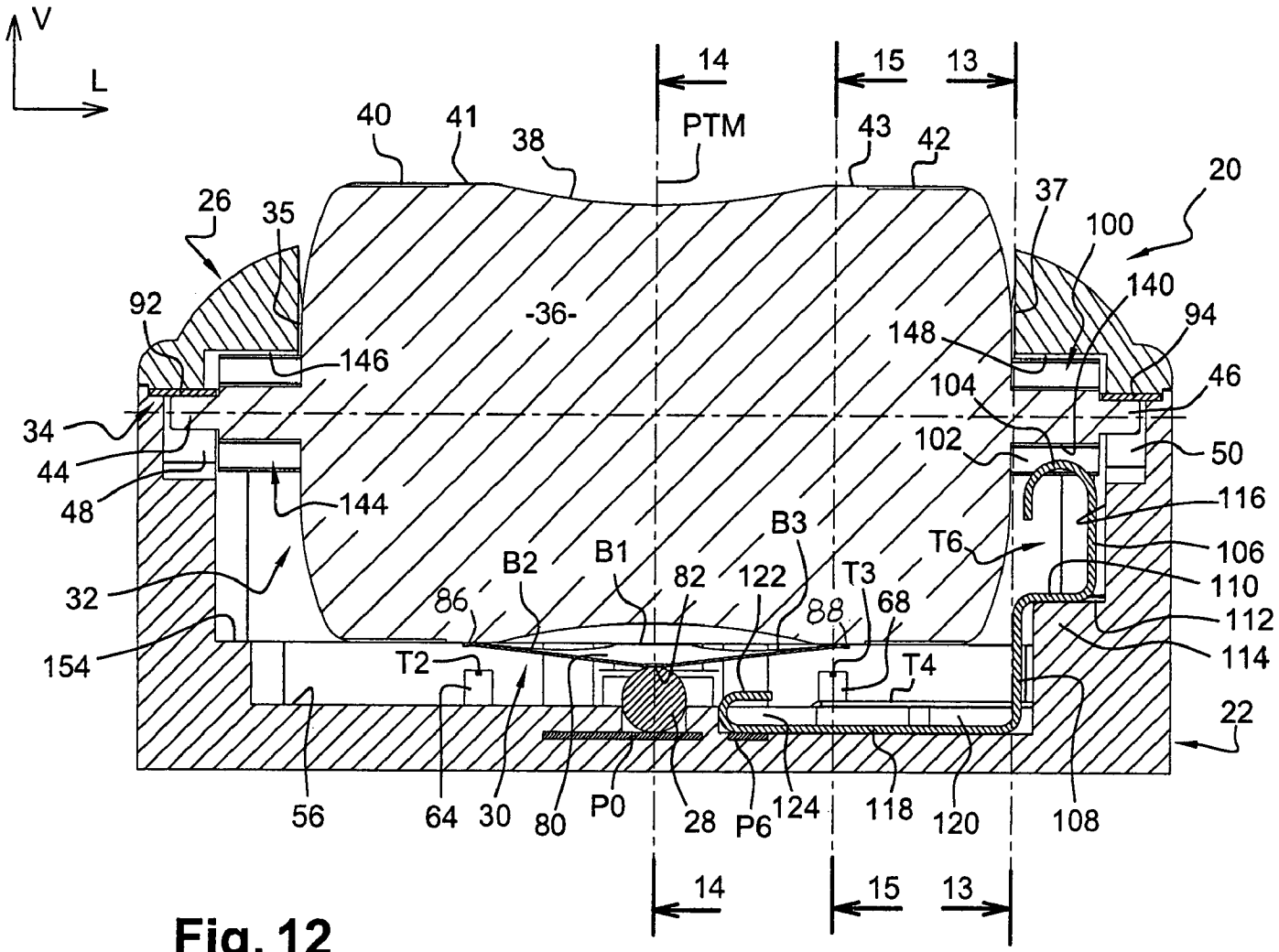
FIG. 12 is a sectional view along line 12-12 of FIG. 13.

FIG. 12 shows that the shaft ends 44, 46 lie in slots 48, 50 of the housing to allow the shaft ends to move down. The trigger member 30 has its middle at 82 supported by a ball 28 that lies in a hole in the housing. The left and right branches B2 and B3 of the trigger member extend at upward inclines from the middle and have their ends 86, 88 engaged with tracks 41, 42 of the drum. The branches B2 and B3 support the drum and press it upwardly so the shaft ends 44, 46 press up against walls at the upper ends of the slots 48, 50. When one end of the drum is depressed, the corresponding trigger member branch is downwardly deflected against one of the two stationary contacts T2, T3.

FIG. 12 shows that the deflectable portion or part 104 of the deflectable contact element T6 lies between teeth of the multi-tooth wheel 100. The deflectable contact element also has a mount portion or part 110 that lies in a groove 112 formed in the housing and that can pivot in the groove. With such pivotal mounting, deflections of the deflectable part 104 causes deflections of a contacting section or part 108 of the contact element, against stationary contacts such as T4. The deflectable contact element also has a biasing portion or part 118 with a near end that merges with the contacting part 108 and with a far end 122 that is fixed in position on the housing. The long biasing part 118 can readily bend to allow the deflectable part 104 to be deflected and allow the contacting part 108 to engage the stationary contacts such as T4, and the biasing part biases these sections back towards an initial position. The far end 122 of the deflectable contact is in constant engagement with a contact pad P6. The contacting part 108 repeatedly engages and disengages a stationary contact such as T4, to repeatedly close and open a circuit. Currents that pass though the circuit whenever it is closed constitutes a signal that indicates drum rotation.

Figure 13:
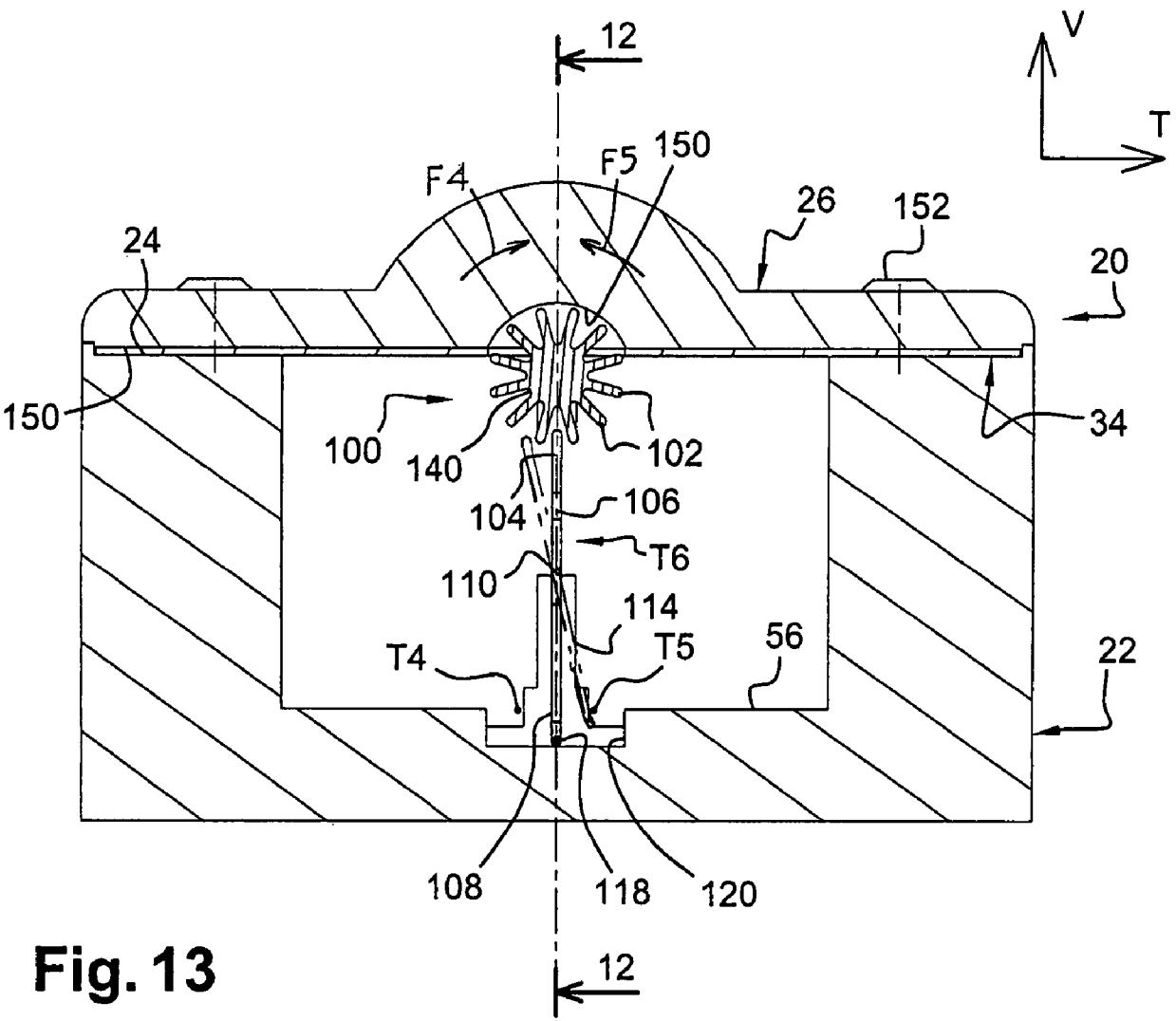
FIGS. 13 to 15 are sectional views taken respectively along lines 13-13, 14-14, and 15-15 of FIG. 12.

FIG. 13 shows that the contacting part 108 lies between the stationary contacts T4 and T5. FIG. 13 also shows, in phantom lines, the contacting part as it engages the stationary contact T5 when the multi-tooth wheel 100 turns in direction F4. The teeth of the wheel 100 repeatedly deflect the deflectable part 104 away from an initial position shown in solid lines in FIG. 14 and releases it, so the contacting part 108 repeatedly engages and disengages the stationary contact T5 to produce repeated pulses. When the wheel 100 turns in the opposite direction F5, the contacting part 108 repeatedly contacts stationary contact T4.

Figure 4:
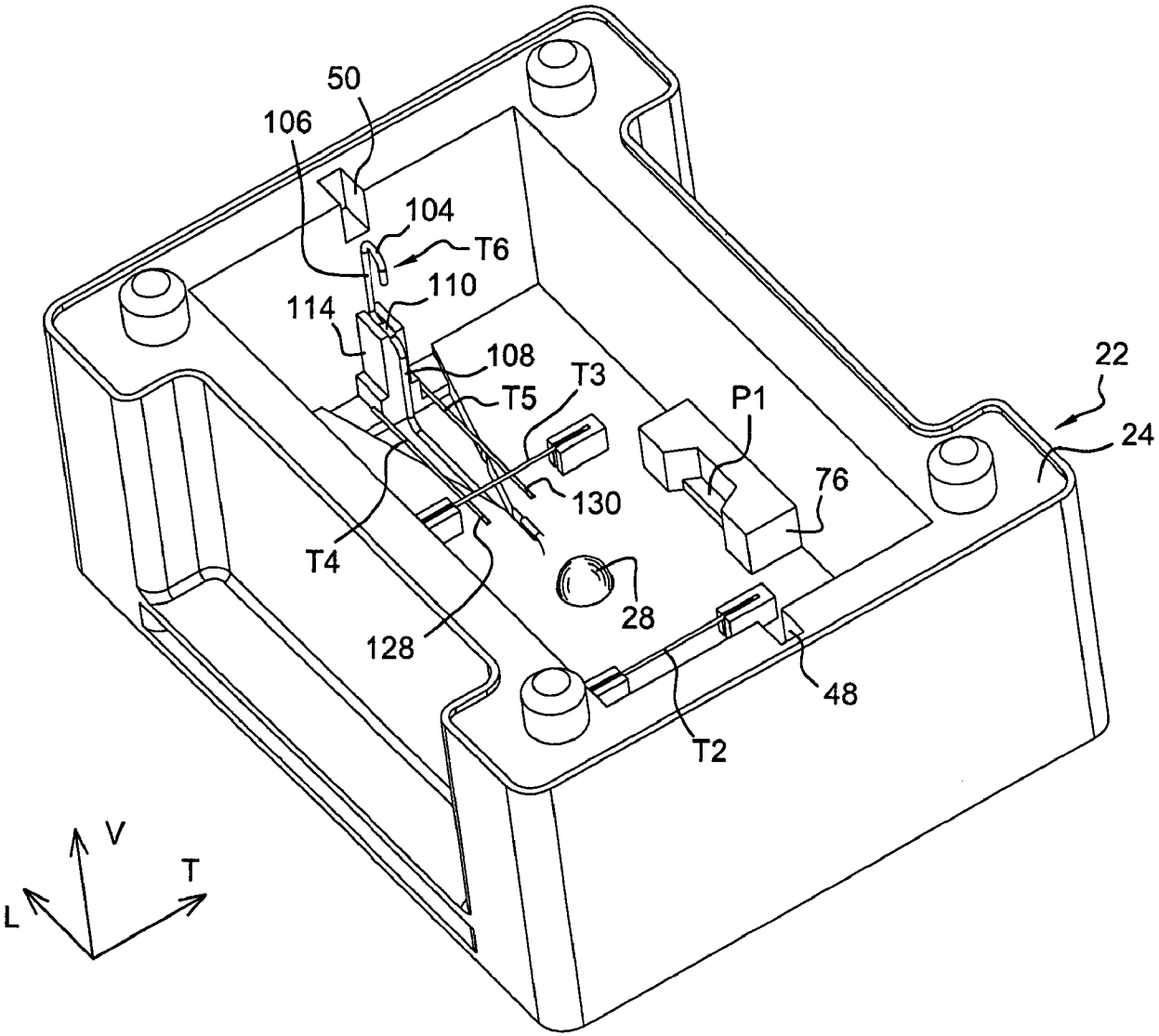
FIGS. 4 to 7 are isometric views similar to that of FIG. 3, illustrating different steps during the installation of the components in the lower part of the housing.
Figure 15:
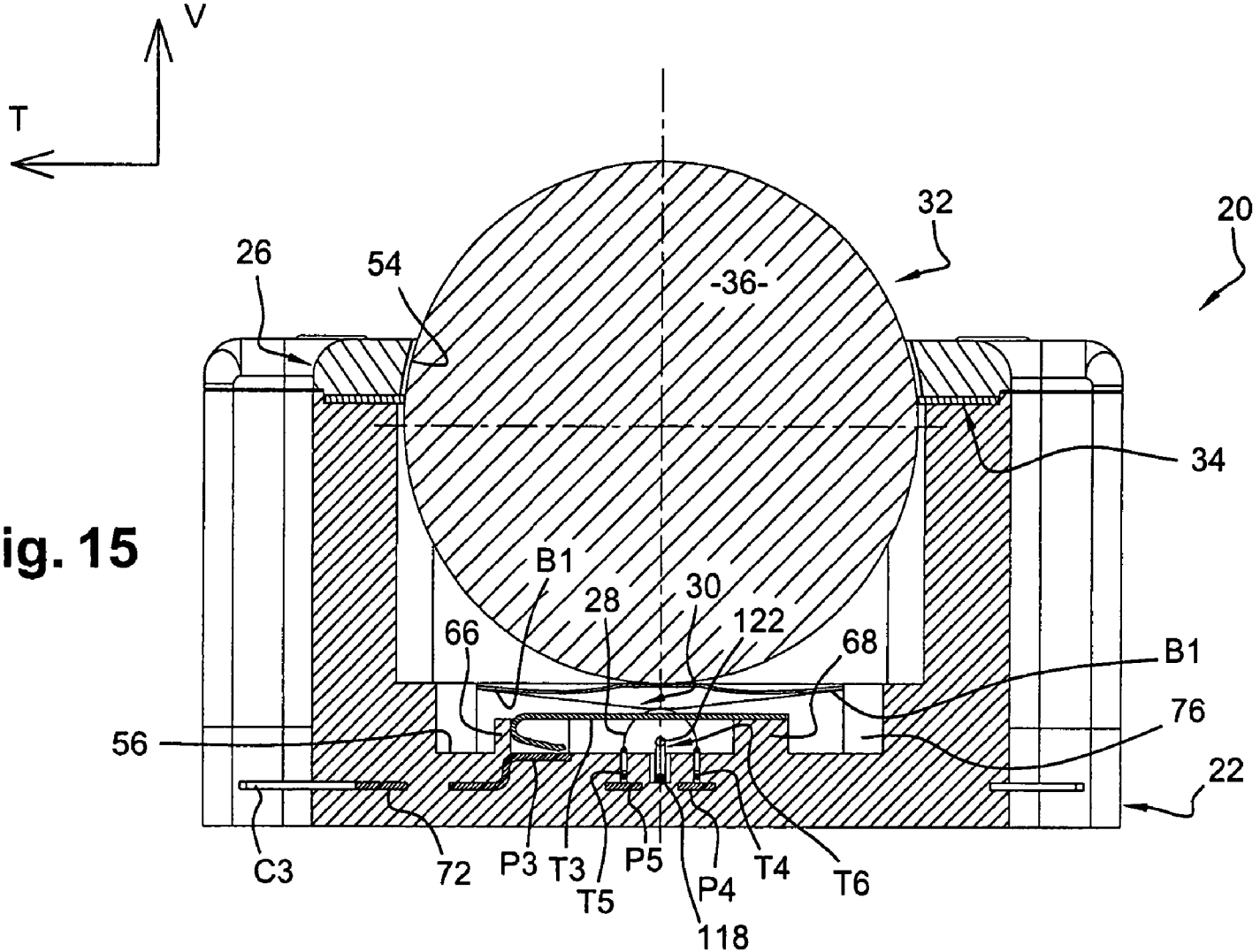
Figure 16:
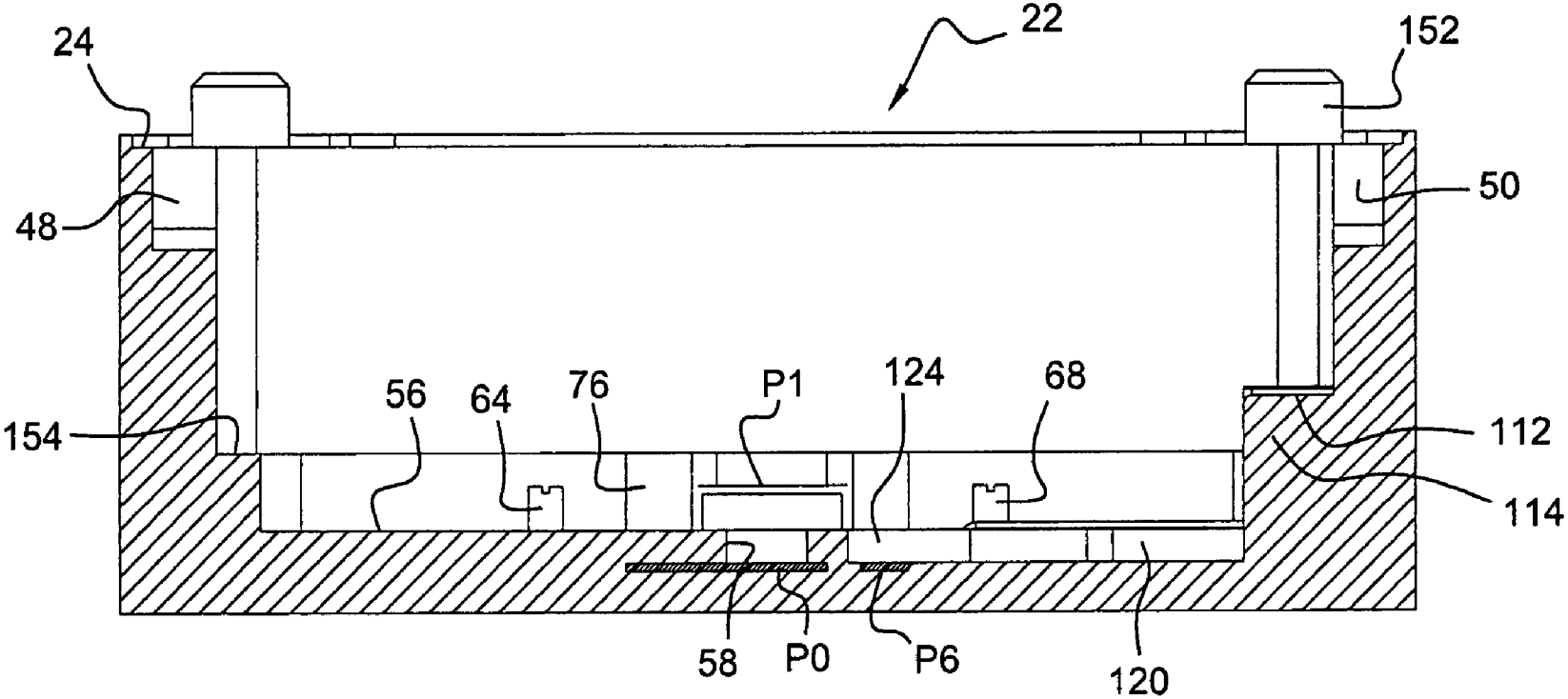
FIGS. 16 to 18 are views similar to those of FIGS. 12, 14 and 15, respectively, but showing only the lower housing.
Figure 17:
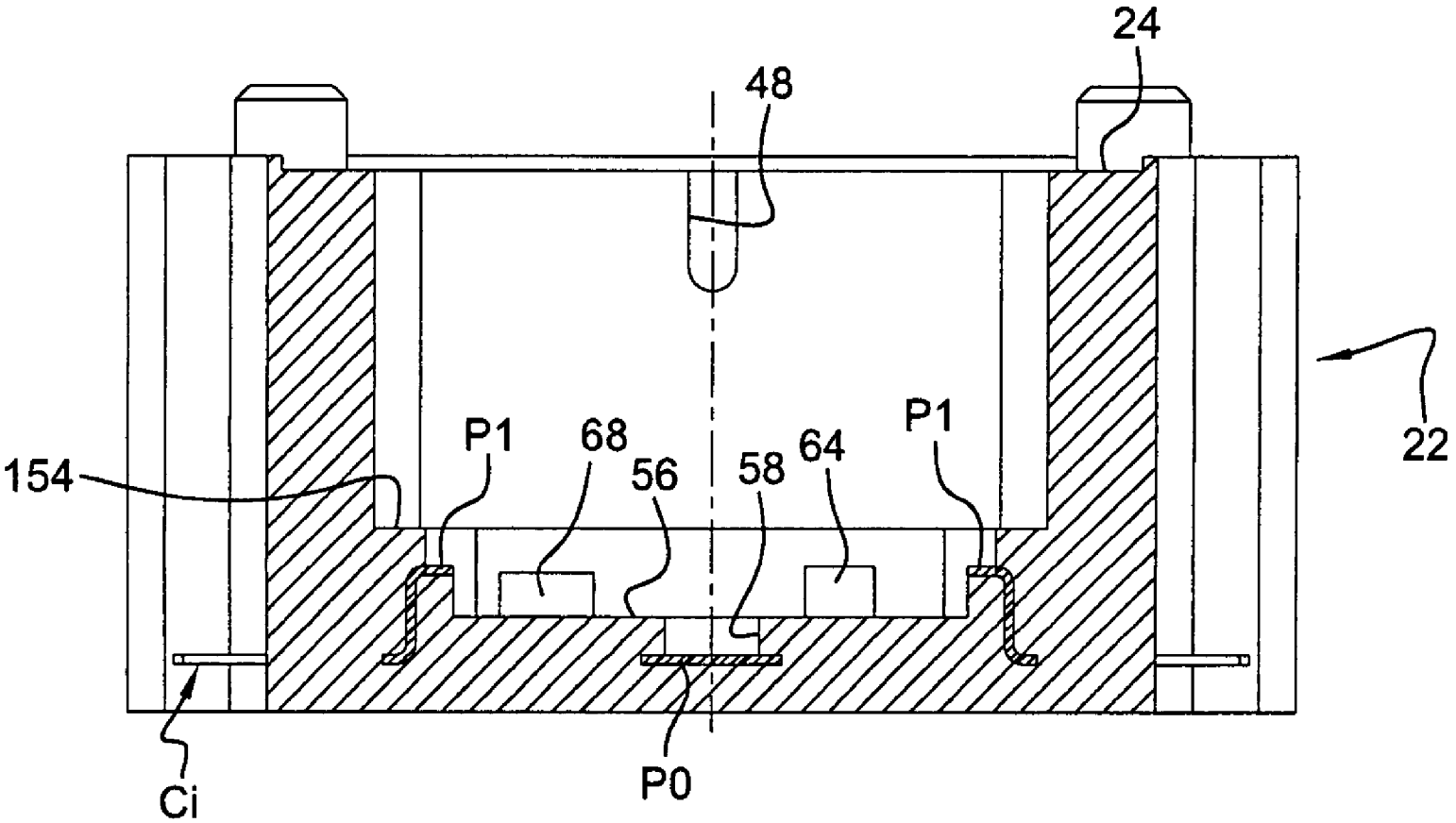
Figure 18:
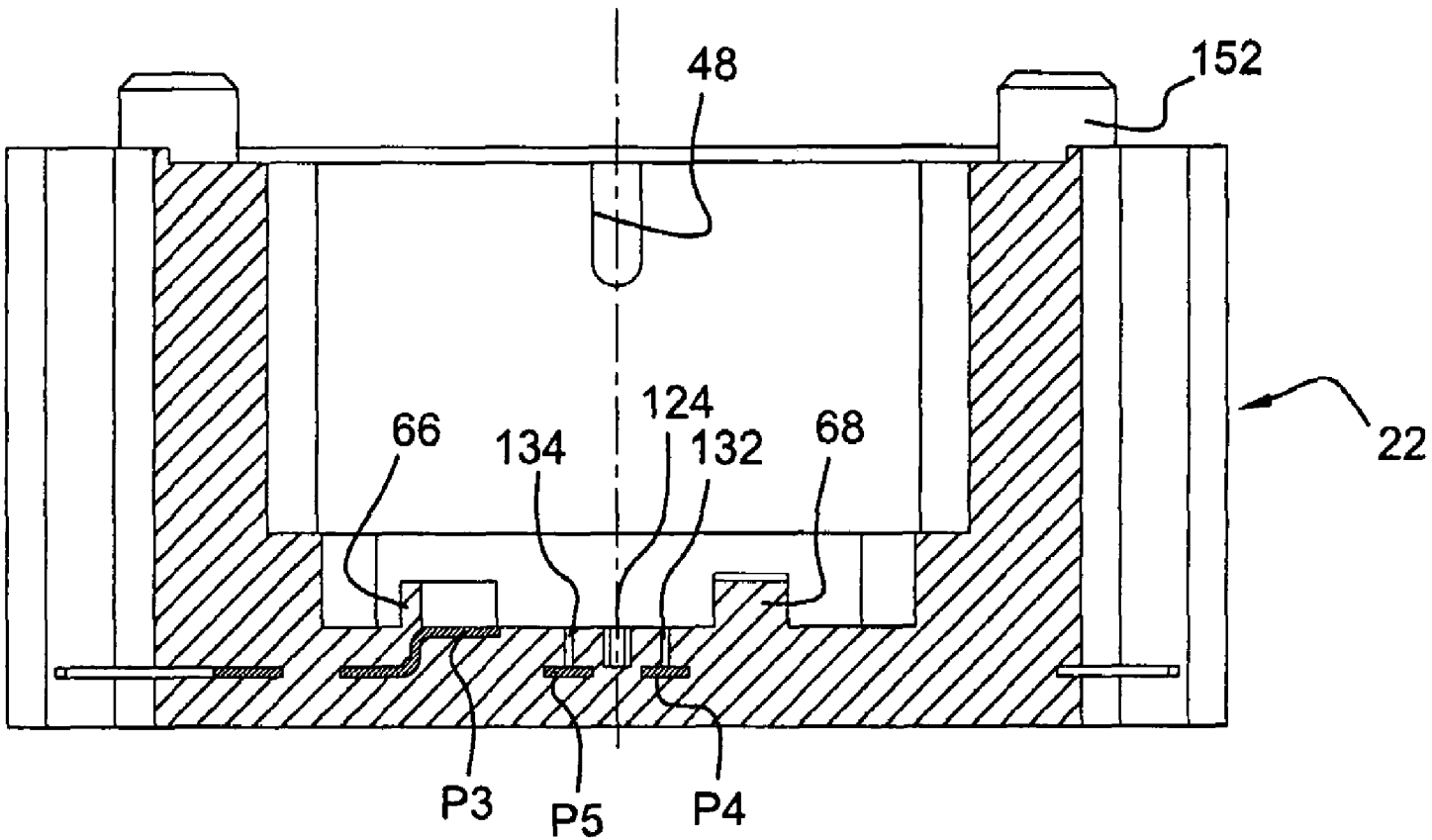

FIG. 4 shows that each stationary contact T4 and T5 has one end 128, 130 fixed in a slot in the housing, and has an opposite end that is cantilevered and therefore free to be deflected by the contacting part 108 of the deflectable contact element T6. The contacts T4 and T5 are referred to as "stationary" because at least one end lies in a fixed position, although a portion of each stationary contact can be deflected to allow overtravel of the deflected contacting portion 108 of the deflectable contact. FIG. 2 shows that each stationary contact element T4 and T5 has a fixed end 128, 130 that extends in a 180° loop. FIG. 15 shows that each loop of contacts T4 and T5 lies in a groove in the housing and engages a contact pad P4, P5.

Figure 30:
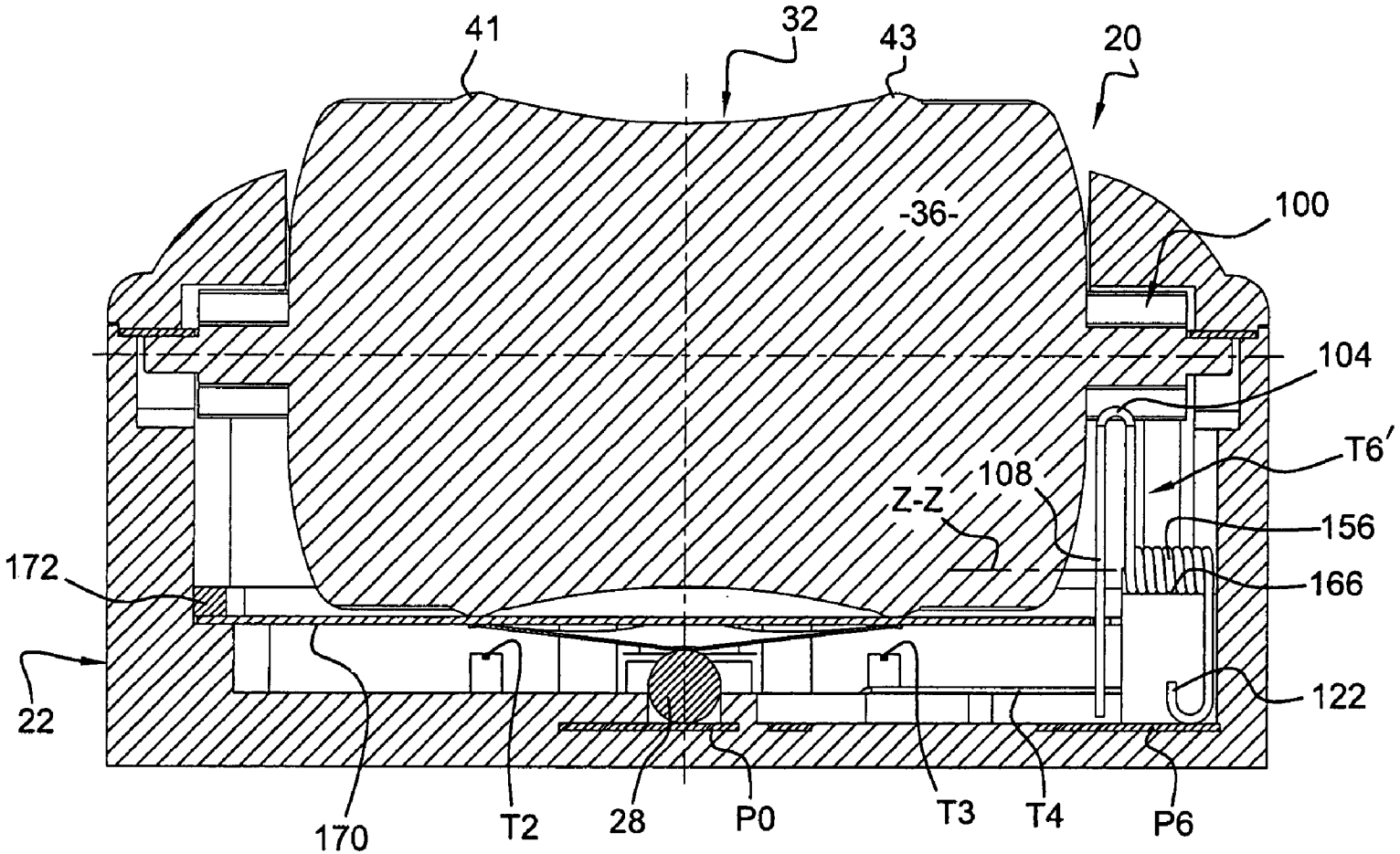
FIG. 30 is a view analogous to those of FIGS. 12 and 24, illustrating a variation of the rotary signals generator, and especially of its movable contact rod.

FIG. 30 shows another deflectable contact element T6' which includes a wound spring part 156 that is wound in at least one 360° turn and that lies in a housing groove. One end of the spring part, which can pivot merges with the deflectable part 104 that is deflected by the multi-tooth wheel. The other end of the spring part, which also can pivot, merges with a biasing part that has an end 122 that lies in a slot and that is in constant engagement with a contact P6. The contacting part 108 lies between two stationary contacts such as T4.

The deflectable contact element T6 (FIG. 2) or T6' (FIG. 30) and the stationary contacts T2, T3, T4 and T5 are each formed of metal wire. A wire has a width and thickness that are about the same, with neither one being more than twice the other. This facilitates pivotal mounting, bending including winding into a spring, and deflection.

Figure 5:
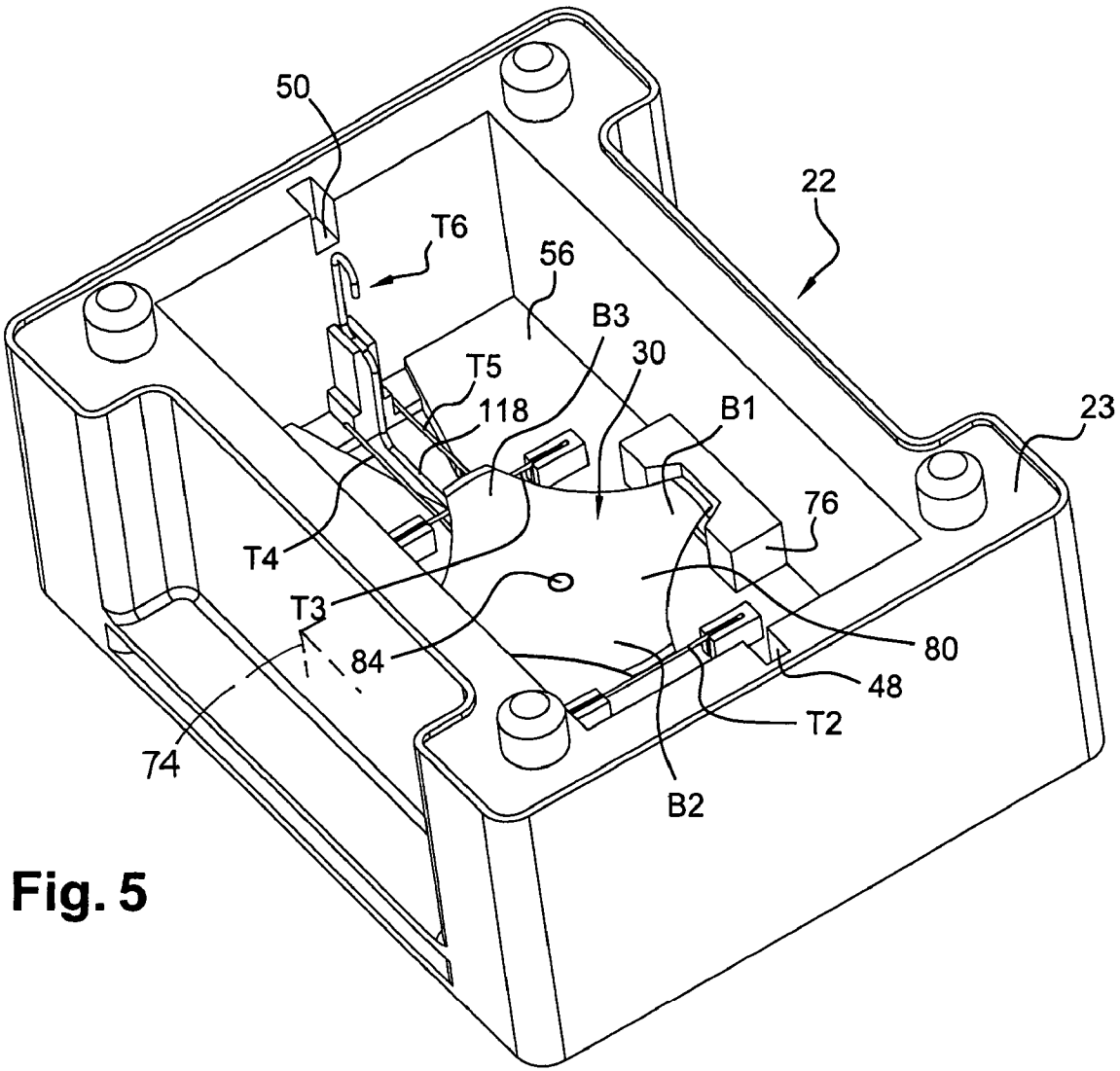
Figure 6:
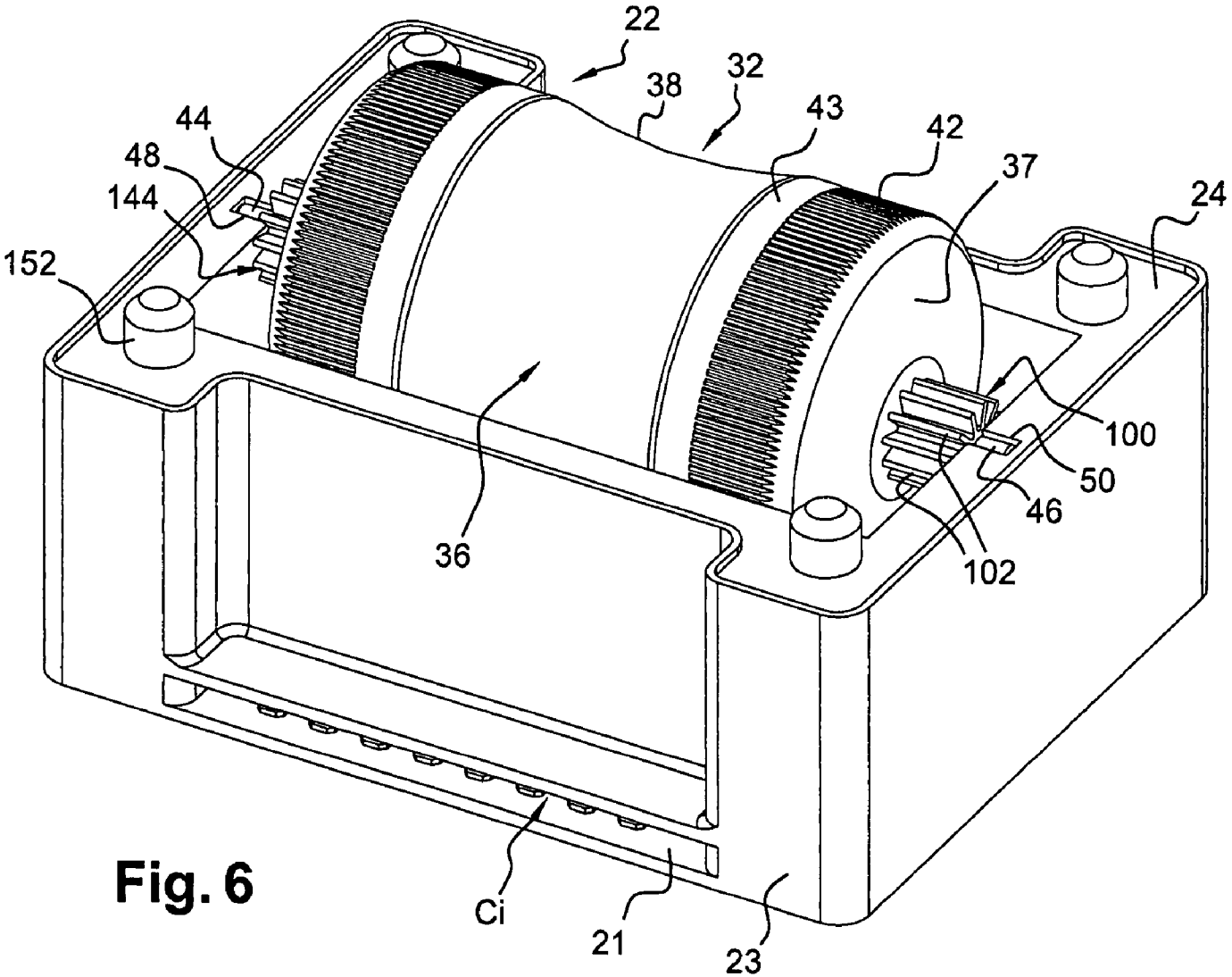
Figure 7:
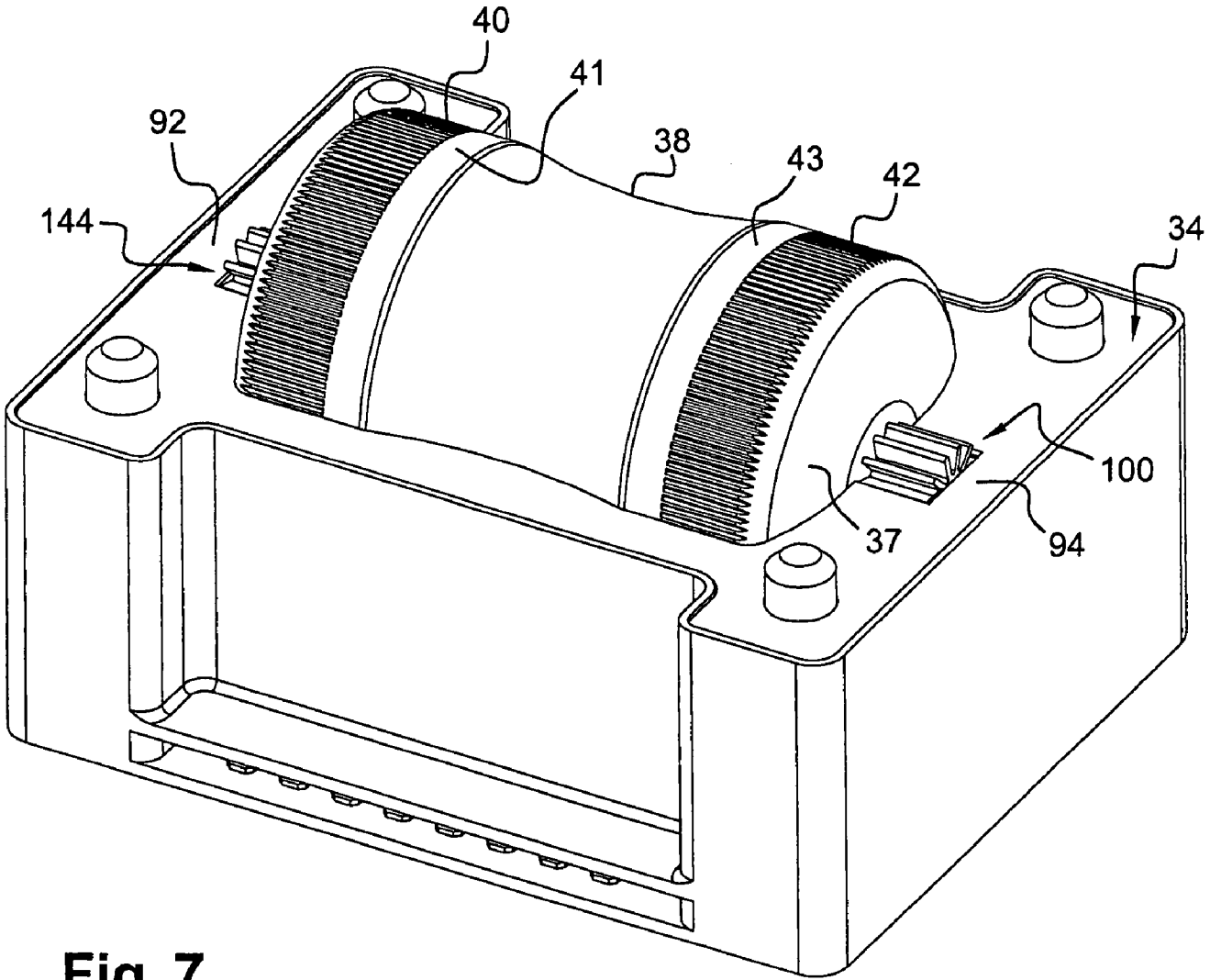
Figure 8:
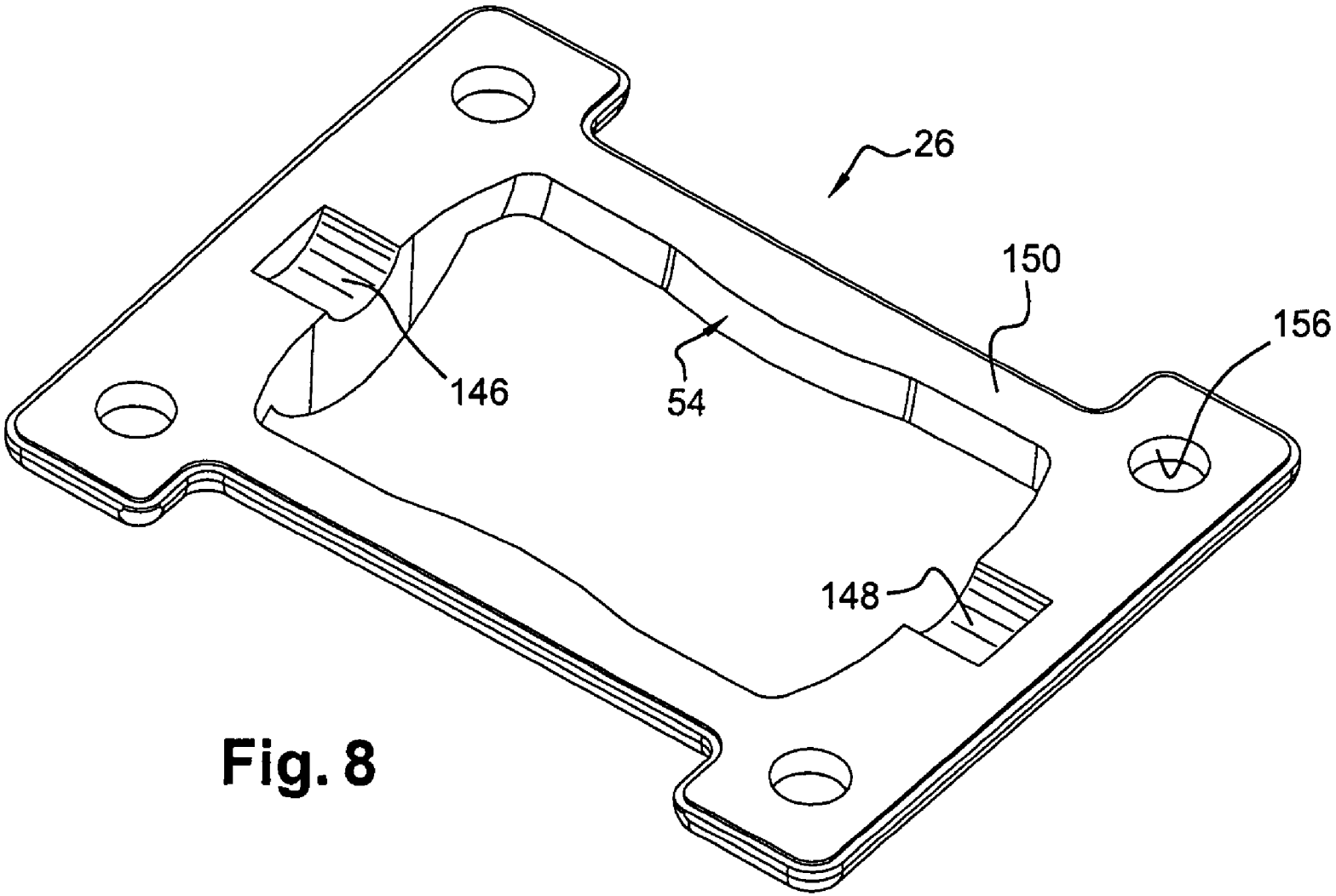
FIG. 8 is a bottom isometric view of the upper closing lid of the device of FIG. 1.

FIG. 5 shows that the sheet metal trigger member 30 has four ends or branches including front and rear opposite branches B1 and opposite branches B2 and B3. The front and rear branches lie on front and rear feet 74, 76 of the housing. The branches B2, B3 engage the drum 36, as shown in FIG. 12. The trigger member has a concave upper face, and the branches B2 and B3 extend at upward inclines from the middle 82 of the trigger member that is pivotally mounted on the ball 28, to the branch ends that engage and support the drum.

Figure 19:
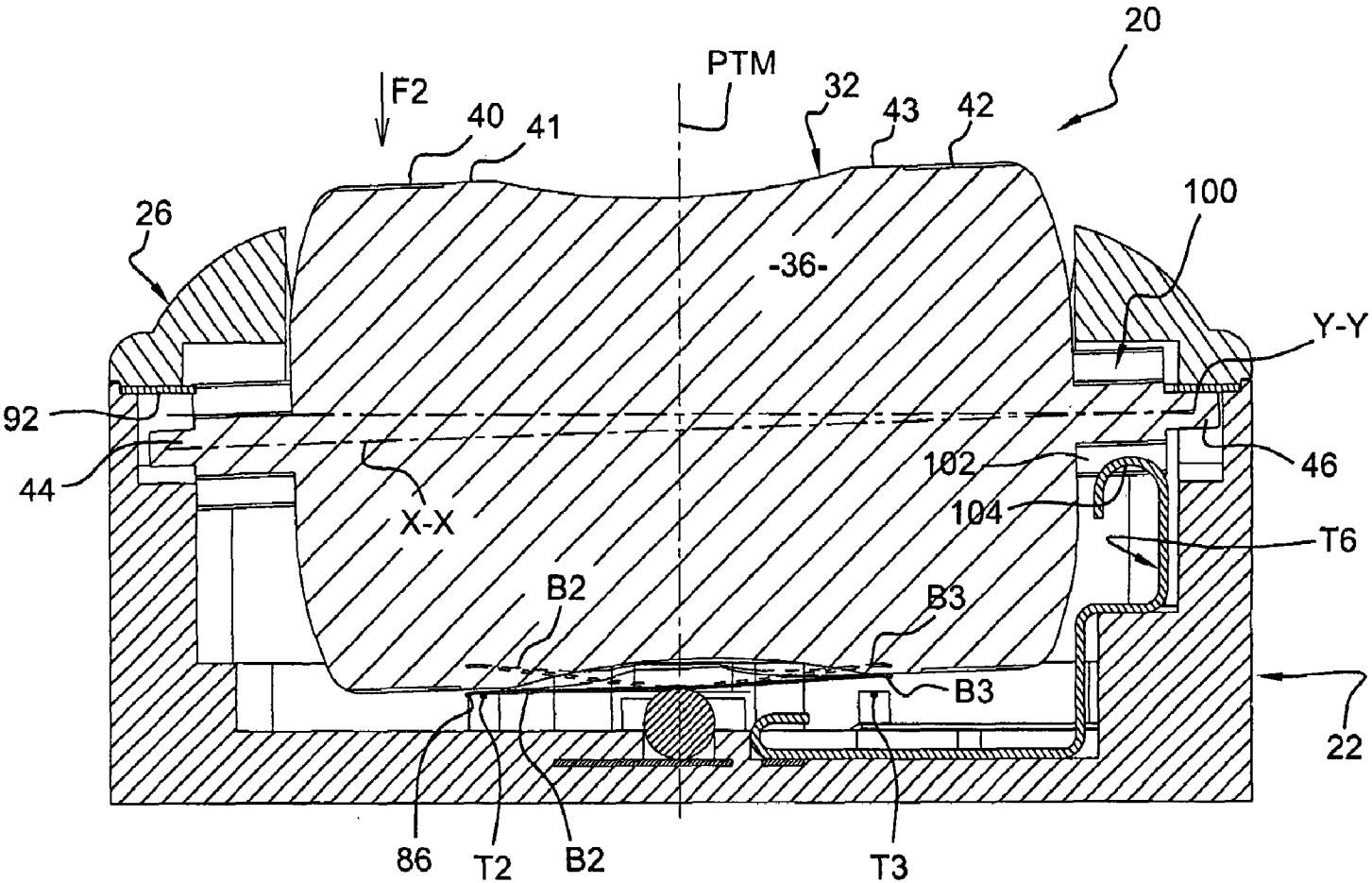
FIGS. 19 to 21 are views analogous to those of FIGS. 12 and 14, illustrating the device when a force F2 or F3 is applied to the drum.

FIG. 19 shows the left side of the drum depressed by a force F2. The branch B2 has been depressed into engagement with the stationary contact T2. There are no supports that impede downward deflection of the branch B2, so it can snap downward. That is, downward movement of each branch B2 and B3 is unobstructed, so the resistance of the branch to further downward deflection suddenly decreases as it is deflected partway down, resulting in a "click" which is a tactile feedback to the person who is applying the force F3. When the person feels and/or hears the click, that person knows that a signal has been generated and that he/she does not have to press even harder on the drum. This minimizes the possibility of damage to the control and harm to the person's fingers from repeatedly pressing hard, and allows the use of depressions of small height.

Figure 20:
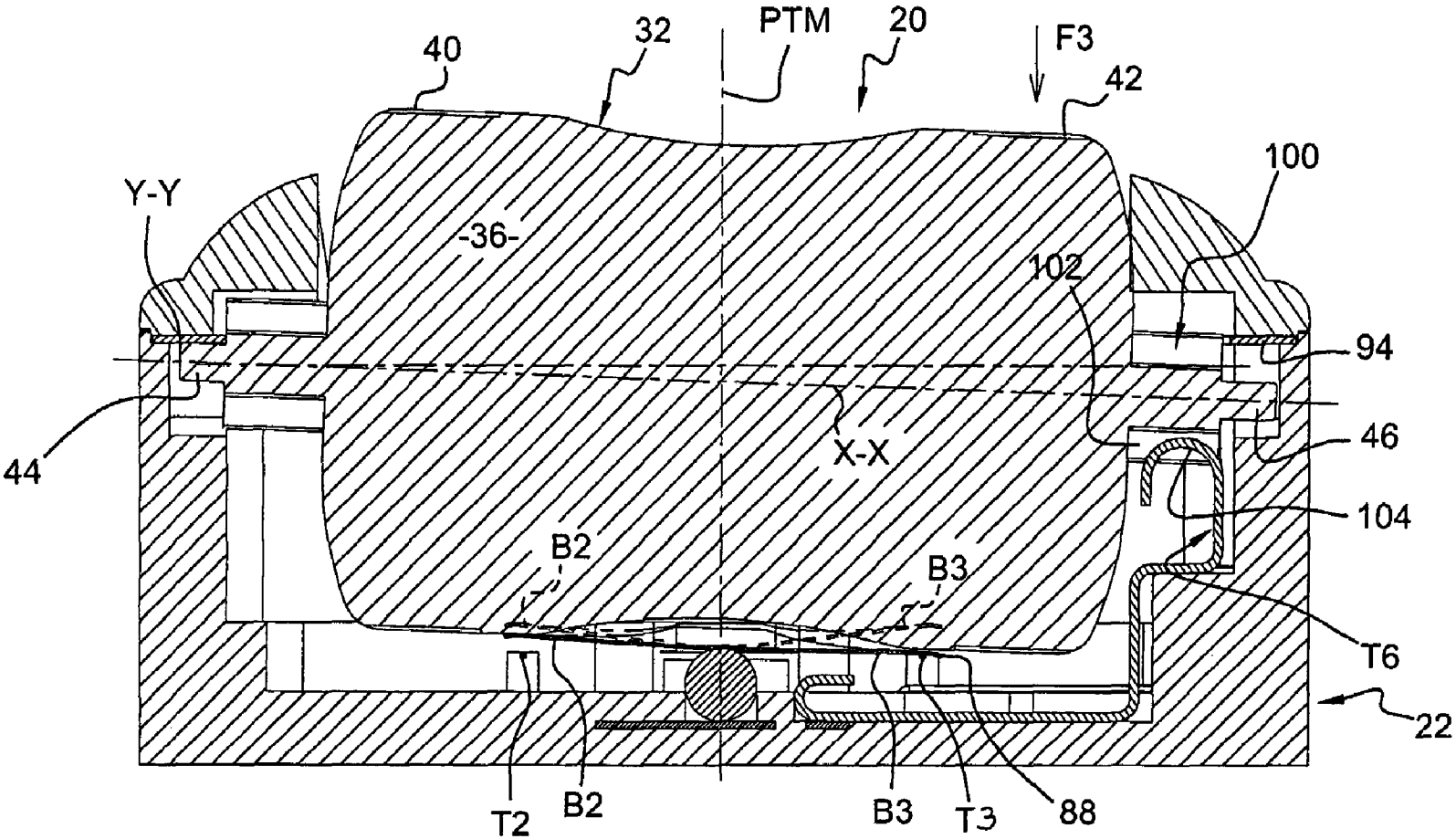
Figure 22:
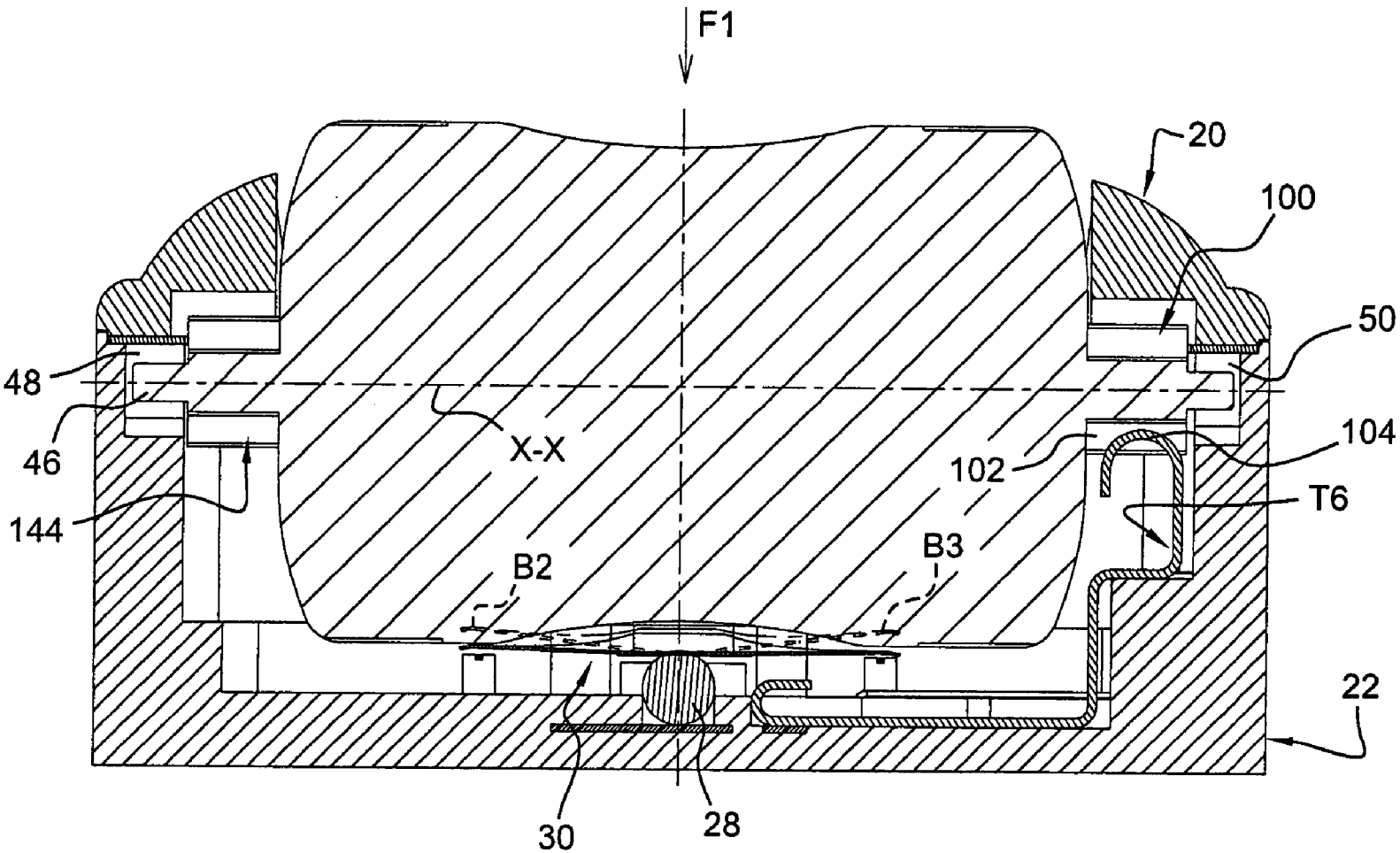
FIGS. 22 and 23 are views analogous to those of FIGS. 12 and 14 illustrating the device when a central force F1 is applied to the drum.
Figure 32:
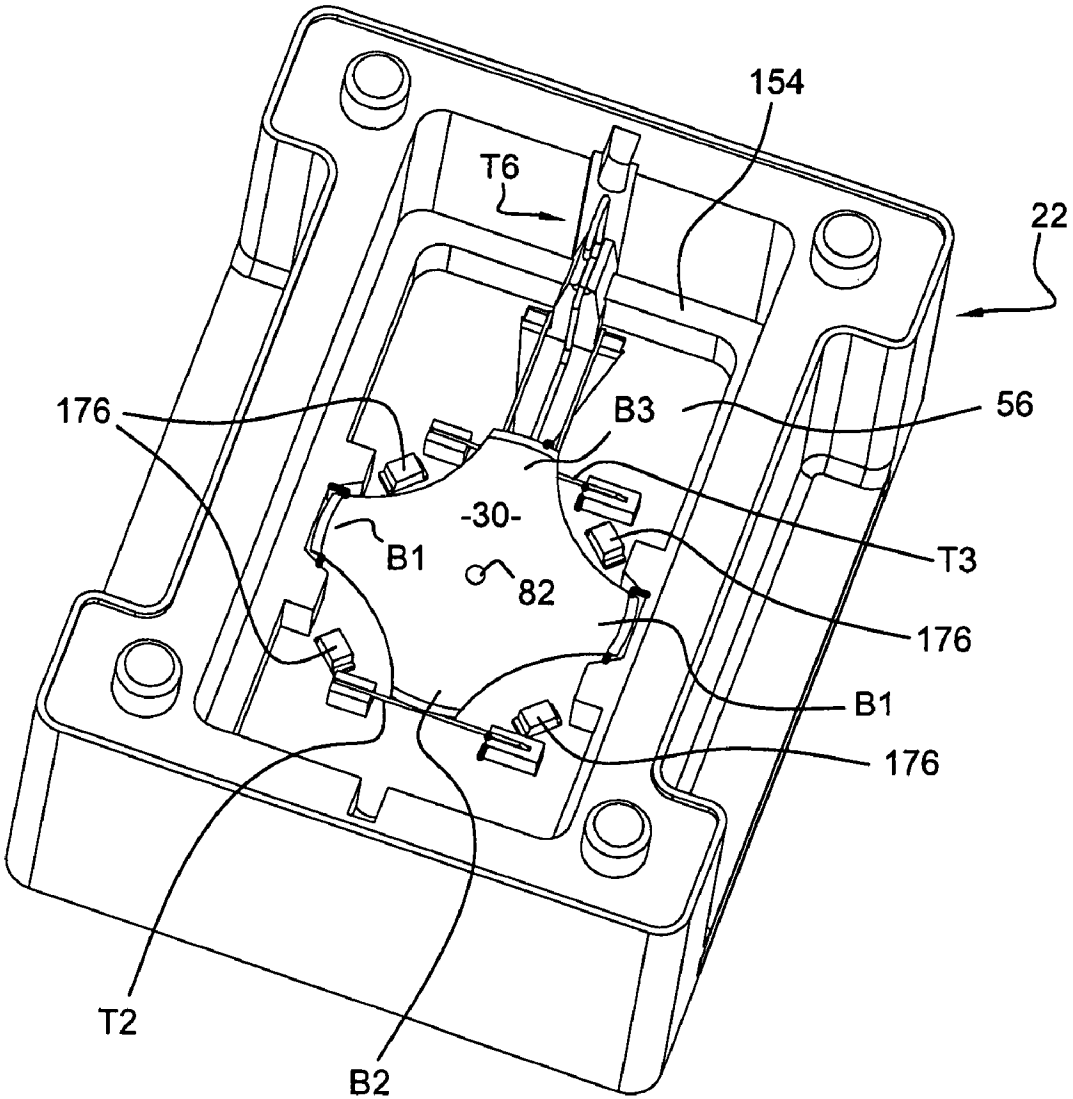
FIGS. 32 and 33 are views analogous to those of FIGS. 5 and 12 or 24, illustrating another embodiment comprising illuminating means for a translucent drum.

FIG. 20 shows the right side of drum depressed by force F3 to deflect branch B3 into engagement with stationary contact T3. FIG. 22 shows a force F1 applied to the middle of the drum, which results in both branches B2 and B3 being downwardly deflected against corresponding stationary contacts. The fact that electrical contact has occurred at both branches B2 and B3 results in the electrical circuitry determining that the force F1 has been applied. FIG. 32 shows one of the stationary contacts T2, showing that its ends are fixed and supported on feet of the housing. FIG. 2 shows that each stationary contact T2, T3 has a loop at its end that helps it engage a fixed contact P2, P3 (FIG. 9) on the housing.

FIG. 1 shows that the drum has a center portion 38 that is concave about its circumference and that is smooth. The opposite ends of the drum include cylindrical (constant diameter) knurled ring-shaped parts 40, 42 that have multiple ridges. The different "feels" of the center and ends of the drum allow a person to sense when his finger lies on the center or one of the ends of the drum. As shown in FIG. 12, the drum has smooth tracks 41, 43 adjacent to the knurled tracts, and the ends of the branches B2, B3 of the trigger member press toward the smooth tracks. The ends of the branches B2, B3 can directly engage the smooth tracks as shown in FIG. 12, or can press against a sealing film shown at 170 in FIG. 24, that presses against the drum.

Figure 14:
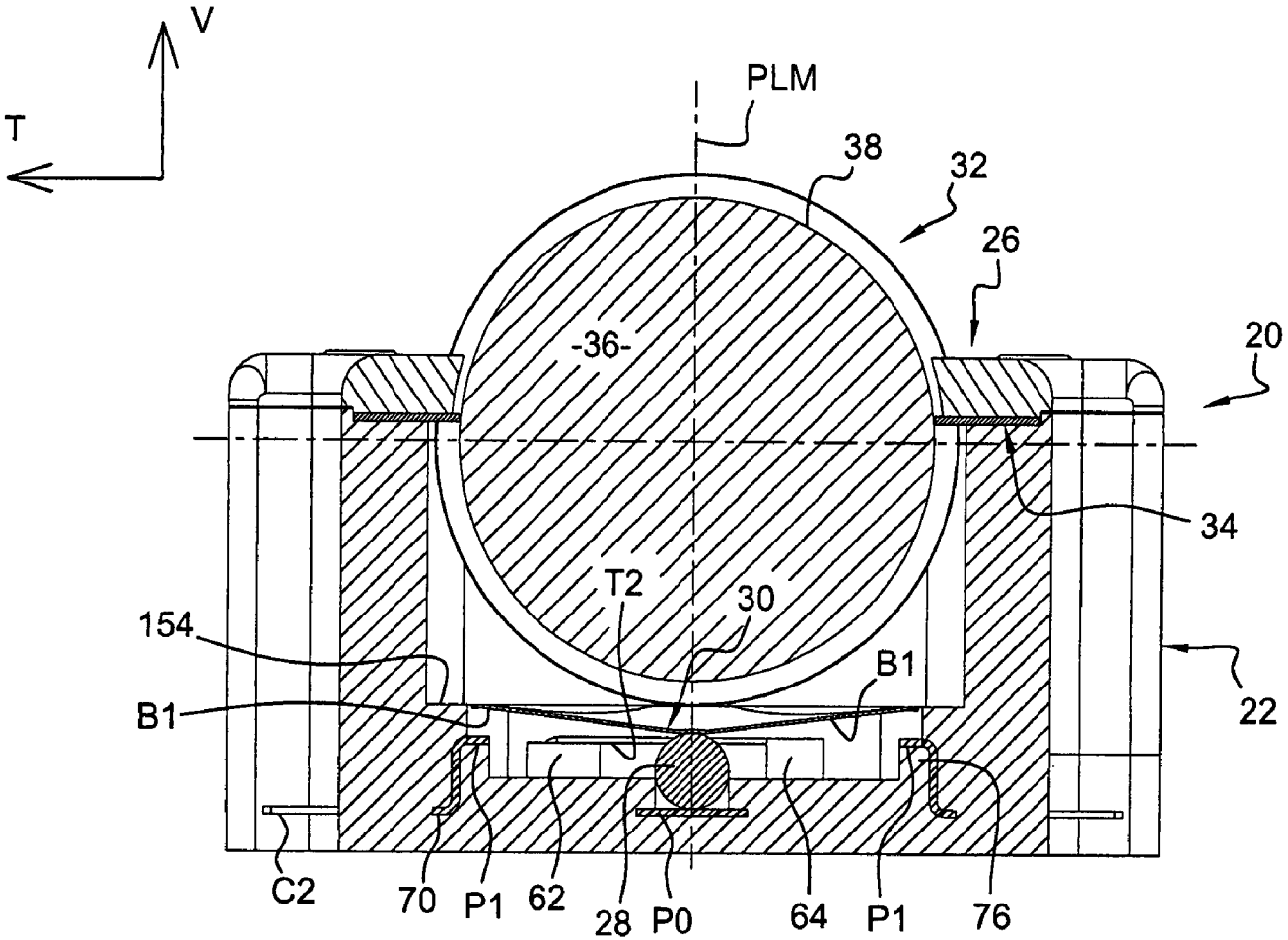

FIG. 2 shows a sealing sheet 34 of elastomeric material (Young's modulus of elasticity of no more than 50,000 psi) that is clamped between the lower housing 22 and the lid 26. As shown in FIGS. 14 and 20, the sealing sheet extends toward the drum further than the lower housing or lid, and directly contacts the drum to seal out dirt.

Figure 45:
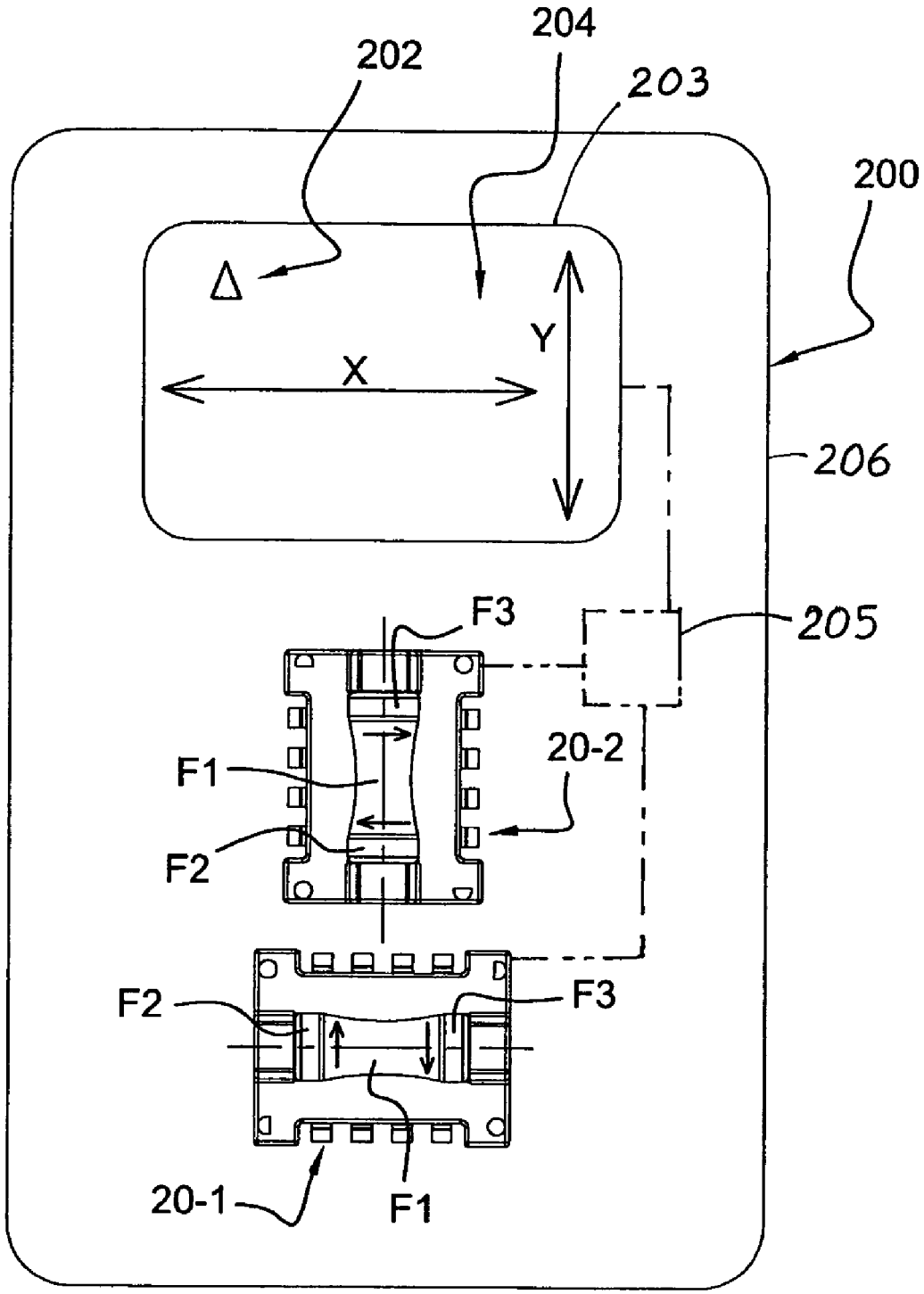
FIG. 45 is a diagrammatic view illustrating an electronic appliance equipped with two control devices of the invention.

FIG. 45 illustrates a control system 200 that includes a frame 206 and a display 203 with a screen 204. An electronic driving circuit 205 controls the image on the screen and, in particular controls a cursor 202 that can move on a background such as a list of items or a game image. Two controls 20-1 and 20-2 that are each of a type shown in the drawings such as the type of FIGS. 1-23, are oriented with their drum rotation axes angled 90° to each other. Rotation of the drum of control 20-2 controls movement of the cursor along horizontal directions X on the screen, while rotation of the drum of control 20-1 controls movement of the cursor along the supposed vertical directions Y-Y on the screen.

Figure 47:
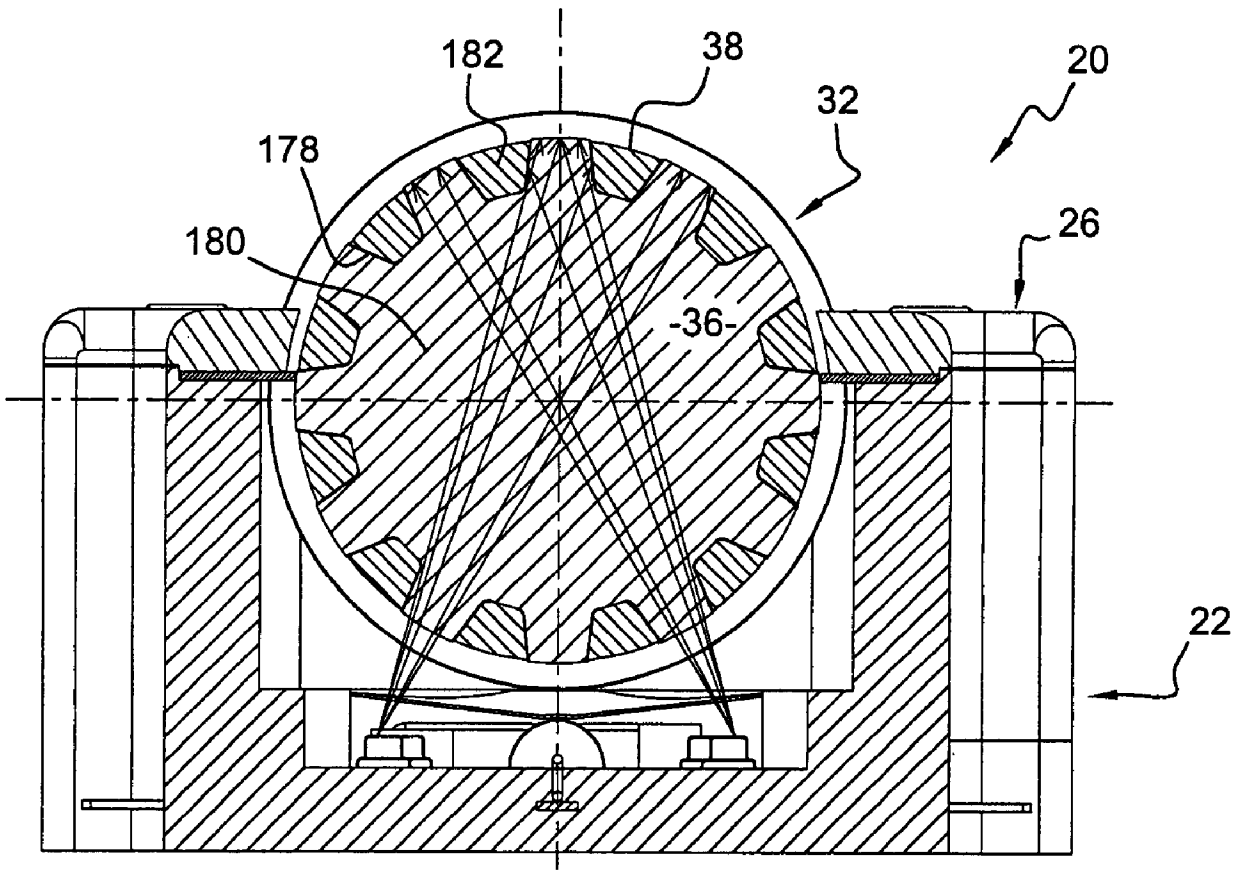
FIG. 47 is a sectional view of the device of FIG. 33, showing light rays.

The drum shown at 180 in FIG. 47, can be made of translucent material, and a light source such as LEDs (light emitting diodes) lying under the drum, can be used to illuminate the drum. Opaque sections 182 of the drum can visually indicate turning.

A control of the construction shown in FIGS. 1-23 is suitable for automotive applications. A control of this type that applicant has designed has a drum of 16 mm diameter, with the overall dimensions of the housing being 36×27×18 mm. Another control designed for integration into a mobile telephone has a drum diameter of 3.5 mm and overall dimensions of 12.9×10×4.5 mm.

Thus, the invention provides a manually operable control of the type that has a rotatable member such as a drum, and that has signal generating apparatus that generates signals indicating the direction of drum rotation and that indicates when the drum is depressed. A gear, or multi-tooth wheel is fixed to the drum, and a deflectable contact element generates signals when the drum and wheel turn because the wheel repeatedly deflects a deflectable part of the deflectable contact element. The contact element can be formed of a wire, and can be pivotally mounted on the housing by holding a mount part of the wire in a groove of the housing. In one embodiment, the wire includes a coil spring portion that pivotally supports the deflectable part of the deflectable contact element while biasing it towards an initial position. Downward depression of the drum is sensed by a sheet metal trigger member that has a center supported on the housing, such as through a ball lying on the housing, and that has opposite branches that each extends at an upward incline away from the center and that supports an end of the drum. Each end of the drum is unimpeded to downward snapping of a corresponding branch.

2. Detailed Description of the Invention

For the description of the invention, the orientations vertical, longitudinal and transverse, according to the reference marking trihedron V, L, T indicated in FIG. 1, shall be adopted on a non-limiting basis.

By convention, the terms lower, upper, front, rear, and left, right with reference to FIG. 1 shall also be adopted.

In the following description, identical, similar or analogous elements belonging to the embodiments according to the invention shall be designated by the same numerical or alphanumeric references.

The navigator or control device 20 (FIG. 2) comprises a lower housing 22 in the general shape of a substantially parallelepipedal rectangle, the upper face 24 of which is upwardly open, and an upper closing lid 26 for the lower housing, which latter houses the principal components of the device 20.

These components comprise, in the first embodiment both from the bottom up and in the bottom of the housing 22, two left T2 and right T3 horizontal, transverse fixed contact rods, two rear T4 and front T5 horizontal, longitudinal fixed contact rods and a fixed central contact ball 28, as well as a movable contact rod T6 belonging to a rotary signals generator associated with the longitudinal rods T4 and T5.

Then, from the bottom up, a central trigger member 30 in the general shape of a star having four trigger branches Bi, a sole or single manual control member 32 of longitudinal and horizontal rotation axis X-X and a flat sealing joint 34.

The sole manual control member 32, which is here realized molded in a one single piece, is basically constituted by a rotary operating drum 36, the central section 38 (FIG. 1) of which is of reduced diameter, and of inwardly curved or concave profile, relative to its two knurled longitudinal end sections, left 40 and right 42, or is lined with a "soft-feeling elastomer outer skin (not shown).

The drum 36 is designed to be rotated by its slender central part 38, which, for this purpose, can comprise longitudinal ribs (not shown in this embodiment). The control member 32 also comprises a central shaft, which is extended, beyond the longitudinal end side left and right faces 35, 37 of the drum 36, by two longitudinal end sections, left 44 and right 46, for the rotation-mounting and guiding-mounting of the member 32 in the lower housing 22, which, for this purpose, comprises two median vertical and longitudinal slots, left 48 (FIG. 3) and right 50, which emerge vertically in the upper face 24 and each of which receives, in rotational and vertically sliding arrangement, the corresponding section 44, 46 respectively.

The slots 48 and 50 also provide for the longitudinal, play-free positioning of the control member 32 relative to the housing 22.

The control device or navigator 20 (FIG. 1) is here a device having five switching ways, each of which can be used independently of the others through the application of a corresponding force Fi to the control member 32.

The first switching way is a so-called "SELECT" way, which is used by applying of a centered vertical force Fl to the central section 38 of the drum 36, by which, for example, a set position reached by a cursor on a flat screen of an electronic appliance (see, for example, FIG. 45) equipped with the navigator 32 can be selected or enabled, each application of a vertical force F1 allowing a selection signal or pulse to be produced or generated.

The second switching way is, for example, a so-called "LEFT" displacement way for displacement towards the left of the screen, which is used by applying a vertical force F2 to the left section 40 of the drum 36, each application of a vertical force F2 allowing a "LEFT" displacement signal or pulse to be produced (FIG. 19).

In a symmetrical fashion, the third switching way is, for example, a so-called "RIGHT" displacement way for displacement towards the right of the screen, which is used by applying a vertical force F3 to the right section 42 of the drum 36, each application of a vertical force F3 allowing a "RIGHT" displacement signal or pulse to be produced (FIG. 20).

The circuits of the operated electronic appliance can provide that, if the user keeps the drum "pressed" down according to F2 or F3, the pulses are repeated in continuous trains of identical pulses ("Scrolling"), in the same way as for a computer keyboard on which the key or button is kept pressed.

The fourth switching way is, for example, a so-called "DOWN" displacement way for displacement towards the bottom of the screen, which is used by applying to the central part 38 of the drum 36 a circular force F4 tending to rotate it in a first direction or sense so as to generate a series of control signals or pulses by means of a signals generator 52 which will be described below.

In a symmetrical fashion, the fifth switching way is, for example, a so-called "UP" displacement way for displacement towards the top of the screen, which is used by applying to the drum 36 a circular force F5 tending to rotate it in a second direction or sense so as to generate a series of control signals or pulses by means of the signals generator.

The application of the forces F2 or F3 to the drum 36 might be facilitated by the presence of the knurls at its ends 40 and 42, which indicate to the user that they are zones on which it is necessary to press. However, as it will be seen later with respect to the last embodiment, these zones might also be flush without knurls, the knurls being preferably arranged in the central potion for rotational driving.

The general concept of the device according to the invention with its single actuator or control member 32 does permit to have different values for the central SELECT force F1 and the lateral LEFT, or RIGHT force F2, or F3 in a ratio between 1.5 to 2. This is due to the possibility to dimension the drum and its various central and lateral 40, 42 actuating zones along the longitudinal axis, as well as the dimensions of the switching branches of the central trigger member 30.

Also, the external shape or profile of the drum, in combination with the arrangement and dimensioning of the trigger member under the drum is thus that any vertical or substantially vertical effort applied to the central concave section or portion 38 of the drum member is inherently an effort of the F1 type which does provoke a switching of the first way. On the contrary, any effort applied on the lateral left or right section (40 or 42) is inherently an effort of the F2 or F3 type which does provoke a corresponding switching of the second or third way.

The navigator 20 has a general design symmetry relative to the median vertical and longitudinal plane PLM (FIG. 9) in which is situated the rotational axis X-X of the drum member 32, and a general symmetry relative to the median vertical and transverse plane PTM, with the exception of the means, constituting the signals generator 52, which are here gathered together in the right-hand part of the housing 22 and which have no symmetrical counterpart in the left-hand part of the housing.

In its center, corresponding to the intersection of the planes PLM and PTM, the flat horizontal bottom 56 (FIG. 9) of the housing 22 contains a receptacle 58, which receives the central metallic ball 28, the upper section of which, in the form of a convex spherical cap, projects vertically above the plane 56.

The ball 28 cooperates with a common, fixed, central contact pad PO, which is connected, by a strip conductor (or conducting strip) 60 (see FIG. 9), to a connecting terminal in the form of a pin or lug CO, which projects transversely forward in a receptacle 21 in the lower part of the front longitudinal face 23 of the housing 22.

Each fixed transverse contact rod T2, T3 (FIG. 4) is in the form of a pin and is mounted in the bottom of the housing, bearing upon two (eft front 62 and rear 64 and right front 66 and rear 68 positioning and fixing side feet, containing vertical slots and raised in the bottom 56.

The front feet 62 and 66 (FIG. 3), respectively comprise a second P2 and a third P3 fixed conductor pad, each of which is electrically connected to the fixed contact rod T2, T3.

Each pad P2, P3 is connected, by a strip conductor 70, 72, to a connecting pin or lug C2, C3.

The bottom 56 also comprises two front 74 and rear 76 central feet, which, in the plane PTM, are aligned with the bail 28.

Each central foot constitutes a part of a first fixed conductor pad P1 and these parts are connected, here by a common strip conductor 78, to a common connecting pin or lug C1.

The common trigger member 30 (FIG. 5), which will now be described in details, allows the first switching way between the pads P0 and P1 (FIG. 9), the second switching way between the pads P0 and P2 (through the fixed contact rod T2), or the third switching way between the pads P0 and P3 (through the fixed contact rod T3), to be selectively established, and this as a function of the vertical force F1, F2 or F3 applied to the drum 36 by the user, i.e. as depending upon the force which is applied.

In accordance with the teachings of the invention, the common trigger member 30, here made of metal, integrates or gathers four trigger members, each of which is constituted by a trigger branch Bi. of essentially radial orientation, which extends outwards from a central portion 80 of essentially domed shape and the concavity of which is orientated vertically upwards.

These four branches Bi are identical and are angularly distributed at 90° apart such that the member 30 has a design symmetry about its vertical central axis Y-Y, which, in position mounted in the housing, corresponds to the intersection of the planes PLM and PTM.

The bottom 84 of the central part 80 comprises a receptacle 82 (FIG. 10) in the form of a spherical cap, the concavity of which is orientated downwards and the radius of which is substantially equal to that of the ball 28 (FIG. 12) such as to rest on the latter (see FIG. 12) and allow slight pivotal movements of the member 30 about the center of the ball 28.

By way of a variant (not represented), and in order to reduce frictions, the receptacle 82 can be truncated in such a way as to secure a circular contact with the ball 28.

The member 30 comprises two diametrically opposed longitudinal branches, left B2 and right B3, which will be referred to as the second trigger branch B2 and third trigger branch B3 and which belong to the second and third switching ways respectively.

The member 30 also comprises two first transverse trigger branches B1, which are diametrically opposed and belong to the first switching way.

Each trigger branch B1 (FIG. 10) extends slightly upwards and their free ends are substantially coplanar.

In mounted position of the member 30 (FIG. 12), each free end 86, 88 of the branch B2, B3 extends above and at a distance from the associated fixed transverse contact rod T2, T3.

In the same way, each free end 90 of the branch B1 (front, rear) extends above and at a distance from a first fixed contact pad P1 (FIG. 14).

As it can be seen, in particular from FIG. 12, the drum 36 rests vertically on the upper faces of the free ends 86 and 88 of the longitudinal trigger branches B2 and B3. The latter are slightly elastically pretensioned in the downward direction and thus permanently ensure an elastic return function of the drum 36 towards its high rest position illustrated in the figures, in which position the longitudinal end sections 44 and 46 of the shaft bear upwards against the lower face of mutually opposite portions 92 and 94 of the sealing joint 34, which "close" the slots or receptacle 48 and 50 in the upward direction.

When the drum or roller 36 is rotated, each upper face of a trigger member free end 86, 88 slides along a cylindrical annular path or track 41, 43, respectively, in the periphery of the drum, these being adjacent to the knurled lateral end sections 40 and 42.

The design of the trigger member 30 and of its branches Bi is such that, when the free end of a branch Bi is stressed by applying to it, from top to bottom, a substantially vertical force, the branch is elastically deformed, then suddenly changes position, angling downwards, this sudden change allowing the securement of a trigger function, for the purpose of establishing at least the corresponding switching way, and supplying, moreover, a click of tactile and/or auditory sensation indicating the sudden change of position.

The use of the second, "LEFT" switching way, from the rest position illustrated in the figures, will now be described.

When the user applies the vertical force F2 (FIG. 19), that is to say when he presses on the left of the drum 36, he provokes a lowering or descent of the corresponding left end 44 of the shaft, which tilts about a transverse horizontal axis (orthogonal to the axis X-X) passing substantially through the point of contact of the upper face of the right cylindrical end section 46 of the shaft with that portion 94 of the joint 34 which closes the slot 50.

Figure 21:
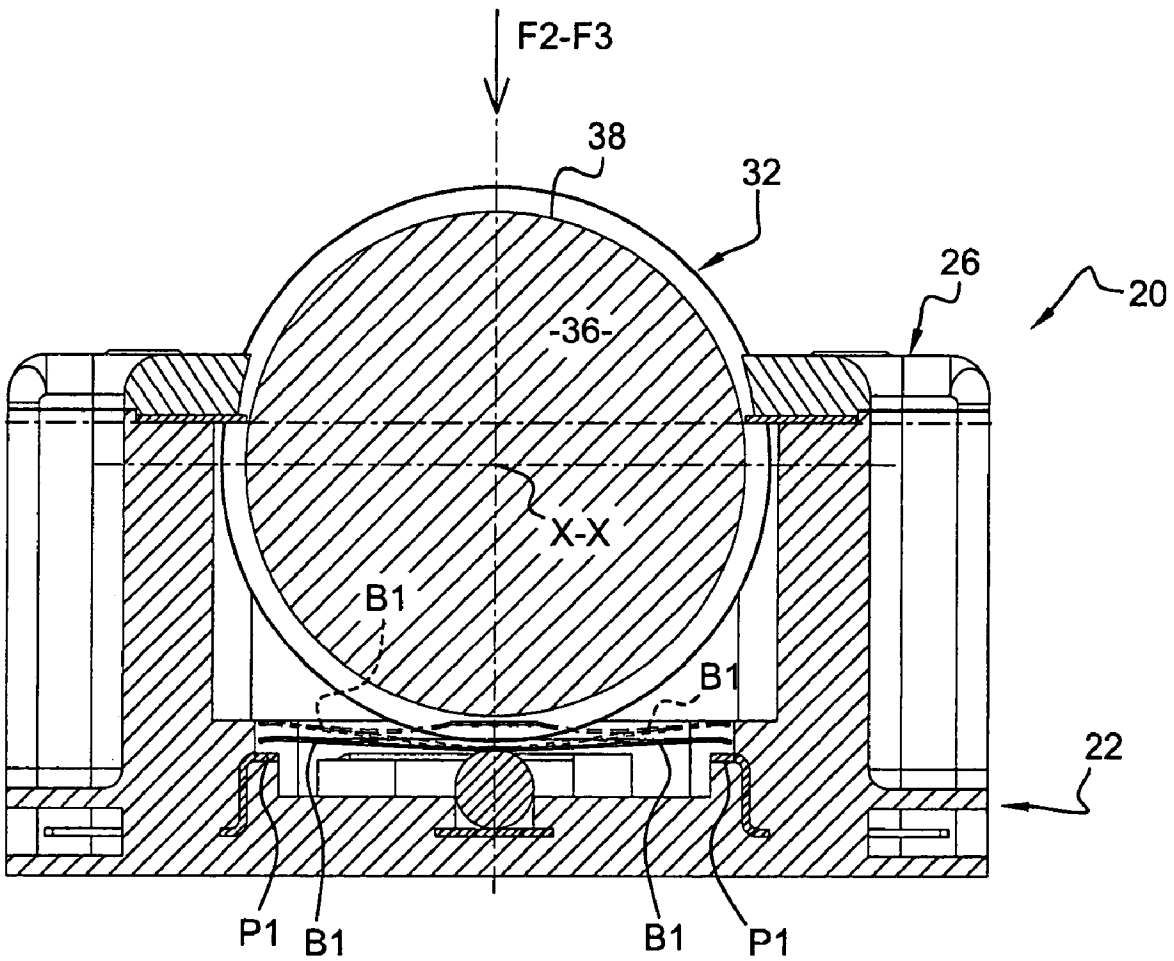

Hence, the left longitudinal branch B2 becomes sufficiently deformed to change state in order for its free end to come into electrical contact with the rod T2, as illustrated in FIGS. 19 and 21.

This deformation of the considered B2 branch is combined with a rotational movement or tilting of the central trigger member 30 around the center of the ball 28.

To the deformation of the trigger branch B2 is thus added a slight pivoting of the member 30 about the center of the ball 28, whereby the travel obtained for the free end 86 of the branch B2, with respect to the corresponding contact T2, can be augmented.

The second electrical switching way (28-PO, B2, 86, T2, P2*j* between the terminals CO and C2 is thus established through the common member 30, which is conductive and which, by its central part, is always in contact with the central fixed contact 28-PO, which is common to the first three switching ways.

In fact, in most of the cases and due to the concept and design of the star-shaped trigger member 30, all the branches might simultaneously change state, but, in this case, the free end of the opposite lateral branch B3 does not come simultaneously in contact with the fixed corresponding contact T3. This free end might not come into contact or, if it comes into contact, it will be later so that an associated software for receiving and analyzing the various switching signals or pulses will permit to discriminate between the two consecutive received signals.

In a similar manner, the downward travel of the free ends o1 the two opposed transverse branches B1 is inferior to the travel o1 the free end 86 of the branch B2.

In symmetrical fashion, the application of the force F3 by pressing on the right of the drum allows a signal or a pulse to be produced by virtue of the third, "RIGHT" switching way (28-PO, B3, 88, T3, P3) between the terminals CO and C3, as illustrated in FIGS. 20 and 21.

For the use of the first, "SELECT" electrical switching way, the user applies the force F1 (FIG. 22) to the central concave portion 38 of the drum.

He thus provokes a lowering or total vertical descent of the control member 32 with the axis Z-Z, which remains essentially horizontal and parallel to himself, this movement being guided by the slots 48 and 50.

The tracks 41 and 43 of the drum 36 act simultaneously and symmetrically upon the free ends of the two longitudinal branches B2 and B3.

Owing to this "balanced" deformation force and through the design of the common trigger member, the four branches Bi simultaneously change of state.

Insofar as there is virtually no pivoting of the member 30 relative to the ball 28, the free ends 86 and 88 of the two longitudinal branches B2 and B3 come into contact with neither the rod T2, nor with the rod T3.

Figure 23:
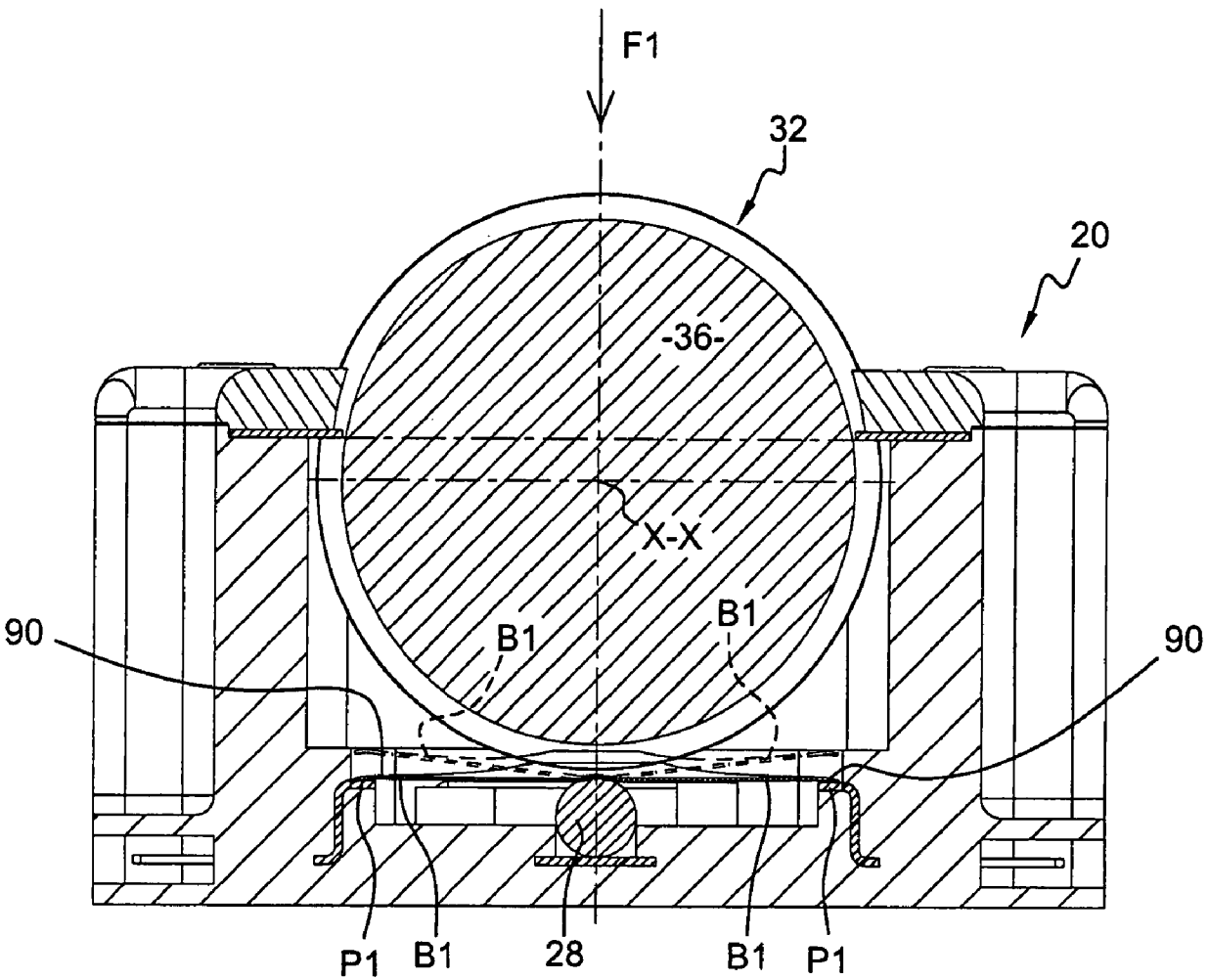

On the other hand, the two branches B1 (FIG. 23) which are lowered each come into contact, by their free ends 90, 92, with an opposite fixed contact pad P1, thus establishing the first switching way, as illustrated in FIGS. 22 and 23.

In the represented embodiment, the "doubling" of the branches B1 and of the pads P1 is redundant insofar as the sudden change of state of the two branches is virtually simultaneous, but this redundancy provides a high level of working reliability.

In fact, especially in view of the very small dimensions of the various components, an action of the F1 type might also provoke the switching between the free ends of the lateral branches B2 and B3 with the corresponding fixed contacts T2 and T3.

Again, the associated software will permit to analyze the various received signals with a view to discriminating the quasi simultaneous switching of the second and third ways hereabove mentioned, from the consecutive switching of these two second and third ways due to a consecutive and voluntary action on one and thereafter the other lateral end portion of the drum member.

In order to obtain the switching, it is necessary, for example, to apply a force F1 of value "N", whereas, for the second or the third switching way, the value of the force F2 or F3 to be applied in order to obtain the corresponding switching is lower, for example between 0.5N and 0.7N, owing to the lever arm effect which is at play when the member 32 tilts in either direction.

This difference in the value of the forces to be applied allows the achievement of discrimination between the functions.

According to another aspect of the invention, the first switching way when applying an F1 effort might not use the branches B1 and the associated fixed contacts, but only the quasi simultaneous formation of switching pulses or signals on the second and third ways, as described above, in combination with the corresponding analysis and discrimination by means of the associated software.

Without changing the design and concept of the device, it is then possible to suppress at least one wire for connection with C1, which is an advantage in the automotive field.

The signals generator 52 will now be described, the general design of which is that described and represented in document WO-A-02/075641.

The generator 52 comprises a toothed spur-type driving pinion 100 (FIG. 13), which is rotationally linked to the shaft between the end section 46 and the opposite end face 37 of the drum 36. Between two consecutive teeth 102 of the twelve teeth of the pinion, an upper section 104 of the movable contact rod T6 in rest position is received in such a way as to provoke the tilting of the movable contact rod T6 in either direction (F4, F5) when the shaft is rotated by the drum 36 in order to establish an electrical contact between the movable contact rod T6 and one or other of the two fixed longitudinal contact rods T4, T5 and thus to generate a control signal, and such as then to provoke the automatic escape of the upper section 104 from the space delimited by the two consecutive teeth beyond a set angle of rotation of the associated drive shaft.

The movable contact rod T6 is a bent-wire element, which extends in a vertical plane and which, when the generator is at rest, lies in the plane PLM. Such a design of a movable rod has been described and represented in document WO-A-02/075641 (FIGS. 25 to 29).

It is basically composed of a vertical strand, comprising an upper section 106 and a lower section 108 connected by a horizontal intermediate section 110 constituting the horizontal general tilt axis of the movable contact rod T6.

For this purpose, the horizontal section is received in the bottom of a slot 112 (FIG. 12) formed in the upper face of a foot 114 adjacent to the right-hand inner side face 116 of the housing 22.

The vertical strand 106-108 is extended rightwards, from the lower end of the lower section 108, by a longitudinal^ horizontal strand 118 which is received in the bottom of a triangular recess 120 (FIG. 3) hollowed out in the bottom 56 and the free end 122 of which, bent back 180°, is clamped in a longitudinal vertical slot 124.

The bottom of this slot 124 comprises a conductor pad P6, which is connected, by a strip conductor 126 (FIG. 9), to an output terminal C6 to which the movable contact rod T6 is thus permanently electrically connected.

This design incorporating the horizontal strand 118 produces a high return motion stiffness, whilst the ohmic resistance of the wire section of the rod is very small between, on the one hand, the "crossed" point of contact between the lower section 108 and the fixed rod T4 (or T5) and, on the other hand, the contact pad P6.

The fixed longitudinal contact rods T4 and T5 (FIG. 4) are each squeezed by their left-hand longitudinal end 128, 130, bent back 180°, into a slot in a rear foot 132, front foot 134, and each extends longitudinally and horizontally in overhang above the bottom of the recess 120.

Thus, each rod T4, T5 is deformable elastically and transversely outwards. This is therefore a case of an advantageous crosspoint contact with accompaniment, which avoids the phenomena of bounce, allows the force variations as a function of production tolerances to be minimized and hence produces a high level of homogeneity in the forces to be applied to the drum.

The bottom of each slot comprises an associated conductor pad P4, P5, (FIG. 9) which is connected by a strip conductor 136, 138 to an output terminal C4, C5 respectively.

When the signals generator 52 is at rest, the two rods T4 and T5 are parallel and the lower section 108 of the movable rod T6 is received between the two rods T4 and T5.

When the drum is rotated in one or the other direction, the rod tilts about its horizontal axis 110, in the manner of a crankshaft, and its lower end proceeds to establish an electrical contact with the corresponding fixed rod T4 or T5.

The fourth switching way (C6, T6, T4, C4) or the fifth switching way (C6, T6, T5, C5) is thus established according to the direction of rotation.

Insofar as the upper end 104 of the movable contact rod T6 is received between two consecutive teeth 102 and with a vertical play between its upper end and the bottom 140 of the interdental space, the vertical actuation of the drum 36 according to F1, F2 or F3 produces no parasitic effect upon the signals generator, that is to say it generates no parasitic signal.

The lower horizontal section 118, clamped at its left end, secures the elastic return of the movable rod T6 into its res1 position.

The association of the rotary generator 52 with the multiple-branched Bi trigger member 30 is particularly advantageous and allows the realization of a very compact assembly with a reduced number of components, yet the low total height of which offers access to a large portion of the drum emerging above the upper face of the lid 26.

For component symmetry reasons, the left longitudinal end 44 of the shaft also bears a left toothed pinion 144.

According to a variant (not represented), this second pinion can also belong to a second, dual-way rotary signals generator analogous to the generators 52, the components of which are in this case arranged on the left-hand part of the housing 22 under the pinion 144. A second such generator may be necessary for the redundancy-based reliability of the device or as a function of a specific application inherent to the electronic appliance.

The pinions 144 and 100 are received with play in semi-cylindrical receptacles 146 and 148 (FIG. 8) formed in the lower face 150 of the lid, which, with the upper face 24 of the housing 22, encloses the upper joint 34.

The components assembly is held in place by closure of the lid 26, which is fixed by hot crimping of the studs 152 of the housing 22, which pass through holes 154 in the lid 26.

In this type of electromechanical component, it is particularly important to be able to ensure the best possible seal in order, especially, to protect the switching zones.

The first seal in the top part is secured by the joint 34 (FIG. 2) with its cutout 93, which closely matches the profile of the drum 36 (35, 40, 41, 38, 43, 42, 37). By way of a variant (not represented), the joint can also, be realized by bi-injection molding with the lid.

In the low part, it is also possible to interpose a horizontal flexible joint in the form of essentially rectangular and horizontal film, which extends below the drum 36 and above the common trigger member 30.

Figure 24:
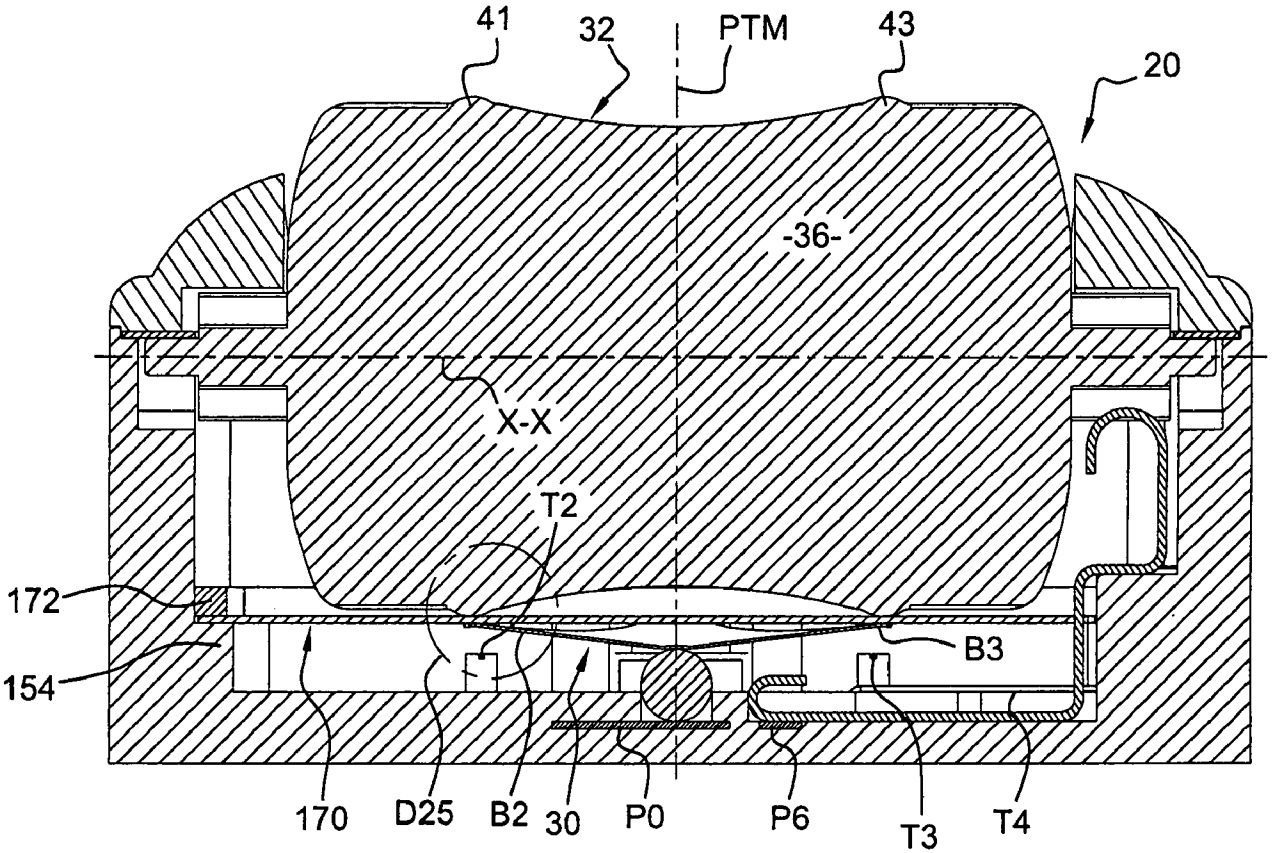
FIG. 24 is a view analogous to that of FIG. 12, illustrating an embodiment having a lower sealing film
Figure 25:
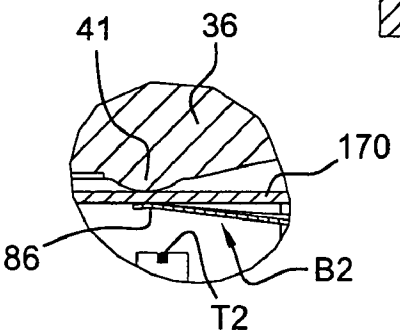
FIG. 25 is a larger-scale view of the detail D25.
Figure 27:
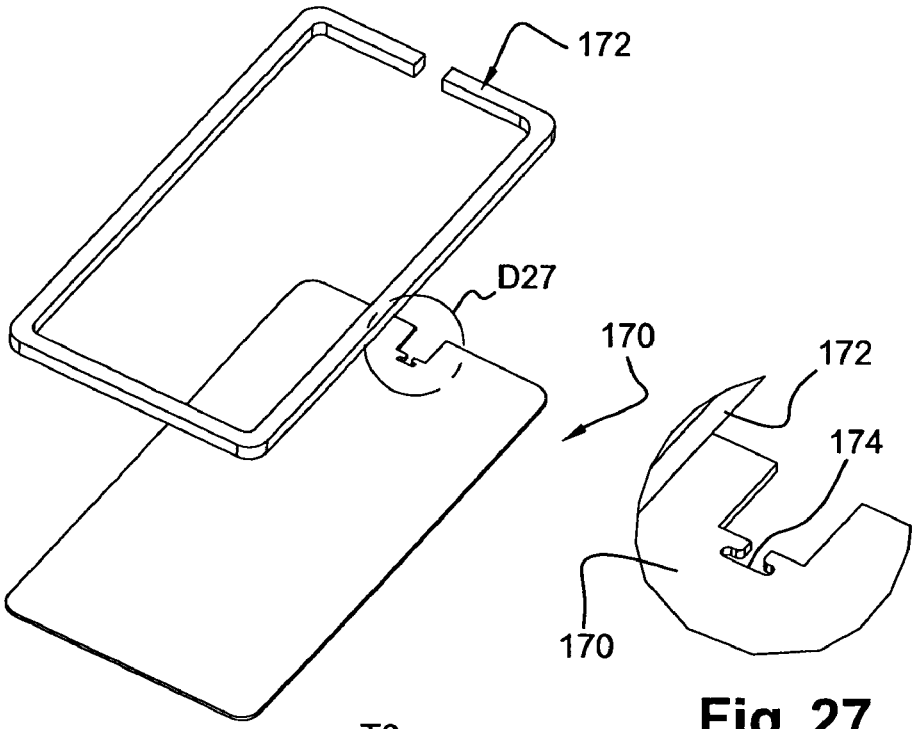
FIG. 26 is an exploded isometric view of the sealing film and its holding frame and FIG. 27 is a larger-scale view of the detail D27.
Figure 26:
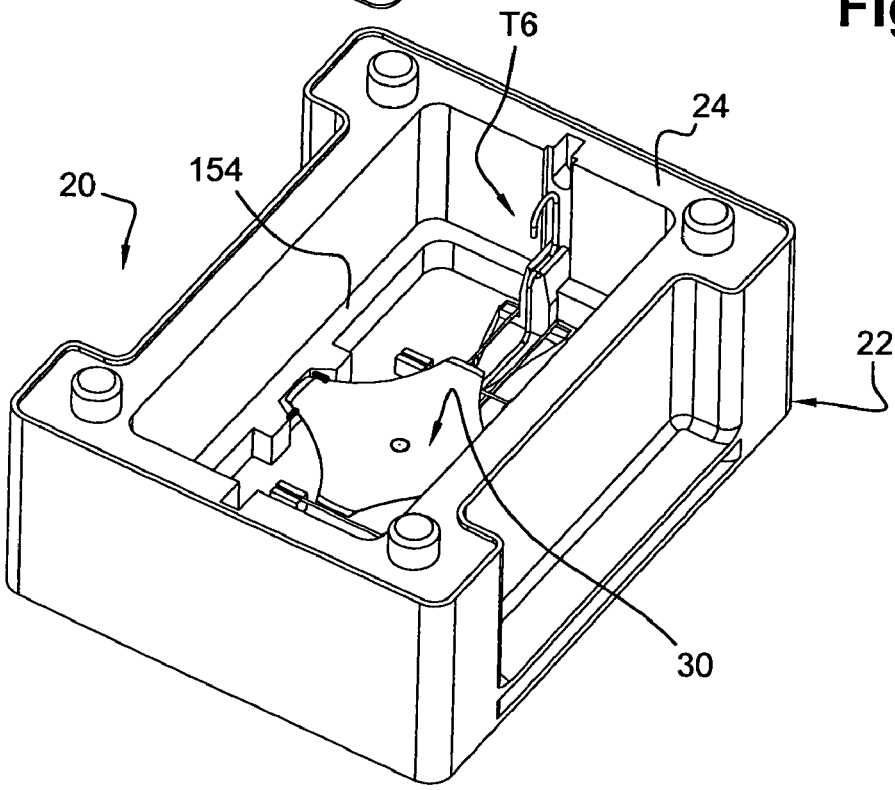

As it can be seen from FIG. 24 et seq., the film 170 is held in position by an upper peripheral frame 172, which rests on a peripheral inner shoulder 154 on which the periphery of the sealing joint can be glued.

The sealing film 170 thus extends vertically between the drum 36 and the common trigger member 30.

The drum in this case comprises two circular ribs or flanges 41 and 43, axially facing the upper faces of the ends 36 and 38 of the branches B2 and B3.

When the drum 36 rotates, each flange rubs on the part opposite the upper part of the film 170, which can be provided with a top coating (not represented) of tow friction coefficient, for example "Teflon" (polytetra-fluoro-ethylene).

Where the device 20 comprises illuminating means for the drum, the film 170 can be totally or partially transparent or translucent.

Figure 29:
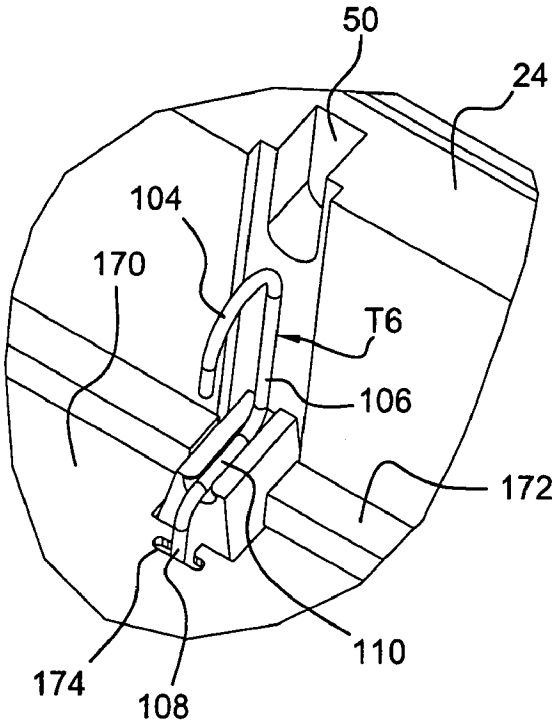
FIG. 29 is a larger-scale view of the detail D29 of FIG. 28.
Figure 28:
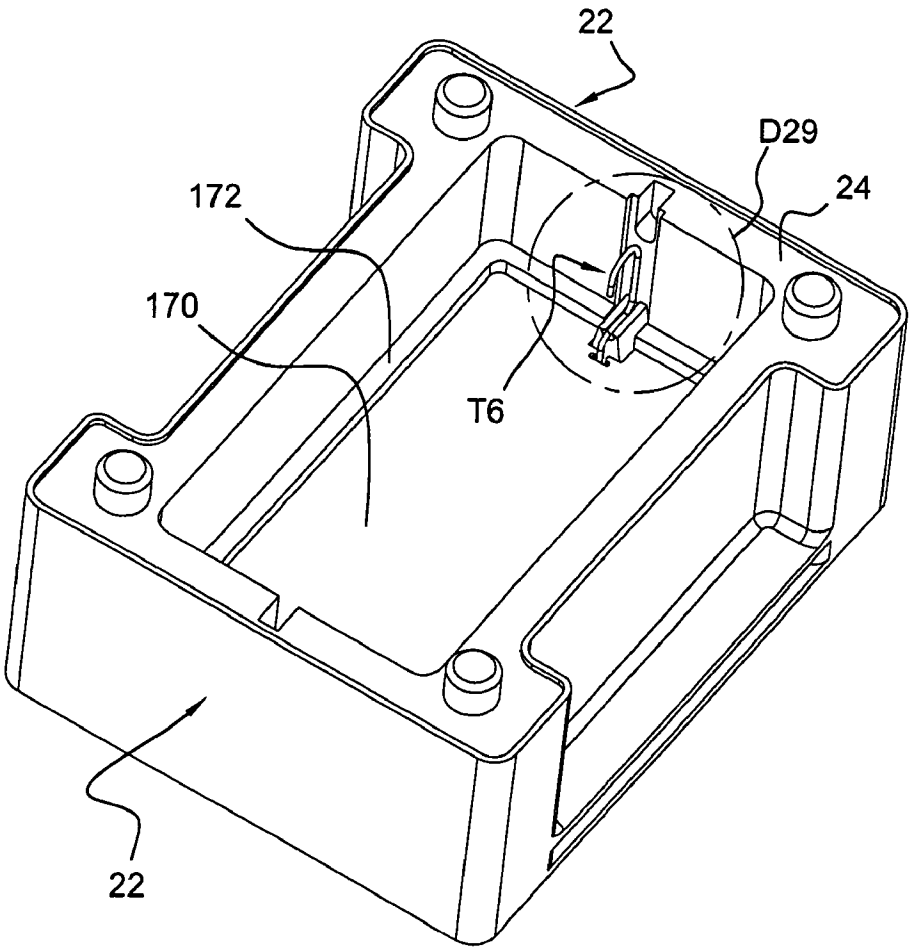
FIG. 28 is an isometric view of FIG. 24 without the drum.

As it can be seen, in particular, from FIGS. 24 and 28, 29, the film 170 provides a virtually total sealing of the lower part of the housing 22 with only a very small cut-out in its right-hand transverse edge having a transverse slot 174 for the passage and deflections of the movable contact rod T6, the upper control portion 104 of which extends above the film 170 so as to cooperate with the driving pinion 100.

Figure 31:
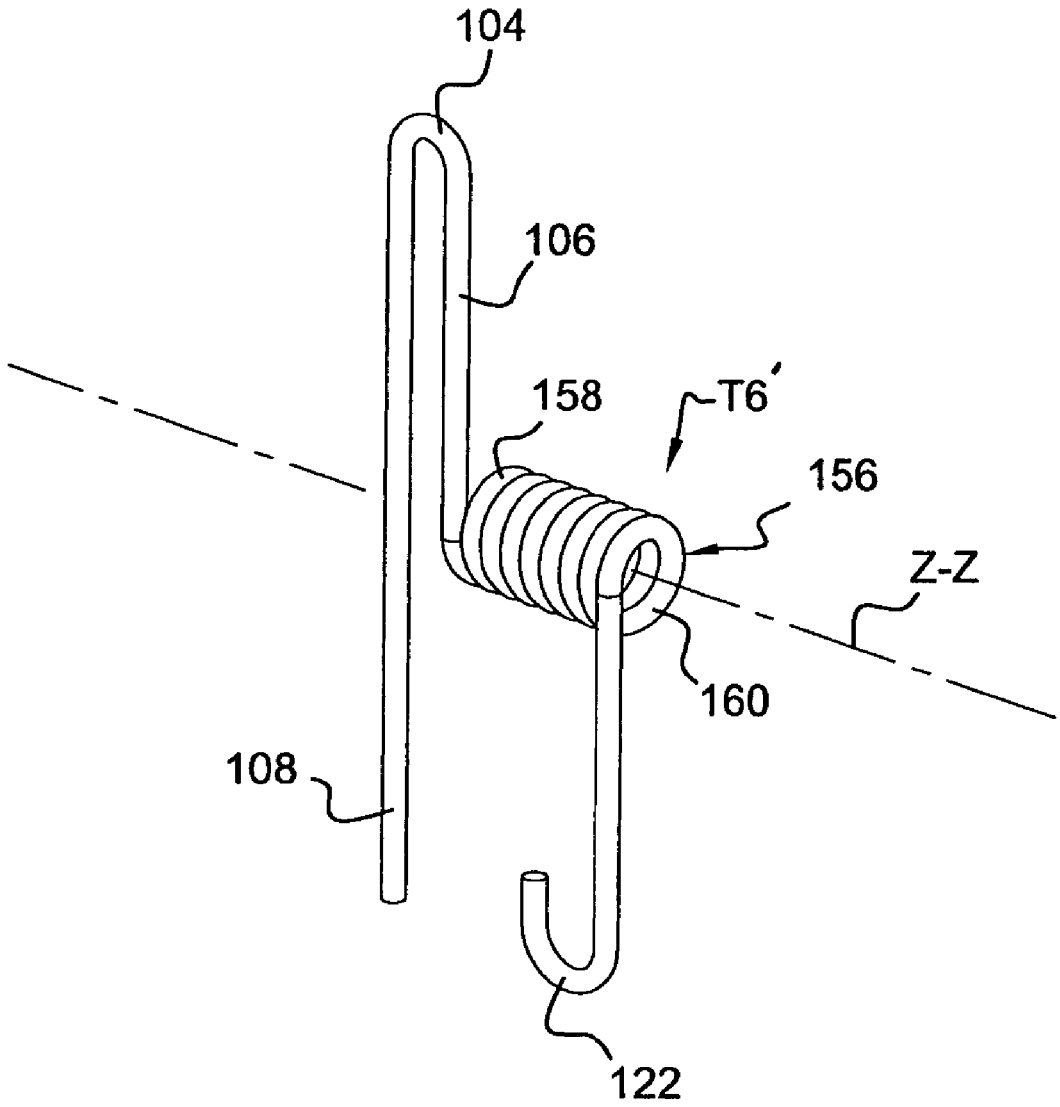
FIG. 31 is an enlarged isometric view of the movable contact rod of FIG. 30.

In FIGS. 30 and 31, an embodiment of the movable contact rod analogous to that described in documents WO-A-02/075641 is described, according to which the rod T6 is connected to the last turn 158 of a helical spring 156 which secures its return into its angular position of rest and the axis Z-Z of which constitutes the pivot axis in both directions of the movable contact rod and lies parallel to the rotational axis X-X of the drum.

The longitudinal cylindrical body of the spring 156 is received and guided in a complementary receptacle 166 in the housing 22. The length and the number of turns of the spring allow, in particular, the value of the elastic return force to be gauged. On the other hand, the ohmic resistance between the lower movable contact section 108 and the fixed pad P6 is greater than previously.

The housing 22, as in the case of the aforementioned "trackballs", can also comprise inner lighting diodes 176 for the drum 36, which can be totally or partially translucent.

Figure 33:
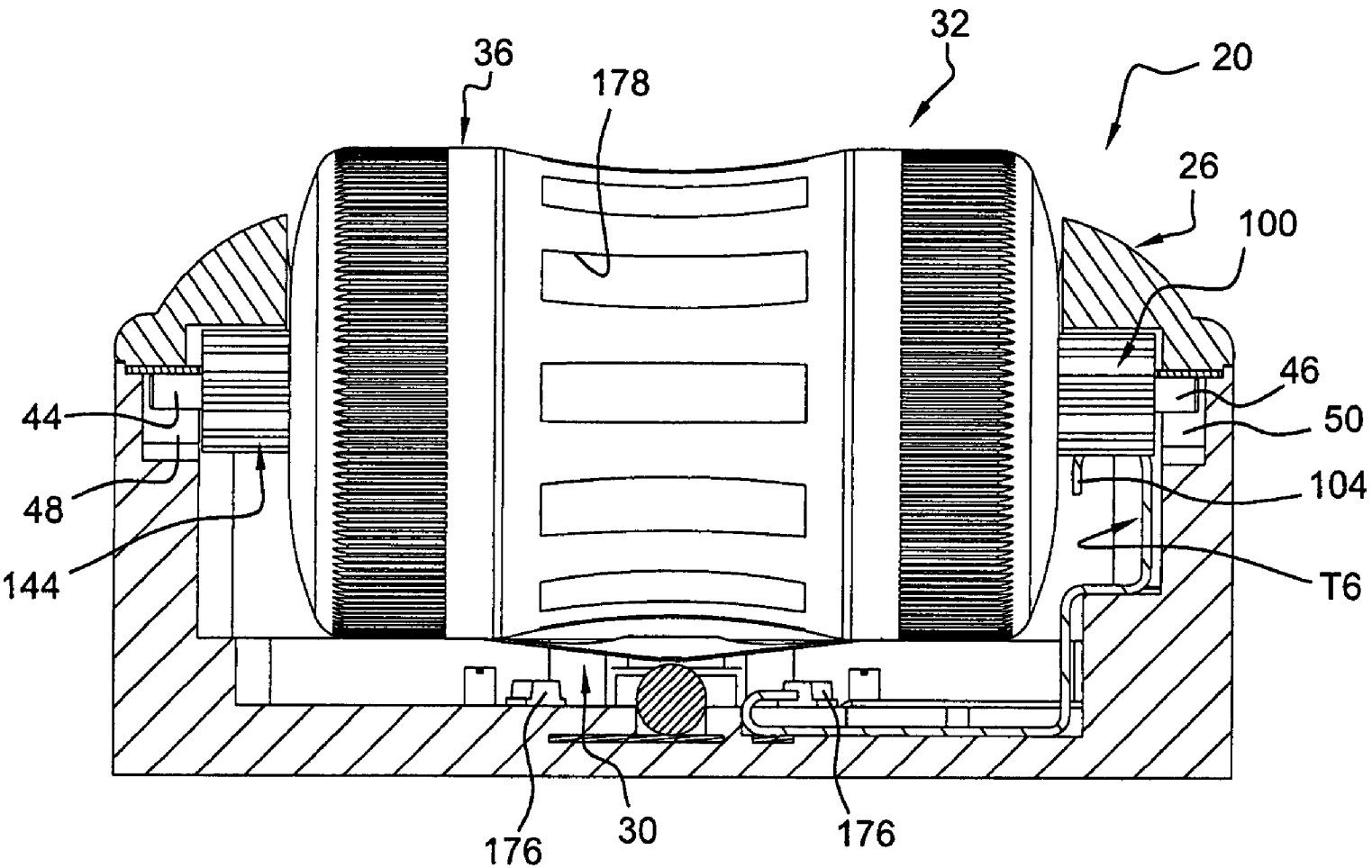
Figure 34:
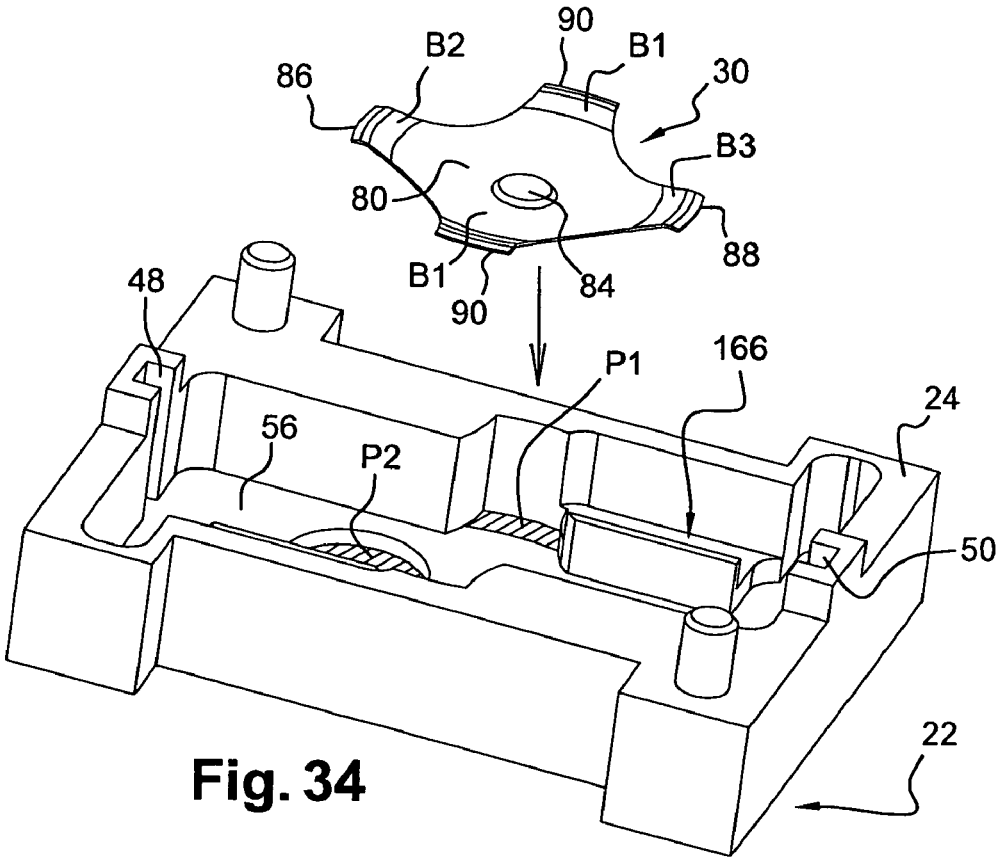
FIG. 34 is a simplified, enlarged and exploded isometric view of a second embodiment, illustrating the lower housing and the common trigger member in the course of installation in the housing.
Figure 35:
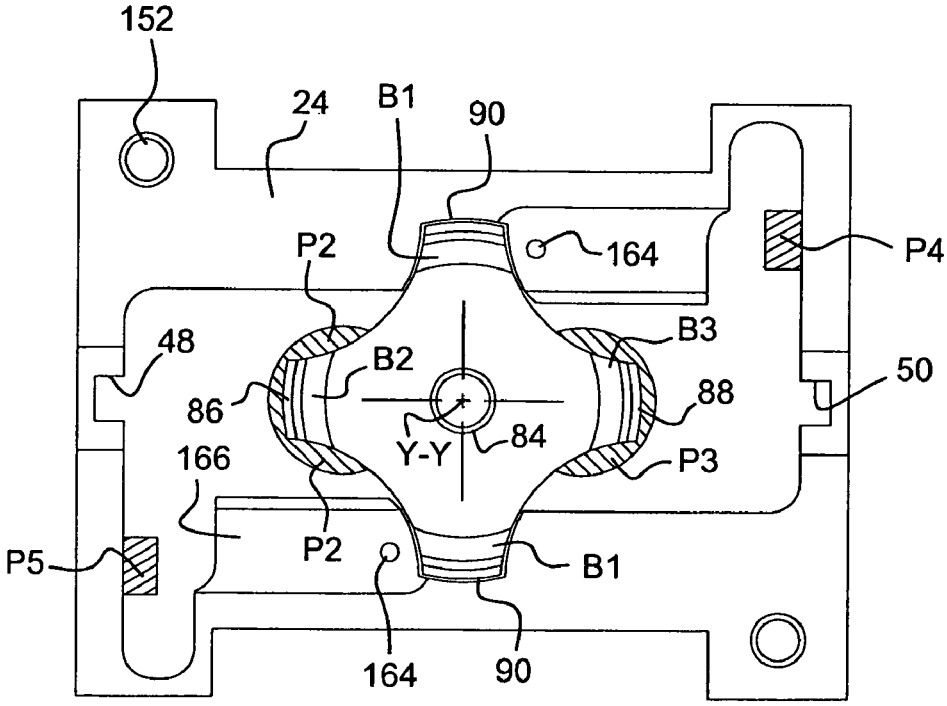
FIG. 35 is a top view of the components of FIG. 1, following the installation of the common trigger member.
Figure 36:
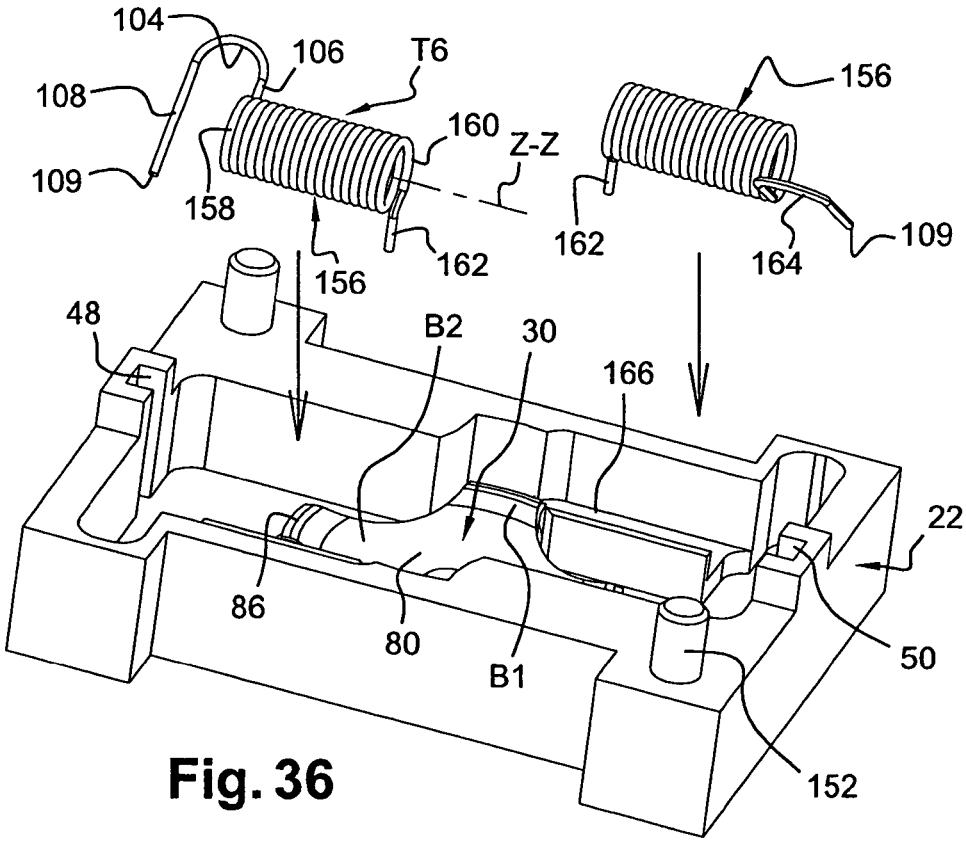
FIGS. 36-37 and 38-39 are pairs of figures analogous to those of FIGS. 34 and 35, illustrating the installation of the movable contact rods, then of the double-pinioned drum.
Figure 37:
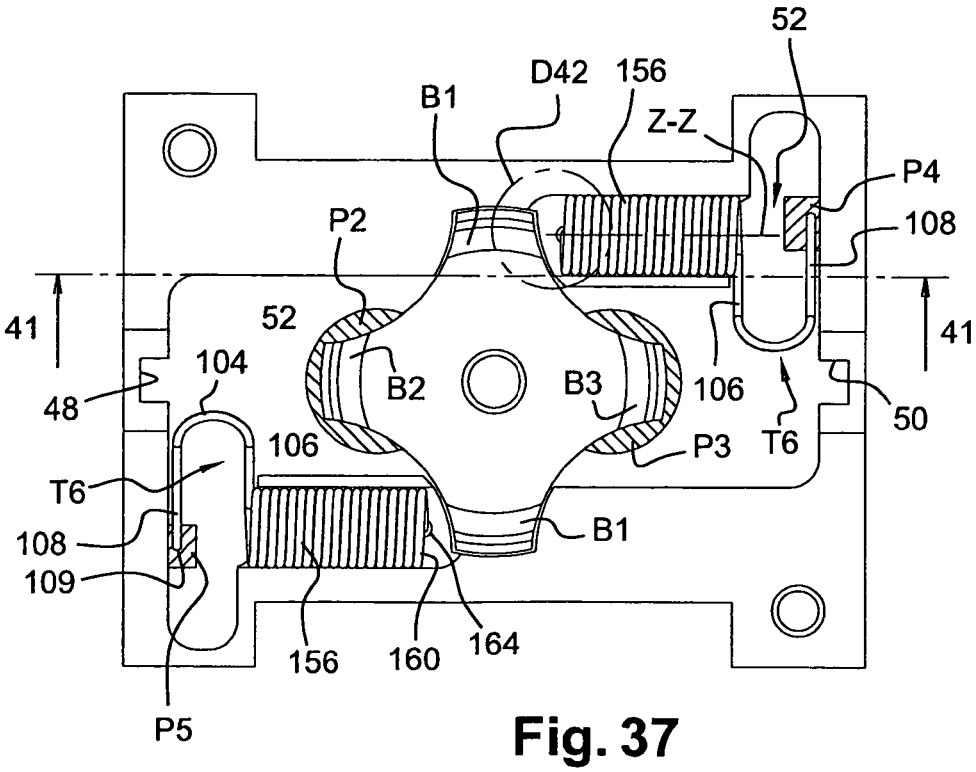
Figure 38:
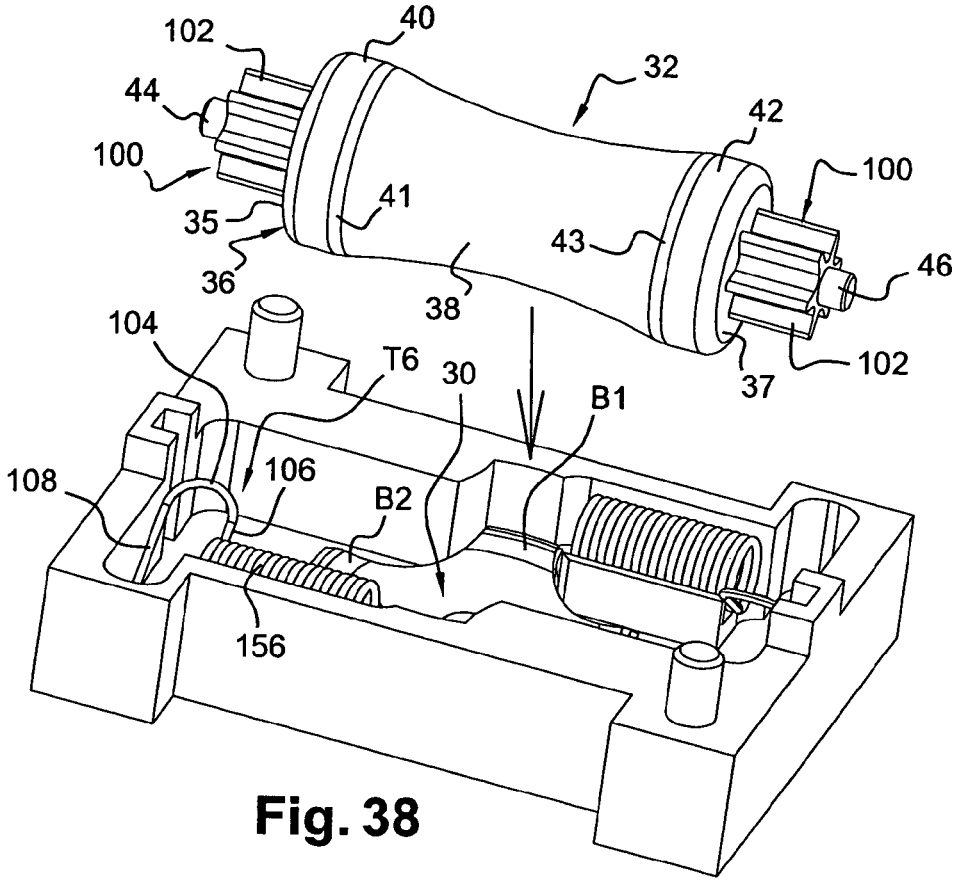
Figure 39:
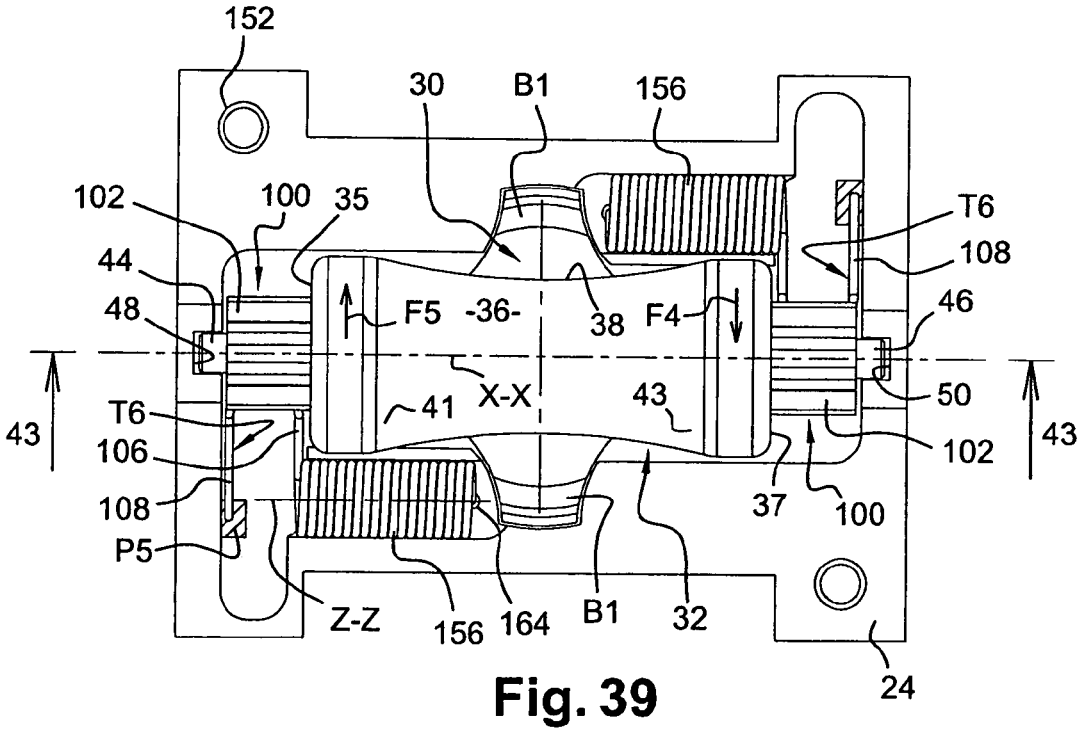
Figure 40:
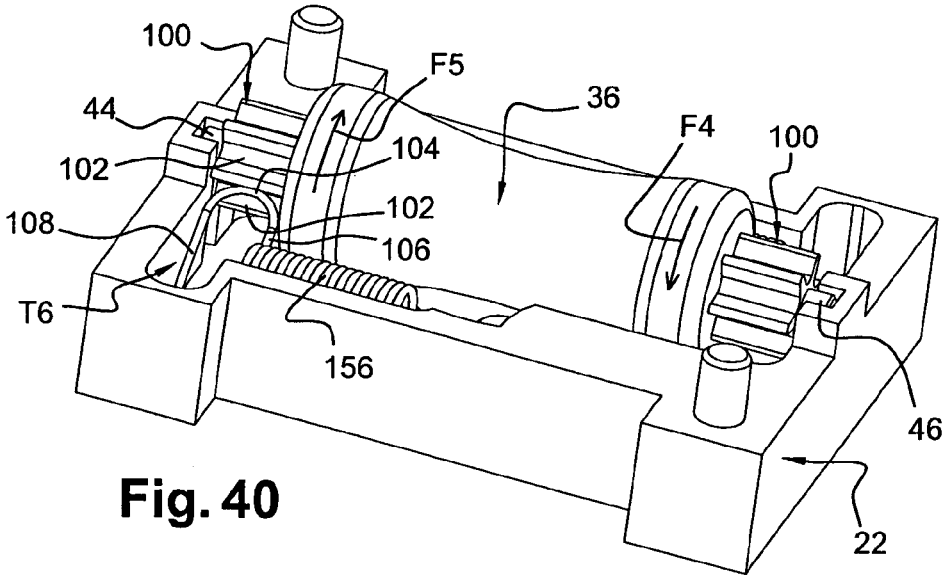
FIG. 40 is a view similar to that of FIG. 38, illustrating the drum in position.
Figure 41:
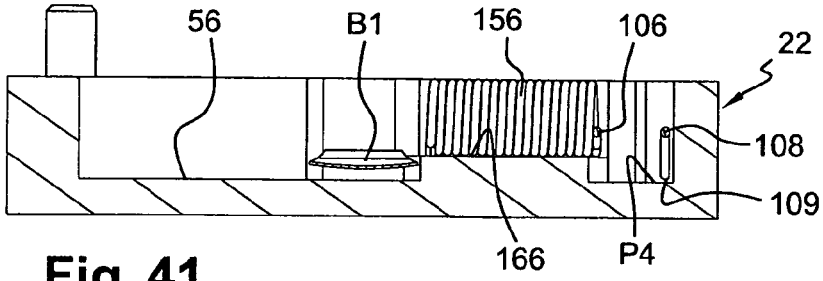
FIG. 41 is a detailed sectional view along the line 41-41 of FIG. 37.
Figure 43:
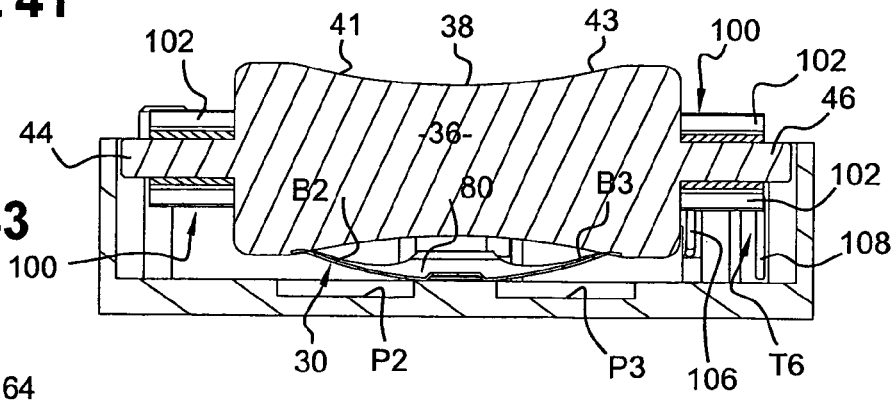
FIG. 43 is a sectional view along the line 43-43 of FIG. 39.
Figure 42:
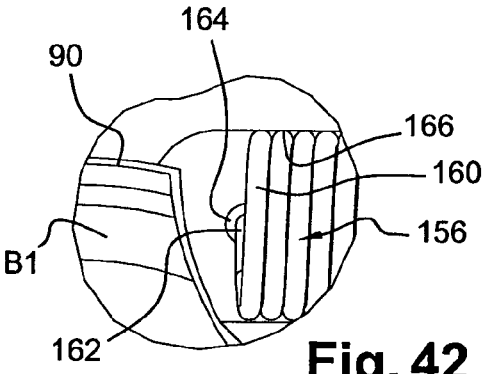
FIG. 42 is an enlarged view of detail D42 of FIG. 37.
Figure 44:
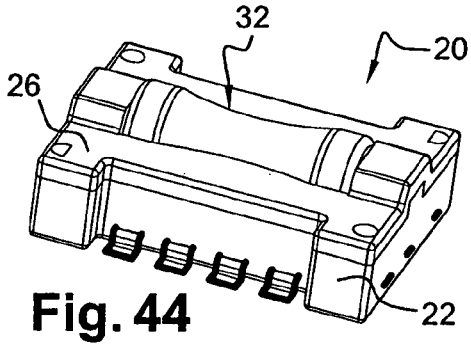
FIG. 44 is an isometric view of the complete device according to the second embodiment.

Such illuminating means, represented diagrammatically in FIGS. 32 and 33, in association with the tactile sensations, allow the user to be supplied with luminous indications, especially for the purpose of guiding him in his use of the device, for example so as to indicate to him the type of force he must apply to the drum for the next executable function.

The drum 36 can comprise a translucent body 180 (FIG. 47) having molded-on opaque axial end sections 182, with the molding material extending longitudinally into the radial slots or notches 178 in the translucent body 180. Thus, on the surface of the central section of the drum, a series of angularly evenly distributed luminous windows are defined, which are equal in number, for example, to the number of teeth of the driving pinion.

It is possible to use different-colored diodes 176 for each function and/or to make the drum out of a translucid material comprising differently colored longitudinal sections, since the drum always revolves about the same axis, unlike the control ball of a trackball which revolves in "all directions".

It is also possible to use for the drum a known material, of the phosphorescent type, which permits to very quickly accumulate light from the external environment and to restitute this light during several hours. This material might be in the form of an additive in an elastomeric soft-touch material.

Especially when the device is arranged in an area without permanent lightness (such as the inside of an automobile at night) the drum might be permanently and slightly illuminated so as to facilitate its detection by the user in the same manner as an illuminated button or switch for equipment of the dashboard.

By way of a variant and as represented in FIG. 45, in the case of the control of the Y-axis (vertical) displacements of a cursor 202 on a screen 204 of an electronic appliance, the second (F2) and third (F3) switching ways can be used for "large-step" rapid displacements upwards and downwards, whereas the fourth (F4) and fifth (F5) switching ways retain their "fine-step" control function.

A first drum device 20-1 can in this case be used for Y-axis displacements and a second device 20-2 to control the X-axis displacements, the axes of both drums being perpendicular by virtue of a "T-shaped (as in FIG. 45) or "L"-shaped arrangement.

In such a hypothesis, the first device, arranged "horizontally" (parallel to the horizontal axis of the "X's" on the screen), can secure the control of all the "X-axis" displacements with displacements according to a large step (F2, F3) or according to a fine step (F4, F5) in both directions (leftwards or rightwards). In the same way, the second device, arranged "vertically" (parallel to the vertical axis of the "Y's" on the screen), can secure the control of all the "Y-axis" displacements with displacements according to a large step (F2, F3) or according to a fine step (F4, F5) in both directions (leftwards or rightwards). Each of the devices has, moreover, a supplementary enabling switching way (F1).

Still in this hypothesis combining two devices according to the invention, the first, "horizontally" arranged device can control the "X-axis" displacements in large steps (F2, F3) and the "Y-axis" displacements (F4, F5) in fine steps, whereas the second, "vertically" arranged device controls the "Y-axis" displacements in large steps (F2, F3) and the "X-axis" displacements in fine steps (F4, F5).

The choice between one or other of these two combinations is realized as a function of their respective ergonomy and of the type of function to be controlled.

Moreover, for example as a function of the number of teeth on the driving pinions of the rotary signals generators, it is also possible to have different fine steps from one device to the other.

It is also possible to use a simplified device according to the invention, that is to say without a rotary signals generator.

Figure 9:
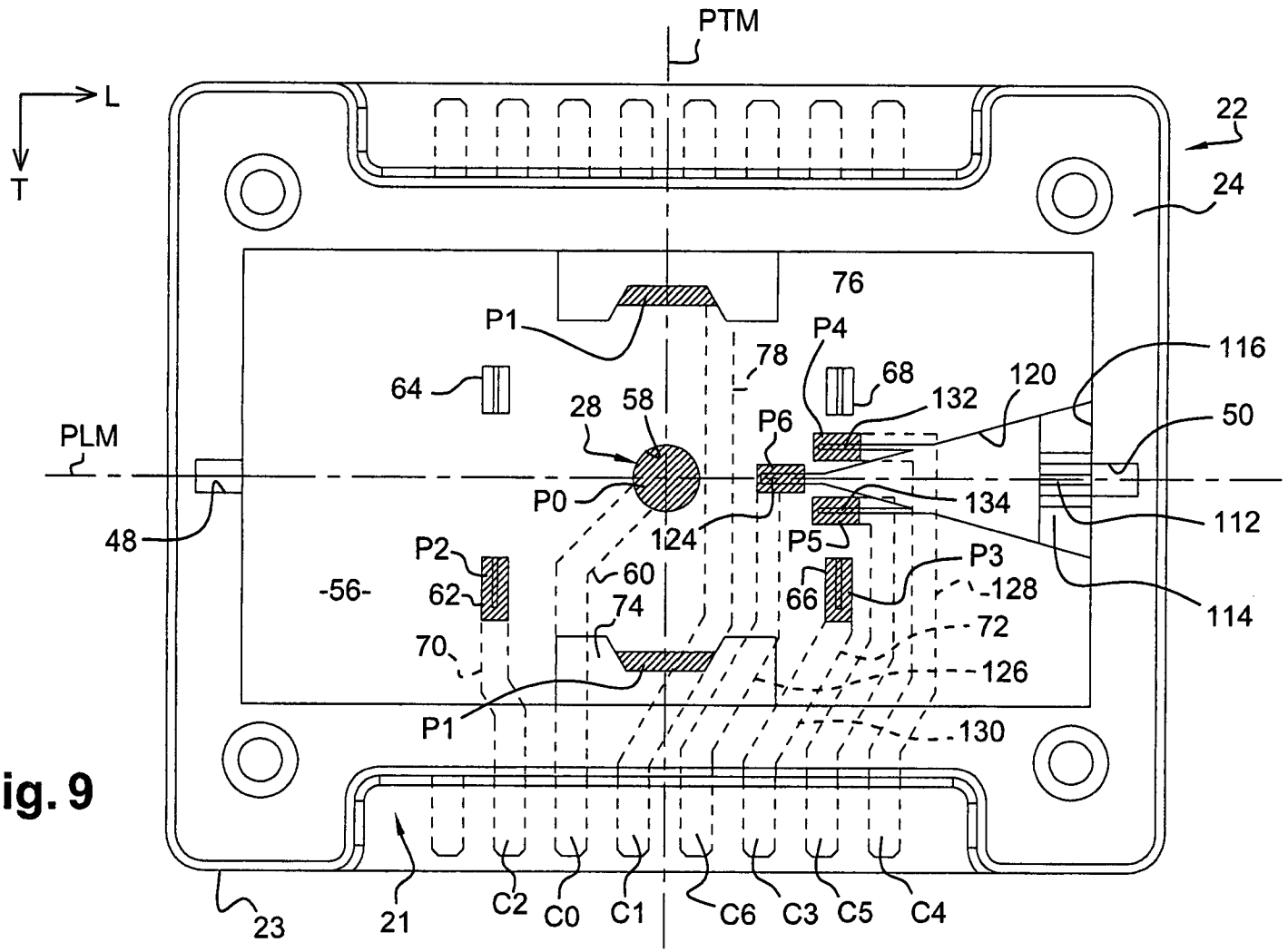
FIG. 9 is an enlarged top view of only the lower housing of the device of FIGS. 1 and 2, showing contact pads and their connections to contact lugs at the front of the housing.
Figure 10:
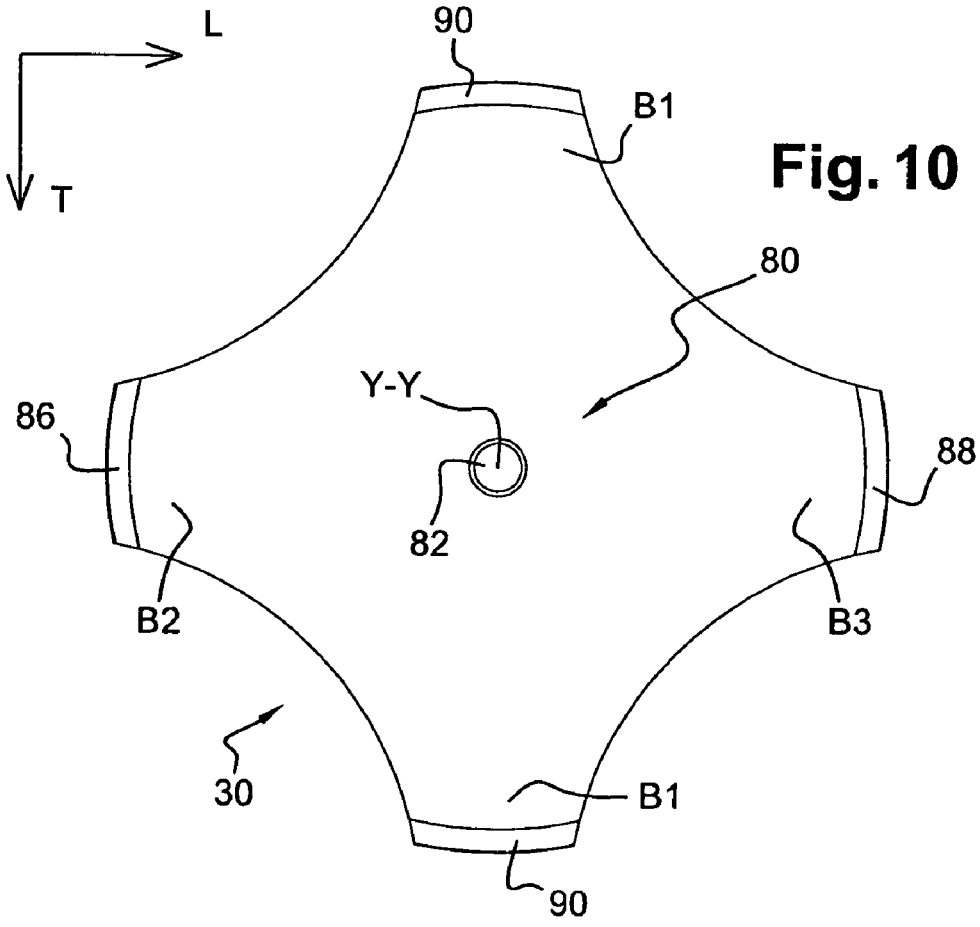
FIG. 10 is an enlarged top view of the trigger member of the device of FIG. 1.
Figure 11:
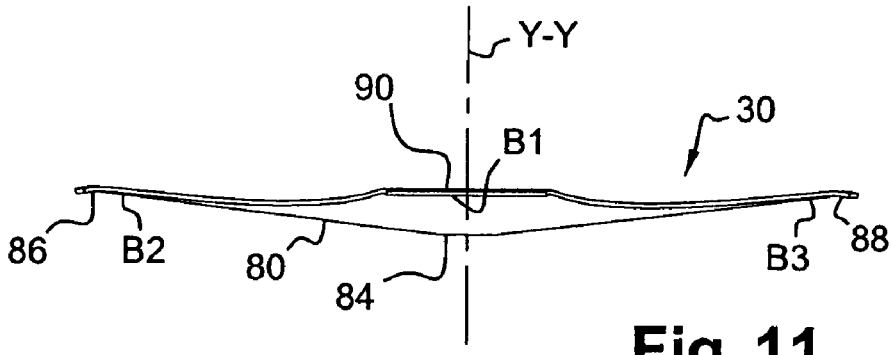
FIG. 11 is a side view of the trigger member of FIG. 10.

The tracks connecting the pads Pi to the terminals Ci, an arrangement of which is represented diagrammatically in FIG. 9, are advantageously realized in the form of pre-cut tracks, constituting inserts around which the plastics insulating body of the housing 22 is molded on.

The embodiment which has just been described is intended, for example, for an automotive application having an ergonomic drum of relatively large diameter in the order of 16 mm with overall dimensions L×T×V in the order of 36×27×18 mm, this "fat" drum or roller facilitating operation in a passenger compartment.

The second embodiment of the invention, illustrated in FIGS. 34 to 44, will now be described, which is a model of very small dimensions intended, for example, for integration in a mobile telephone, having an ergonomic drum of approximately 3.5 mm diameter, with overall dimensions L×T×V in the order of 12.9×10×4.5 mm.

In order to reduce, in particular, the total height of the component, it is possible "to incline" the movable contact rod relative to the vertical, here by about 45°, and hence to "split" the rotary signals generator into two symmetrical parts arranged on either side of the two longitudinal ends of the drum and of the housing.

Thus, the device 20 according to the second embodiment has design symmetry about the central vertical axis corresponding to the interception of the aforementioned planes PLM and PTM.

The signals generator 52 is thus constituted by two identical generators 52 arranged on the left and on the right and each of which comprises a movable contact rod T6, the lower section 108 of which cooperates, by its free lower end 109, with a fixed pad P4 (on the right), P5 (on the left) arranged in the bottom 56, which bottom is constituted, for example, by a conductive inset.

As described and represented in documents WO-A-02/075641, the rod T6 is connected to the last turn 158 of a helical spring 156 which secures its return into its angular position of rest and the axis Z-Z of which constitutes the pivot axis in both directions of the movable contact rod and lies parallel to the rotational axis X-X of the drum.

The two rectilinear sections 106 and 108 and the upper loop 104, bent back 180° (which is received between the teeth 102 of the pinion 100), extend in an axial plane which, in the angular position of rest of the rod T6, forms an angle relative to the vertical.

This orientation and the rotational immobilization of the first turn 160 of the body of the spring 156 are ensured by its vertical section 162, which is received in a hole 164 in the housing 22.

Thus the choice of inclination and of other dimensional parameters allows the overall height of the device 20 to be markedly reduced.

The longitudinal cylindrical body of the spring 156 is received and guided in a complementary receptacle 166 in the housing 22. The length and the number of turns of the spring allow, in particular, the value of the elastic return force to be gauged.

The double signals generator works as follows.

Figure 46:
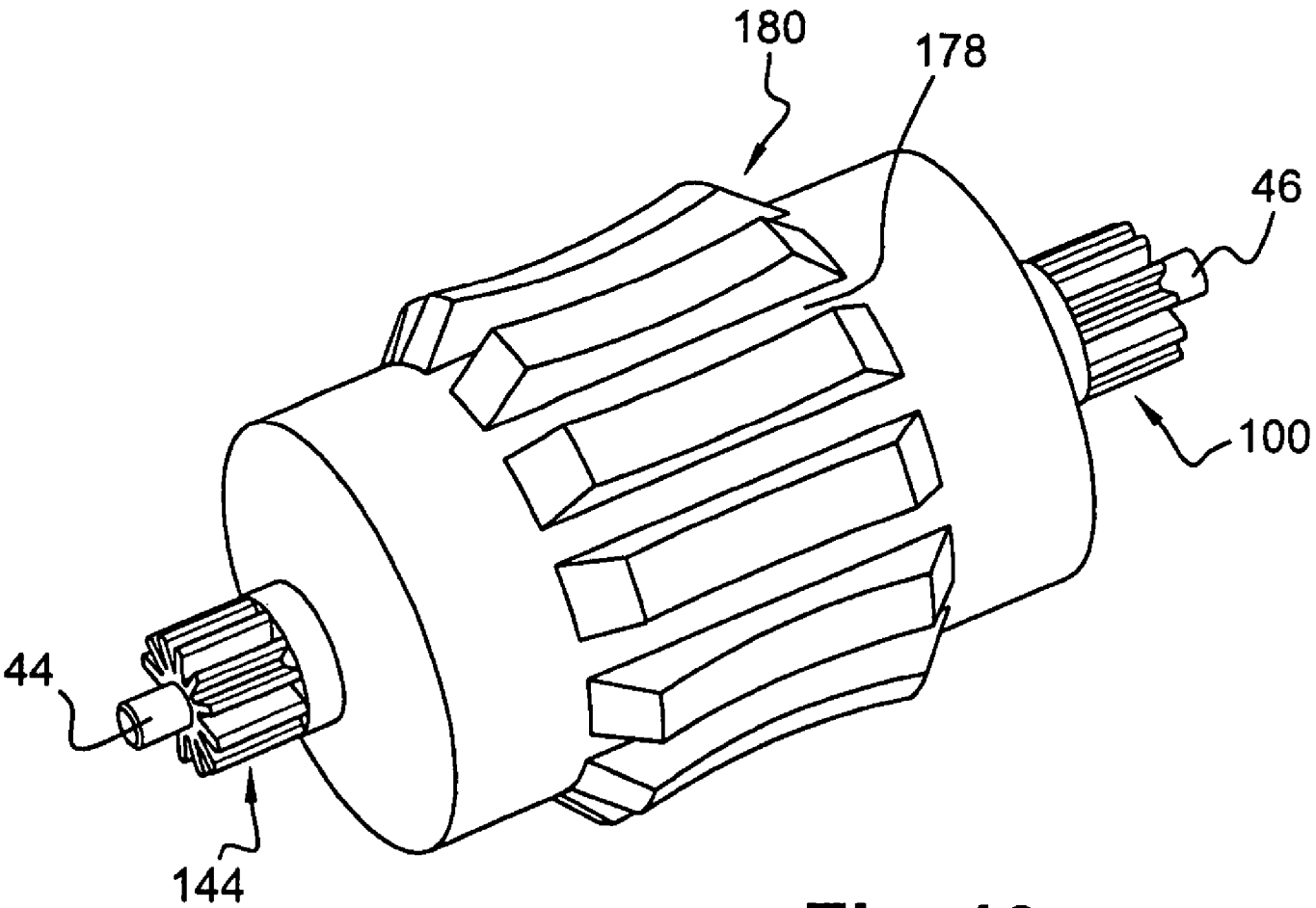
FIG. 46 is an isometric view of the translucent central core of a drum illuminated by diodes, of FIGS. 32 and 33.

When the user drives the drum 36 by applying to it a force F4 (DOWN) (FIG. 46), the right-hand driving pinion 100 provokes the repeated formation of signals or pulses by repeated contacting of the end 109 of the movable contact rod T6 (FIG. 37), which is essentially driven downwards so as to cooperate with the fixed contact pad P4. The user thus uses the fourth switching way.

The equidirectional rotation of the left-hand pinion 100 provokes corresponding movements of the left-hand movable contact rod T6, but its free end shifts essentially upwards without, however, entering into electrical contact with the lower, fixed contact pad P5.

The use of the fifth switching way through cooperation of the left-hand rod T6 with the fixed contact pad P5 is obtained by rotating the drum 36 in the other direction F5.

A rotary signals generator 52 (FIG. 37) having a single switching way on each side of the housing eliminates the risk of generating parasitic pulses when the first three switching ways are actuated, since the descent of a pinion 100 provokes a tilting of the rod(s) T6, but in a direction which tends to remove its lower contact end 109 from the associated conductor pad P4 or P5.

Figure 48:
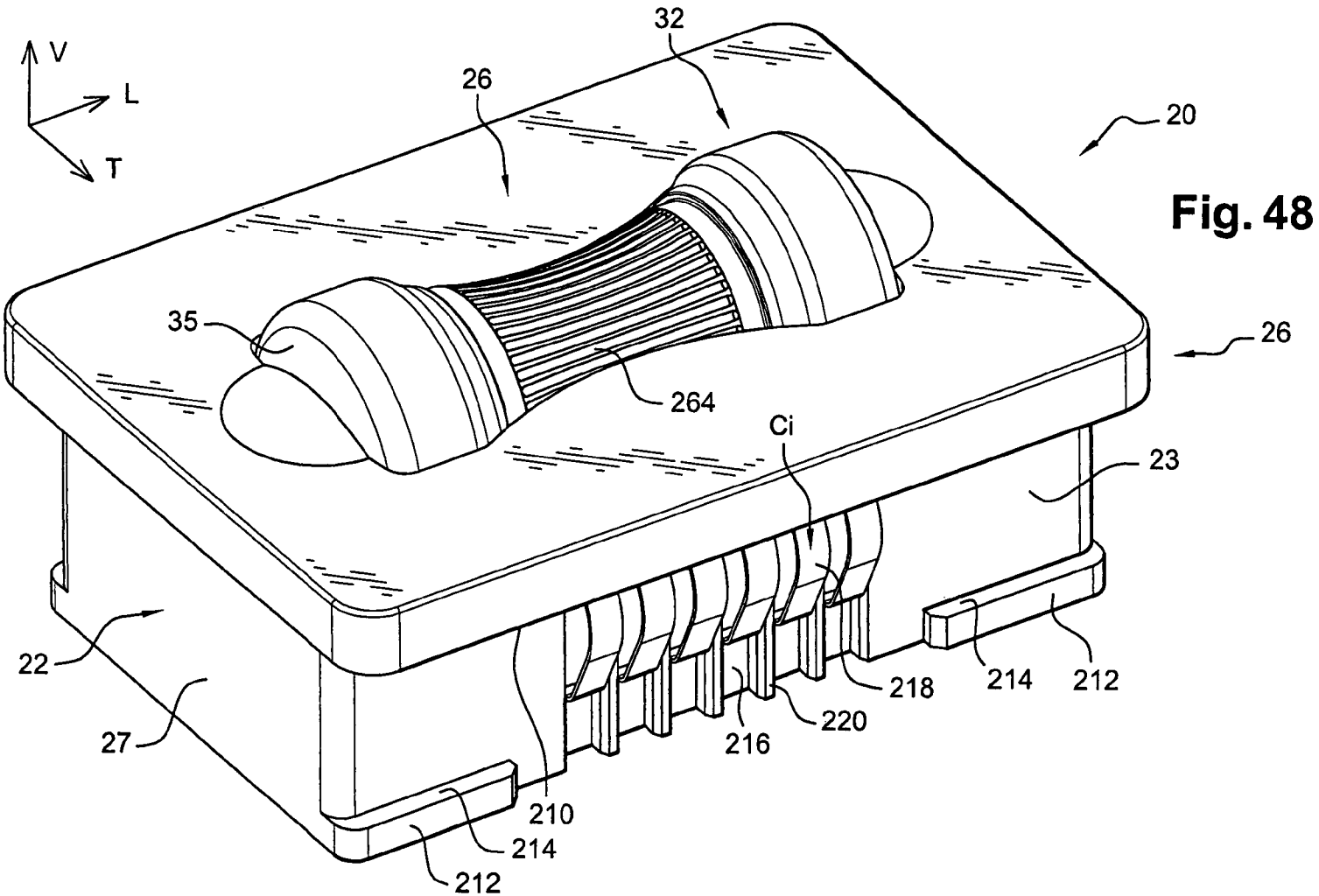
FIG. 48 is a view similar to the view of FIG. 1 showing another embodiment of a device according to the teachings of the invention.

The embodiment of the device illustrated in FIG. 48 and following will be now described by way of comparison with the embodiment of FIGS. 1 to 25.

The upper closing lid 26 is extending longitudinally and transversely beyond the vertical planes of the lateral faces, such as the front and rear longitudinal faces 23 and 25 and transversal faces 27, of the lower housing 22 thus defining a lower peripheral and horizontal edge surface 210.

Along the faces 23 and 25 and in the plane of the horizontal lower face 29, the housing 22 also comprises protruding horizontal ribs 212 defining a horizontal upper bearing surface 214.

The connecting terminals Ci (FIG. 49) made of conductive material and extending outside of the housing 22 are in the form of contacting blades which are elastically deformable, each of them extending upwardly in a corresponding receptacle 216 formed in the lateral face 23. The receptacles 216 are separated by isolating intermediary walls 220.

Each blade Ci defines a contacting outer face 218. Each blade Ci can be transversely depressed in the direction of the face 23.

Figure 57:
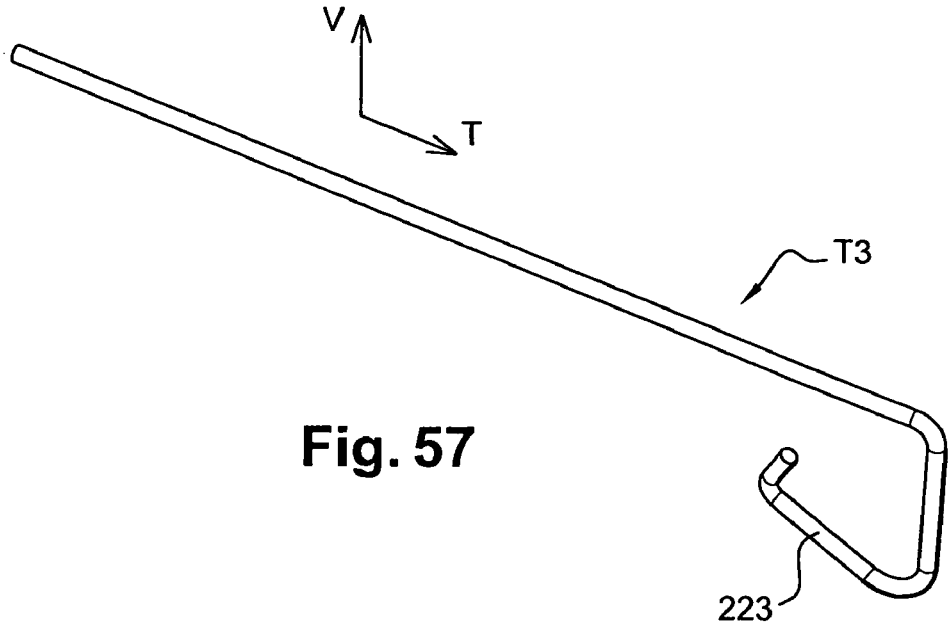
FIG. 57 (on the same sheet as FIG. 52) is an isometric view of one of the two horizontal, transverse fixed contact rods.
Figure 53:
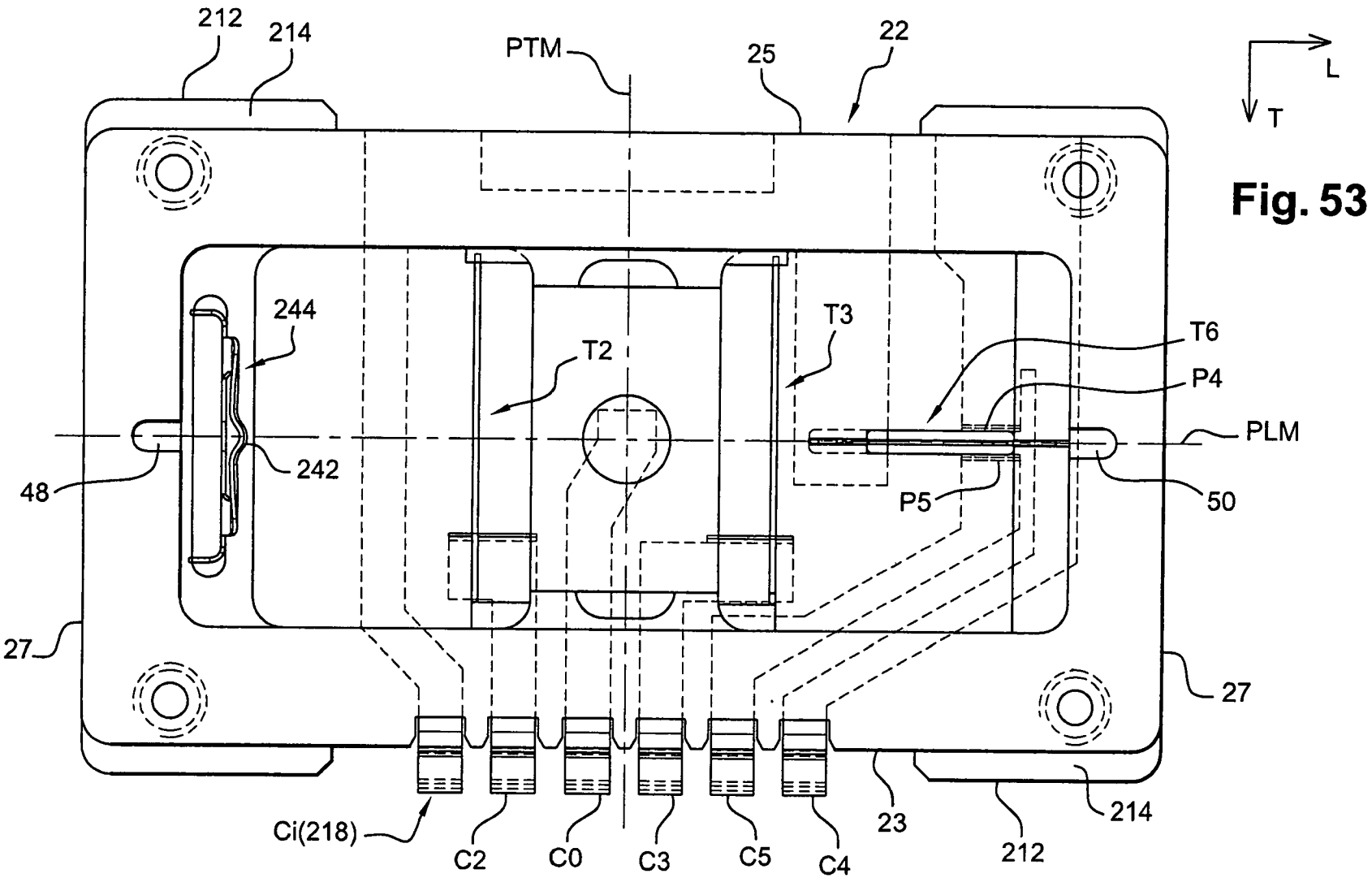
Figure 59:
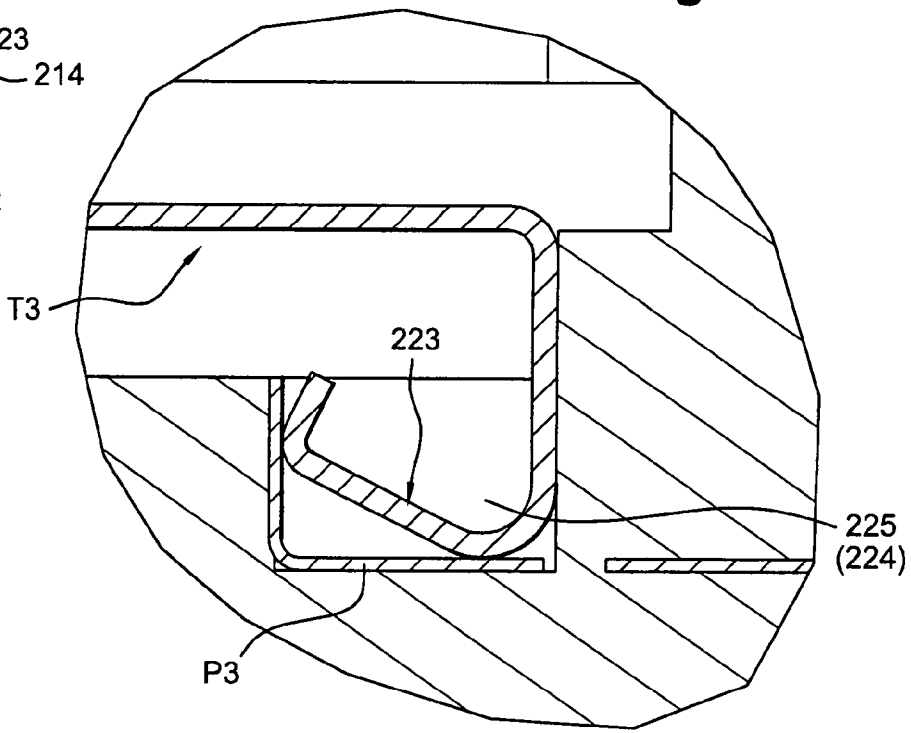
FIGS. 58 and 59 are views similar to those of FIGS. 55 and 56 along another sectional plane.
Figure 58:
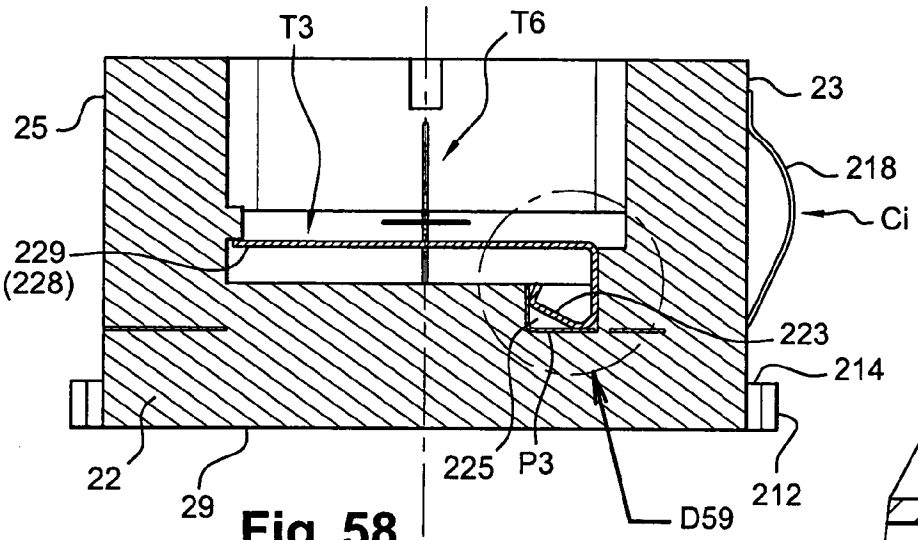

Each left T2 and right T3 horizontal, transverse fixed contact rod, such as the one T3 illustrated in details on FIGS. 57 to 59, comprises a curved bent front end 222, 223 which is crimped in a corresponding shaft or well 224, 225 (in the form of a vertical and transversal slot which is open upwardly) equivalent to previous feet 62 and 66, each having in its bottom a conductive pad P3, P2 respectively of L shaped cross section.

Each transverse rod T2, T3 is thus mounted in a cantilevered fashion such as a beam with its free rear end 226, 227 bearing, in an elastical pre-stressed state, against a horizontal lower bearing surface 228, 229.

This improvement provides for a more precise and trustable detection of the corresponding switching and is particularly advantageous when using the simultaneous or quasi-simultaneous switching of the second and third ways (in association with the corresponding software) to detect a central SELECT action of the F1 type (as previously described in connection with the first embodiment).

Furthermore, it helps to prevent parasitic pulses or signals due to a vibrating environment.

Each rod, by means of its main central section, thus precisely defines a horizontal contact with which the lower face of the corresponding branch B2, B3 (FIG. 32) comes into contact, each rod T2, T3 being thereafter freely and elastically deformable downwardly under the action of the drum when either force F3 or F2 is applied.

As previously described, the mobile contact rod T6 (FIG. 4) is basically composed of a vertical strand, comprising an upper section 106 and a lower section 108 connected by a horizontal intermediate section 110 constituting the horizontal general tilt axis of the movable contact rod T6 which, for this purpose, is received in the bottom of a V shaped slot 112 formed in the upper face of a foot 114 adjacent to the right-hand inner side face 116 of the housing 22.

The vertical strand 106-108 is extended, from the lower end of the lower section 108, by a longitudinal horizontal strand 118 which is here suspended parallelly to the bottom of a recess 120 hollowed out in the bottom 56.

Figure 60:
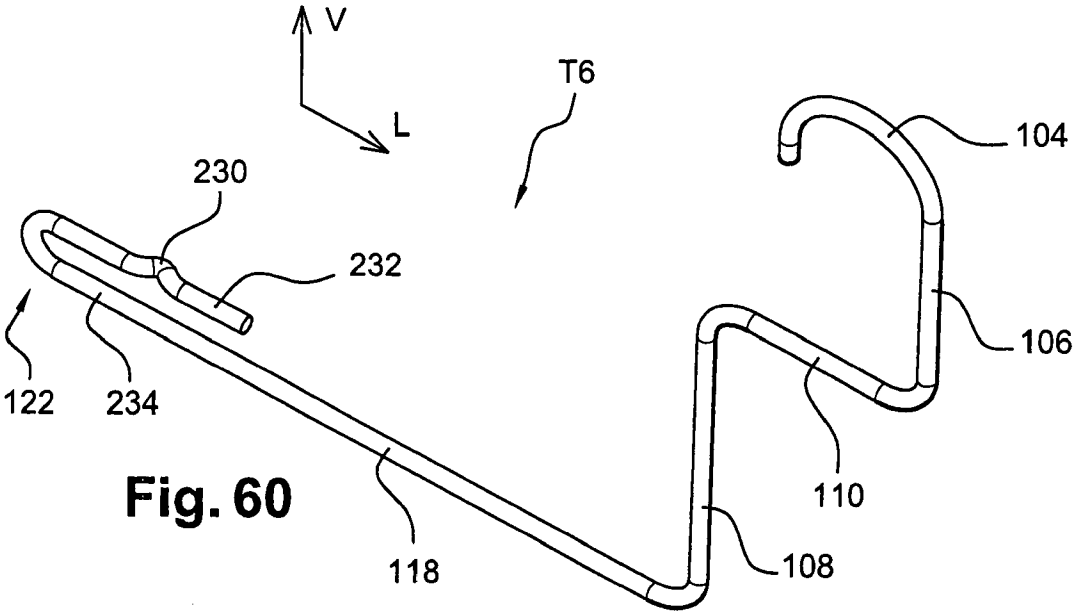
FIGS. 60 and 61 are two views showing the details of the movable contact rod.
Figure 61:
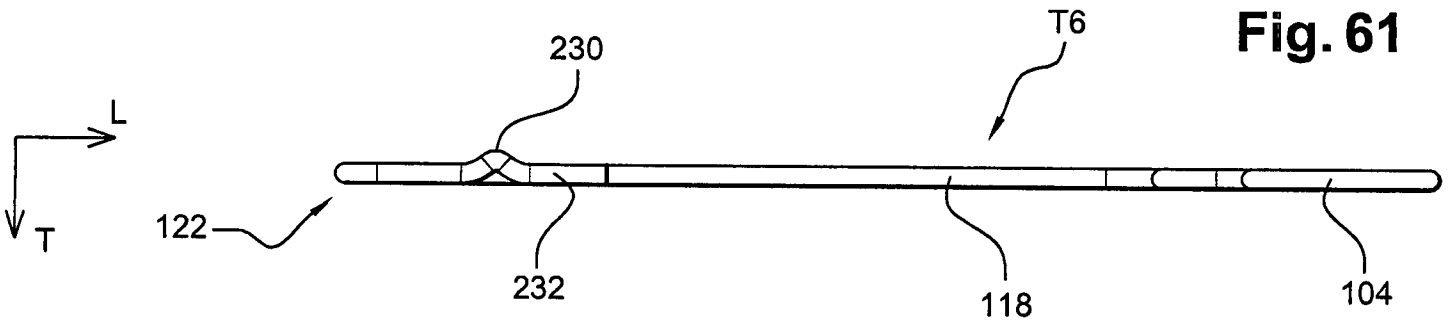

The free end 122 (FIG. 12 & FIG. 60) of the rod T6 which, bent back at 180° in the form of a horizontal hairpin, is clamped in a longitudinal vertical slot 124.

The bottom of the slot 124 comprises a conductor pad P6, which is connected, by a strip conductor 126, to the output terminal C6 to which the movable contact rod T6 is thus permanently electrically connected.

The clamping of the hairpin loop or end 122 of the rod T6 is ensured by means of a rib 230 formed in the upper strand 232 of the looped end 122 and which extends transversely in order to be force fitted in the facing internal longitudinal wall of the vertical slot 124.

The crimping or clamping is such that the lower strand 234 (FIG. 60) of the looped end 122 is permanently and elastically pre-stressed in electrical contact with the contacting pad P6.

It is also such that the looped end 122 does constitute an embedded end so that a kind of torque does permanently apply the intermediate section 110 that lies in the V shaped slot 112.

The crimping might also be reinforced by hot welding of the upper part of the slot 164 to totally embed the end 122 in the loop.

In this embodiment, the two rear T4 and front T5 horizontal, longitudinal fixed contact rods have been replaced by conductive metallic pads P4(T4) and T6(P6) (FIG. 58) on which the lower housing is overmoulded.

Figure 54:
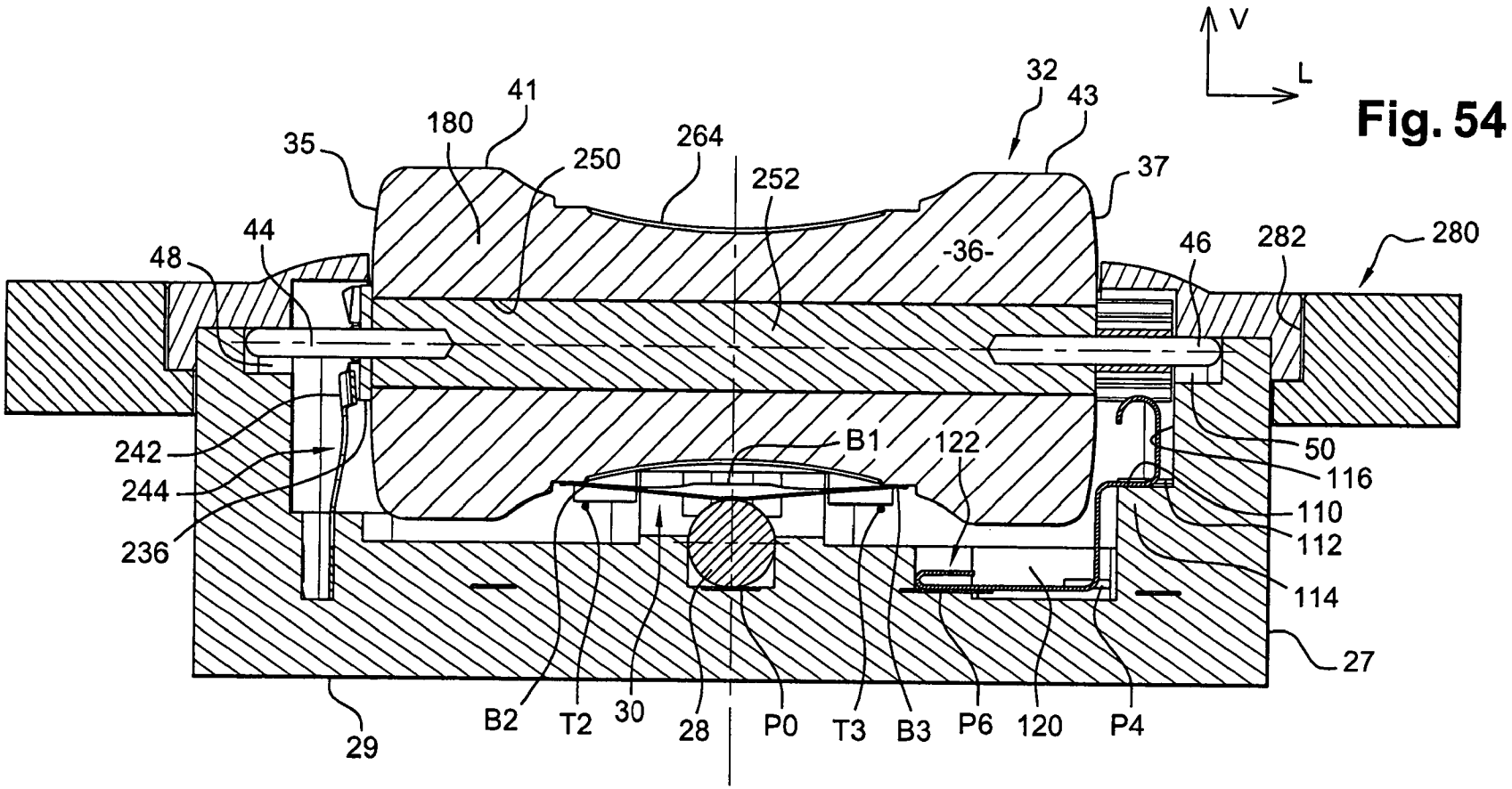
Figures 55, 56:
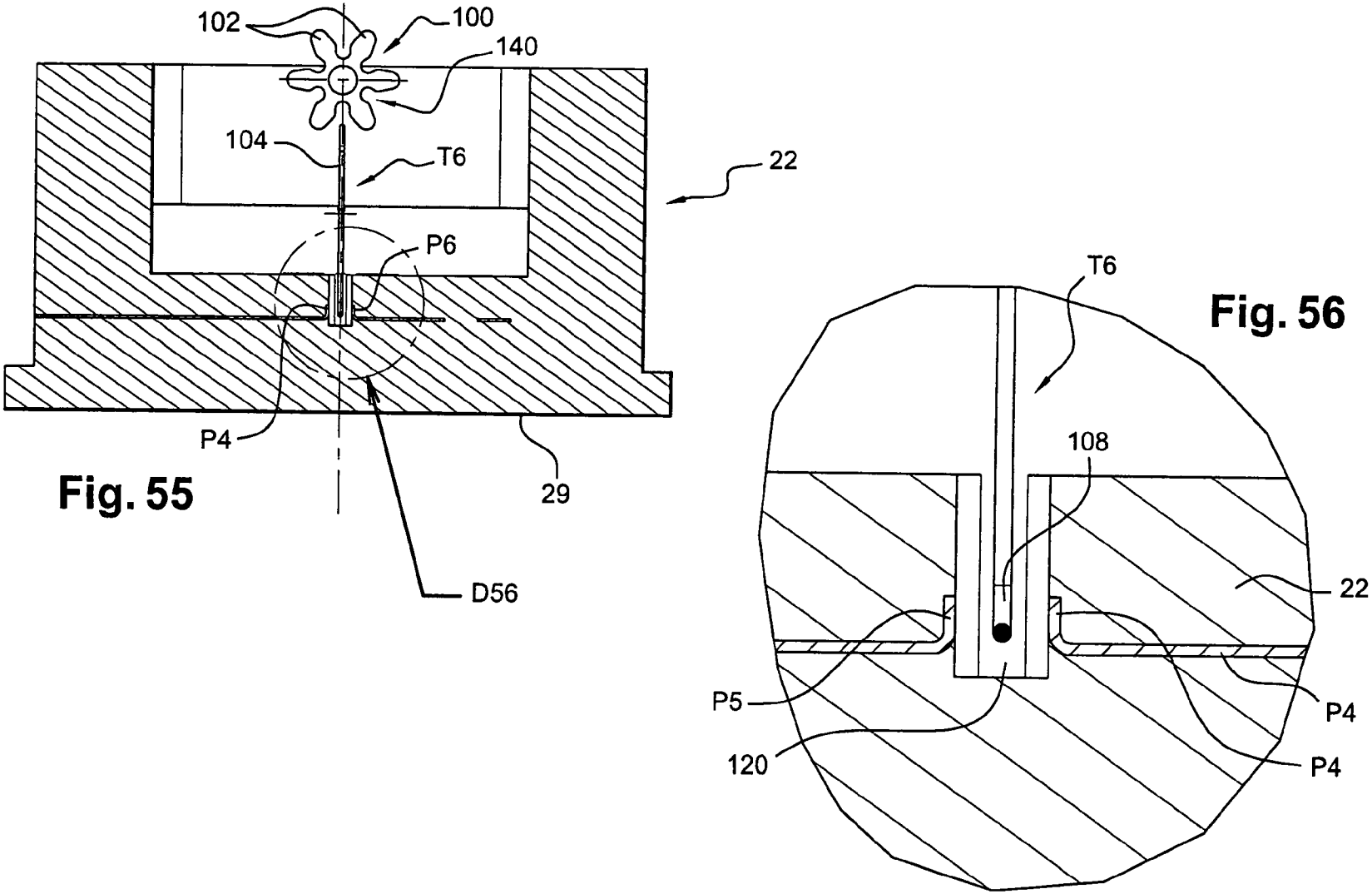
FIG. 56 is an enlarged view of detail D56 of FIG. 55.

As it can be seen on FIGS. 54 to 56, the lower section 108 of the movable rod T6 is received with transversal play between the two pads P4 and P5.

When the drum is rotated in one or the other direction, the rod tilts about its horizontal axis 110, in the manner of a crankshaft, and its lower end 108 proceeds to establish an electrical contact with the corresponding fixed pad P4 or P5.

In order to provide a tactile and audio sensation to the user when the latter is turning the drum 32 along F4 or F5 (FIG. 1), the longitudinal left end side face 35 of the drum 36 is provided with a toothed wheel 236 (FIG. 64*b*) here comprising eight hollow indentations 238 separated by eight V shaped convex teeth 240.

As well as the driving pinion 100 (having here only eight teeth) (FIG. 62), the wheel 236 is rotatably linked to the drum 36 so that an indentation 238 (FIG. 63) is downwardly oriented in a vertical plane when an interdental space 140 between two consecutive teeth 102 is also similarly oriented, i.e. when the upper portion of the mobile contact rod T6 is in rest position (see FIGS. 62 to 64).

The wheel 236 is cooperating with an elastic indexing V shaped convex finger 242 (FIG. 54) which extends longitudinally and horizontally towards the right.

The wheel 236 in combination with the finger 242 does form a kind of ratchet wheel and pawl mechanism.

The indexing finger or pawl 242 belongs to an elastic indexing blade 244 which is supported by the lower housing 22 so as to provide a detent effect when cooperating successively with the indentations 238 and teeth 240 of the ratchet wheel 236.

In the rest position (see for instance FIGS. 54 and 55) the finger 242 is received in a hollow or concave indentation 238 of the wheel 236.

As it can be seen on FIGS. 62 to 64*b*, each indentation 238 lies between two lateral inclined (5° to 8°) opposed faces 237 and 239 so as to have a V shape opening radially towards the exterior.

In combination with the shape and dimensions of the pawl finger 242 (FIG. 54), when the left portion of the drum is descending vertically with respect to the finger 242, the V profile of the indentation 238 does provide a return spring or elastic effect acting on the drum vertically and upwardly.

This returning effect comes in addition to the one exerted by the branches of the trigger element 30.

The arrangement of the pawl and ratchet mechanism does provide the user with a tactile and/or audio sensation when the drum reaches a new angular rest position which also corresponds to a rest position of the pulse generator 100-T6. According to the first described embodiment the audio or tactile signal is generated when an electrical pulse is generated.

It is thus possible to design the wire mobile contact T in a less strong manner since it does no longer ensure any tactile or audio function an/or thus improve its life length.

Figure 65:
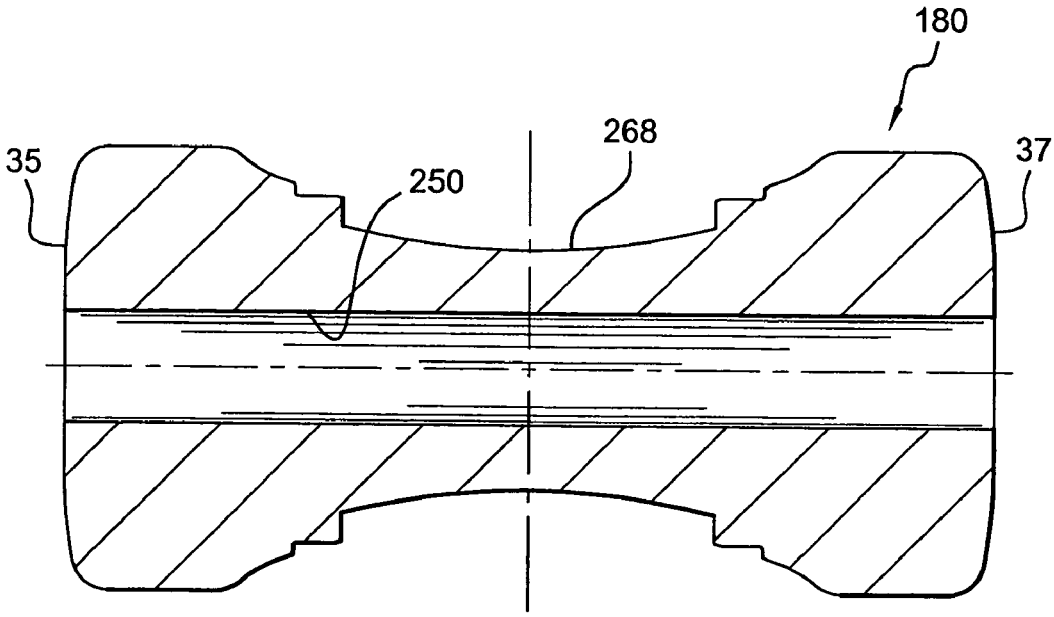
FIGS. 65 and 66 are detailed views of some of the components of the drum.
Figure 66:
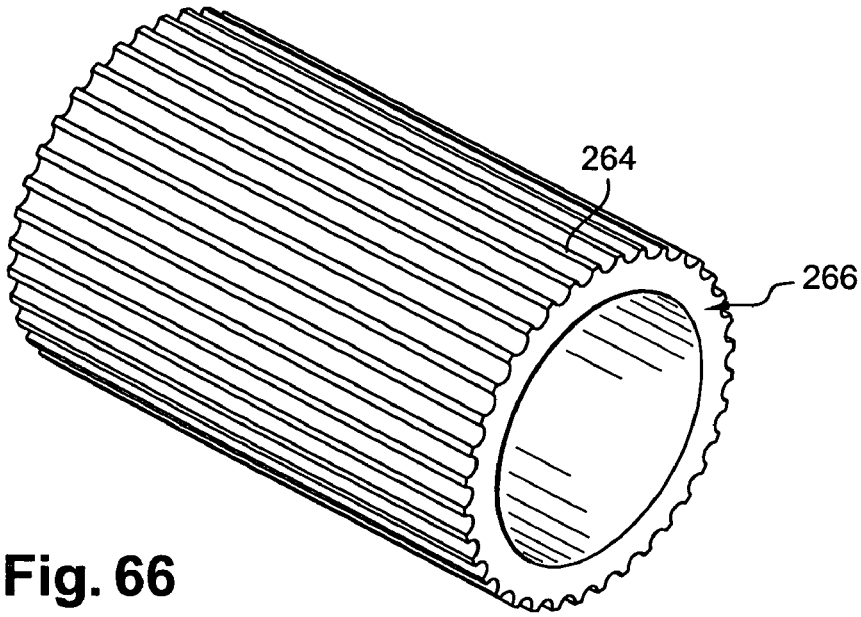
Figure 67:
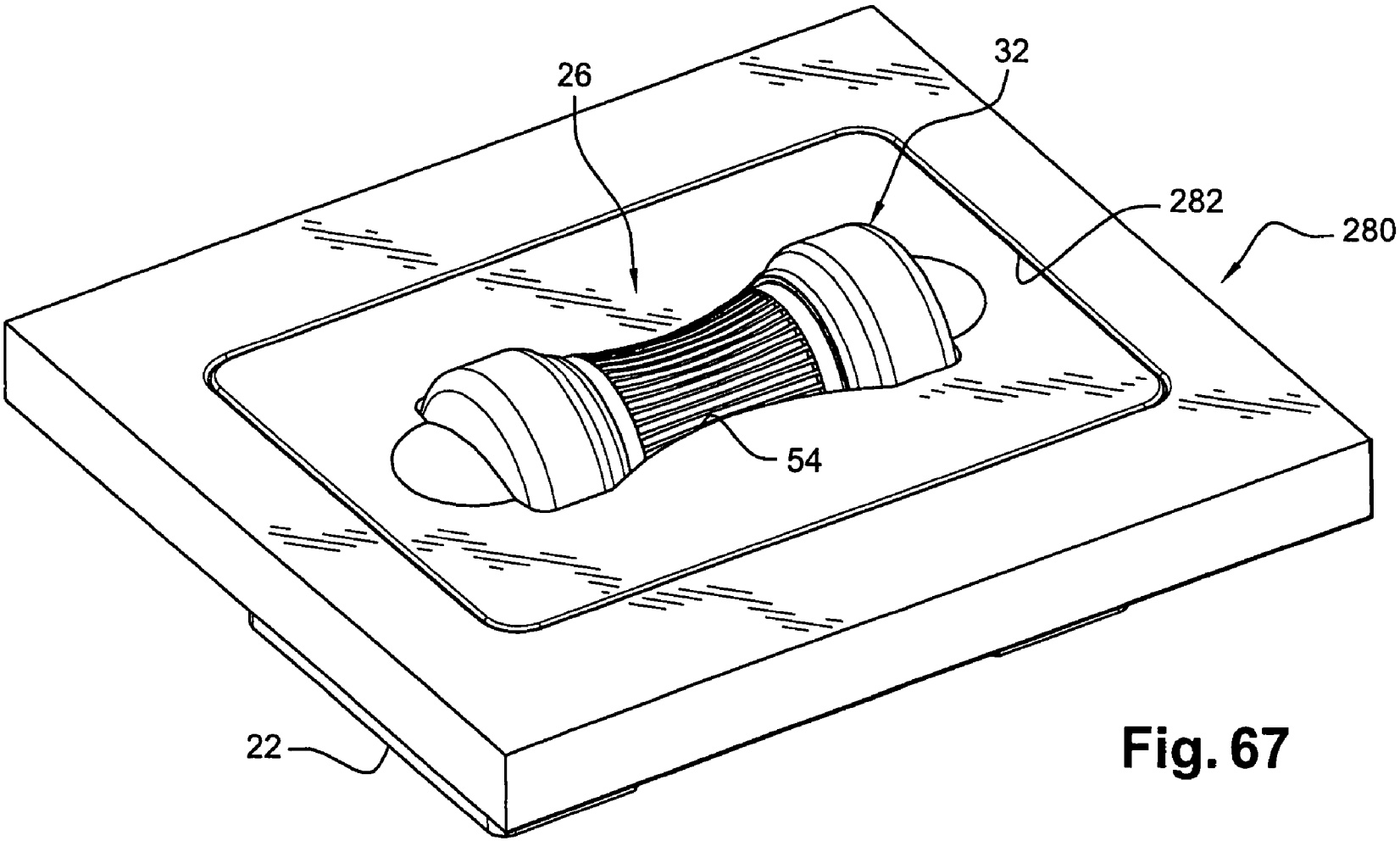
FIG. 67 to 72 are views showing the integration of the device of FIGS. 48 to 54 in the housing of the equipment.

In the embodiment illustrated in details on FIGS. 54, 65 and 66, the drum 32 is made of several parts contrarily to the first embodiment (FIG. 24) where the drum 32 is a single molded piece.

The drum 36 is thus made of a main tubular and cylindrical molded body 180 having a central axial tubular hole which receives a central shaft 252 which might be made of plastics or o1 metal and which is rotatably linked, or fixed to the main body 180.

The two opposite ends of the central shaft 252 each comprises an axial open hole which receives an end rod constituting two longitudinal end sections, left 44 and right 46, for the rotation-mounting and guiding-mounting of the member 32 in the lower housing 22, which, for this purpose, comprises two median vertical and longitudinal slots, left 48 and right 50, which emerge vertically in the upper face 24 and each of which receives, in rotational and vertically sliding arrangement, the corresponding rod 44, 46 respectively.

The driving pinion 100 and the wheel 236 are for instance metallic parts which are force fitted on the end rods 46 and 44.

The wheel 236 might also be made in a single piece with the central shaft 252.

Alternatively, all the components 180, 252, 44, 46, 100 and 236 might be realized in the form of a single molded plastics piece, depending on the dimensions, efforts to be supported, life length, etc.

The central or mid portion of the drum 36 is here of concave shape and comprises series of axial knurls 264 (FIGS. 48 & 54) to provide the user with additional tactile information and to improve its "gripping" of the drum for rotating it and also for applying the "enabling" effort F1 and the lateral end portions are here flush.

The knurls 264 might be realized directly by molding with the main body 180. However, the number of knurls is thus necessarily reduced due to the molding techniques.

The previously mentioned one piece molding of the drum easily permits to define an angular and precise orientation of the knurls 264 with respect to the pinion 100 and the wheel 236 which already have a respective mutual angular orientation as previously mentioned.

If the number of the knurls is reduced and similar to the number of teeth 102 and indentations 238 which is generally comprised between six and twelve, and also depending on the overall external diameter of the drum, it is possible to orientate a hollow between two indentations 264 upwardly in the vertical plane PLM and also an opposite lower one facing the branches B2 and B3, when the drum is in its angular rest position previously mentioned.

If a great number of knurls 264 is desired, and/or if a soft touch material is to be used in this area comprising the knurls 264, they are preferably made in an independent sheath or tubular mantle 266 made by molding of an elastomeric material. This because it is then not possible to realize the knurls in the concave mid portion by molding techniques.

The sheath 266 (FIG. 66) is extrusion molded independently and then the body is introduced therethrough elastically and temporarily deforming the sheath 266 illustrated in FIG. 66. The sheath is thus received in the external complementary groove 268 of the main body 180.

The sheath 266 can also be realized by bi-injection molding with the body 180.

Figure 49:
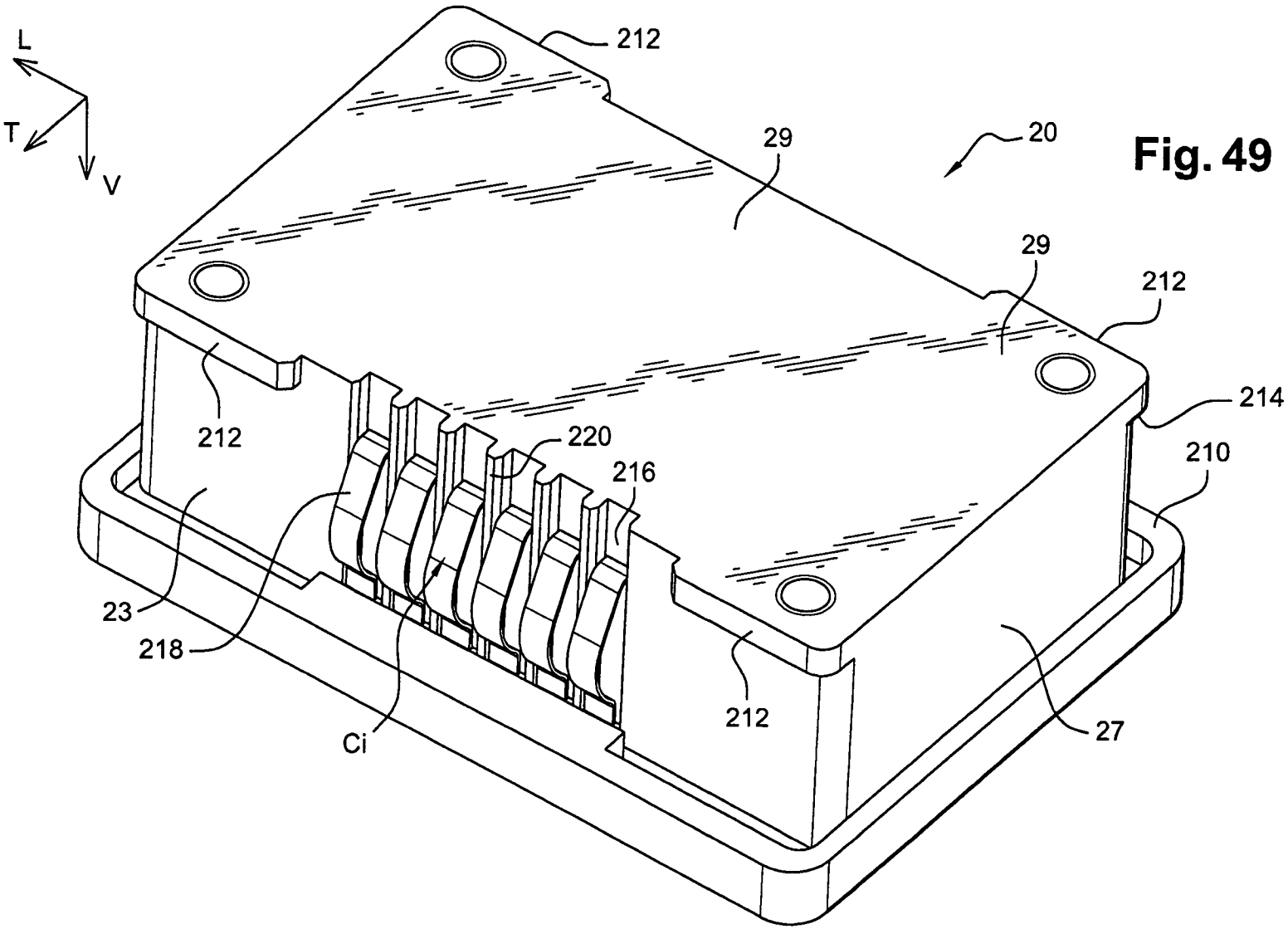
FIG. 49 is a bottom isometric view of the device of FIG. 48.
Figure 50:
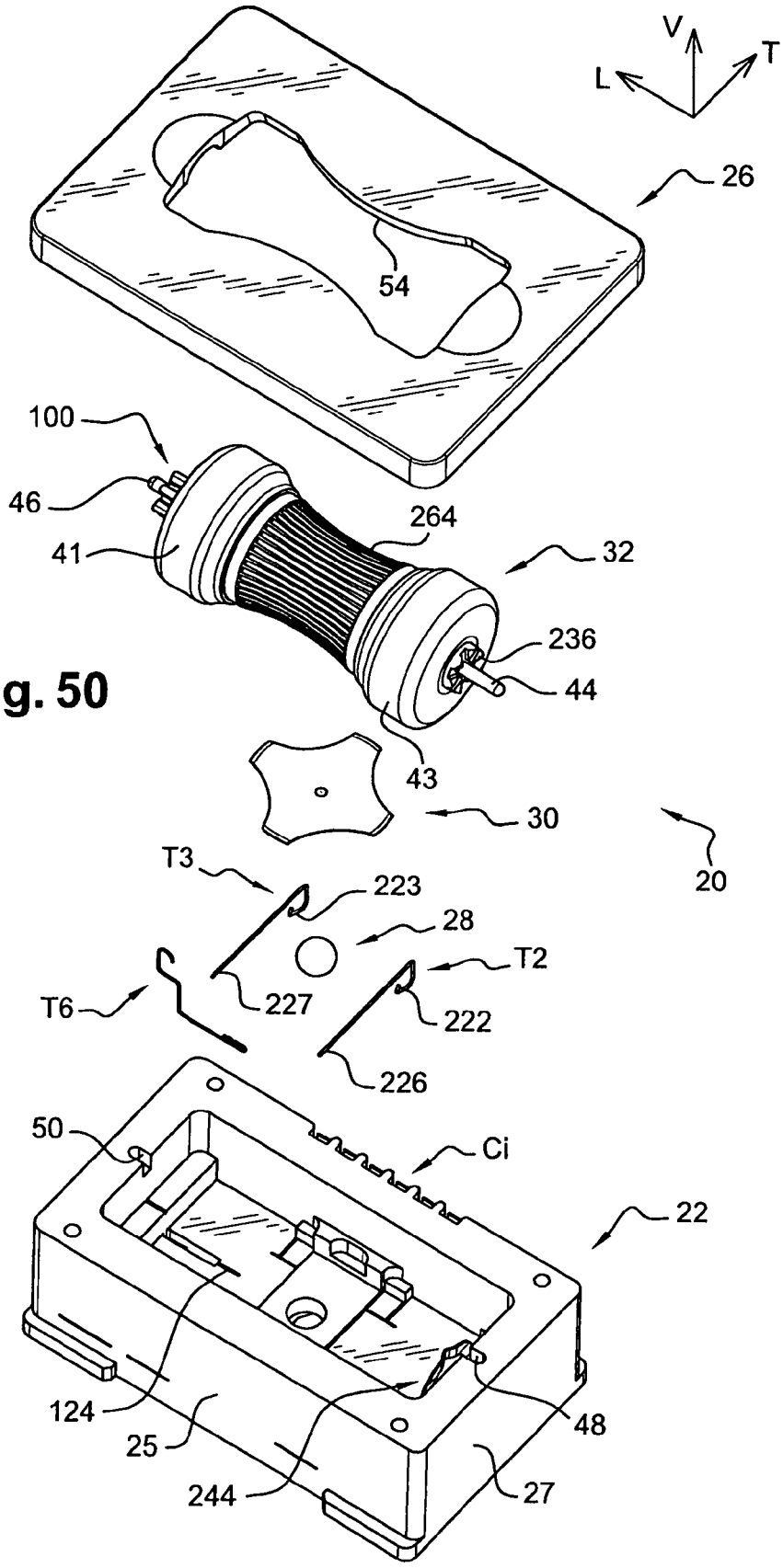
FIG. 50 is an exploded isometric view of the device of FIG. 48 and is similar to the view of FIG. 2.
Figure 51:
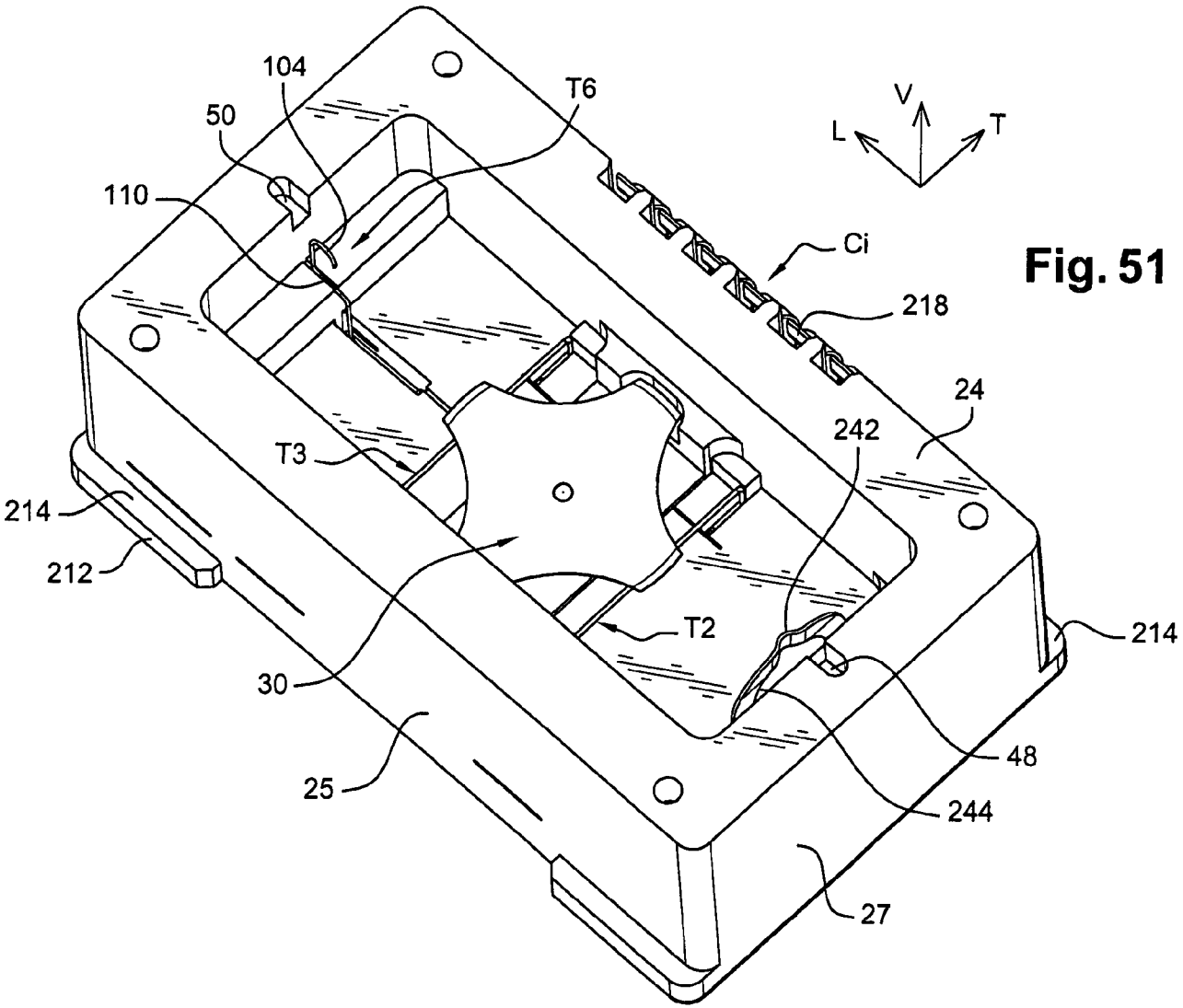
FIGS. 51 to 55 are views similar to the views of FIGS. 5, 8, 9, 12 and 13.
Figure 52:
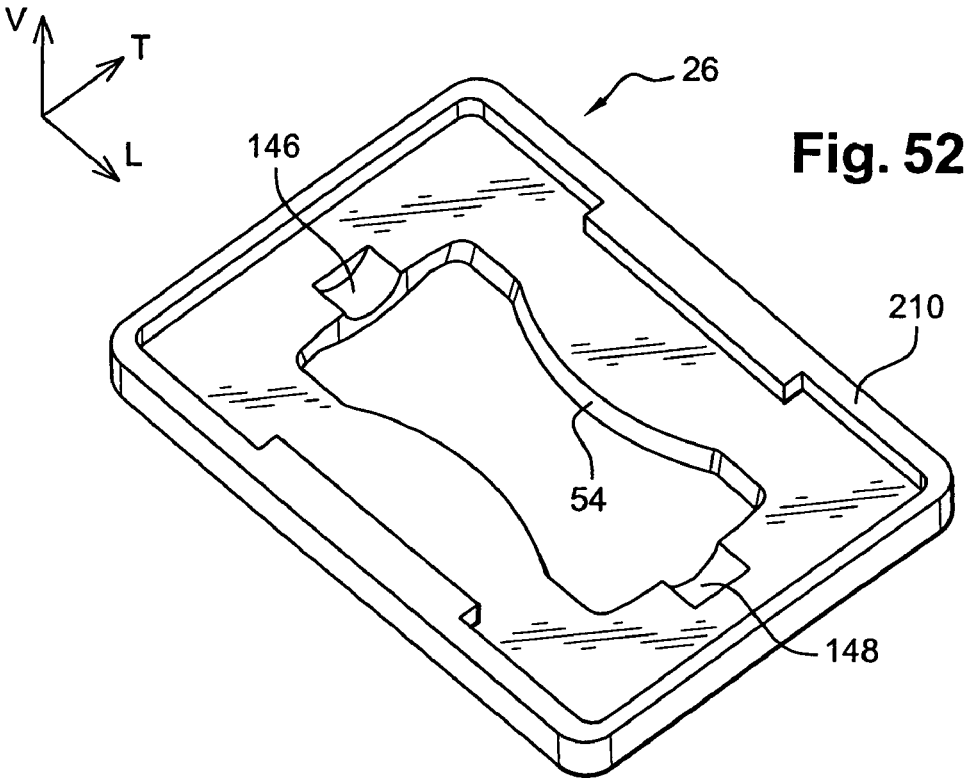
Figure 68:
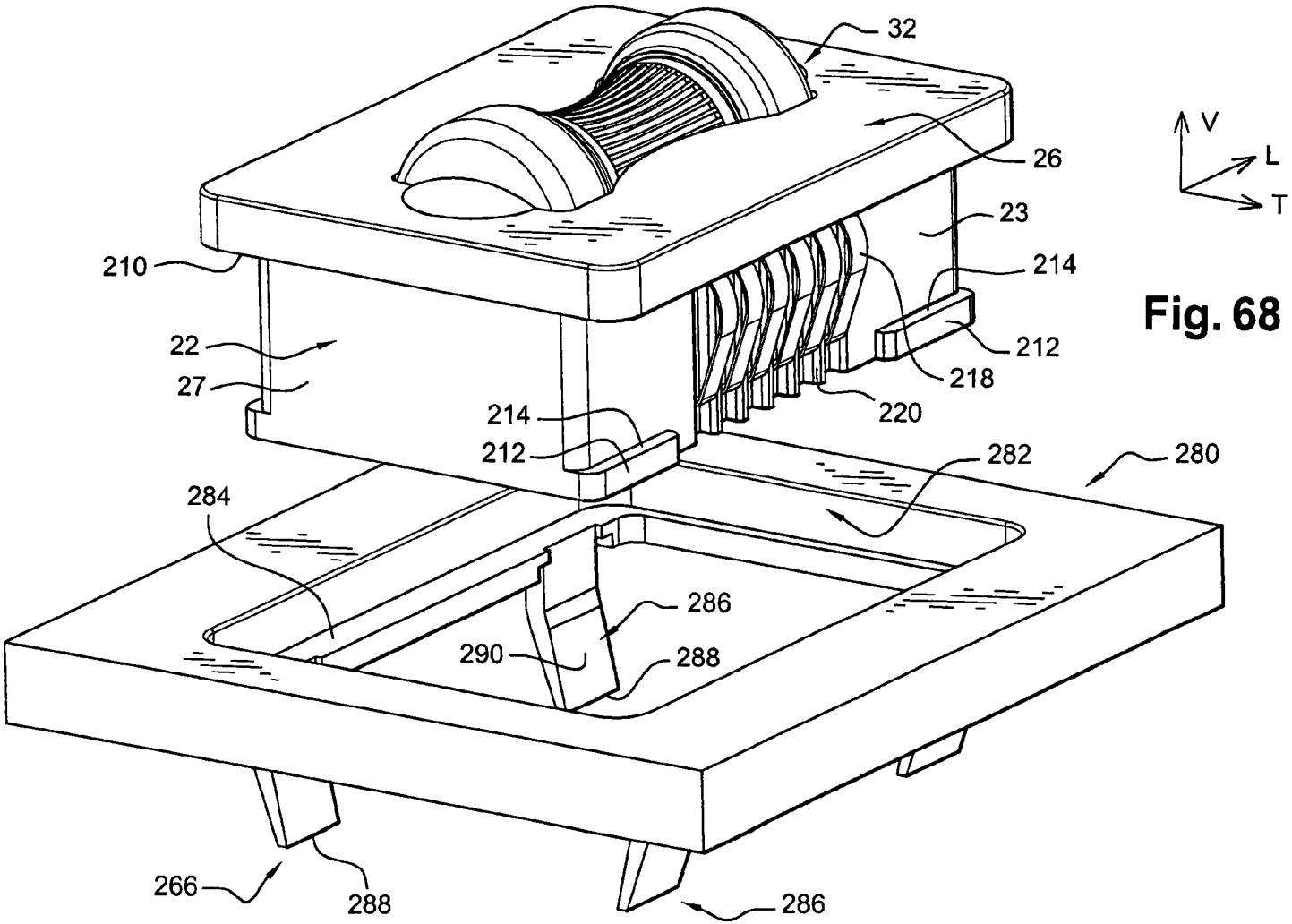

It has been represented on FIG. 68 and following a rectangular frame 280 which schematically represents a portion of a horizontal upper wall of an equipment (such as an electronic appliance) equipped with a device according to FIGS. 48 and 49.

The frame 280 forms a central opening 282 which is rectangular and complementary to the external shape of the upper lid 26. The lower peripheral and horizontal edge surface 210 of the lid 26 is bearing downwardly on a facing upper peripheral and horizontal edge 284 of the opening 280 thus defining the vertical position of the lid with respect to the frame 280.

According to one aspect of this embodiment, the frame, or wall portion, 280 of the apparatus equipped with the multiway switching device, comprises a number (four in the illustrated example) of elastic arms 286 which extend freely downwardly and each of them having a free lower end 288 which bears on the corresponding surface 214 of the lower body 22.

Each locking arm 286 is ramp shaped so as to automatically escape by elastical deformation when the device is vertically introduced for mounting in the opening 280, downwardly when considering FIG. 68. To this end, the internal ramp shaped face 290 of each arm 286 cooperates with the corresponding portion of a facing rib 212.

Figure 69:
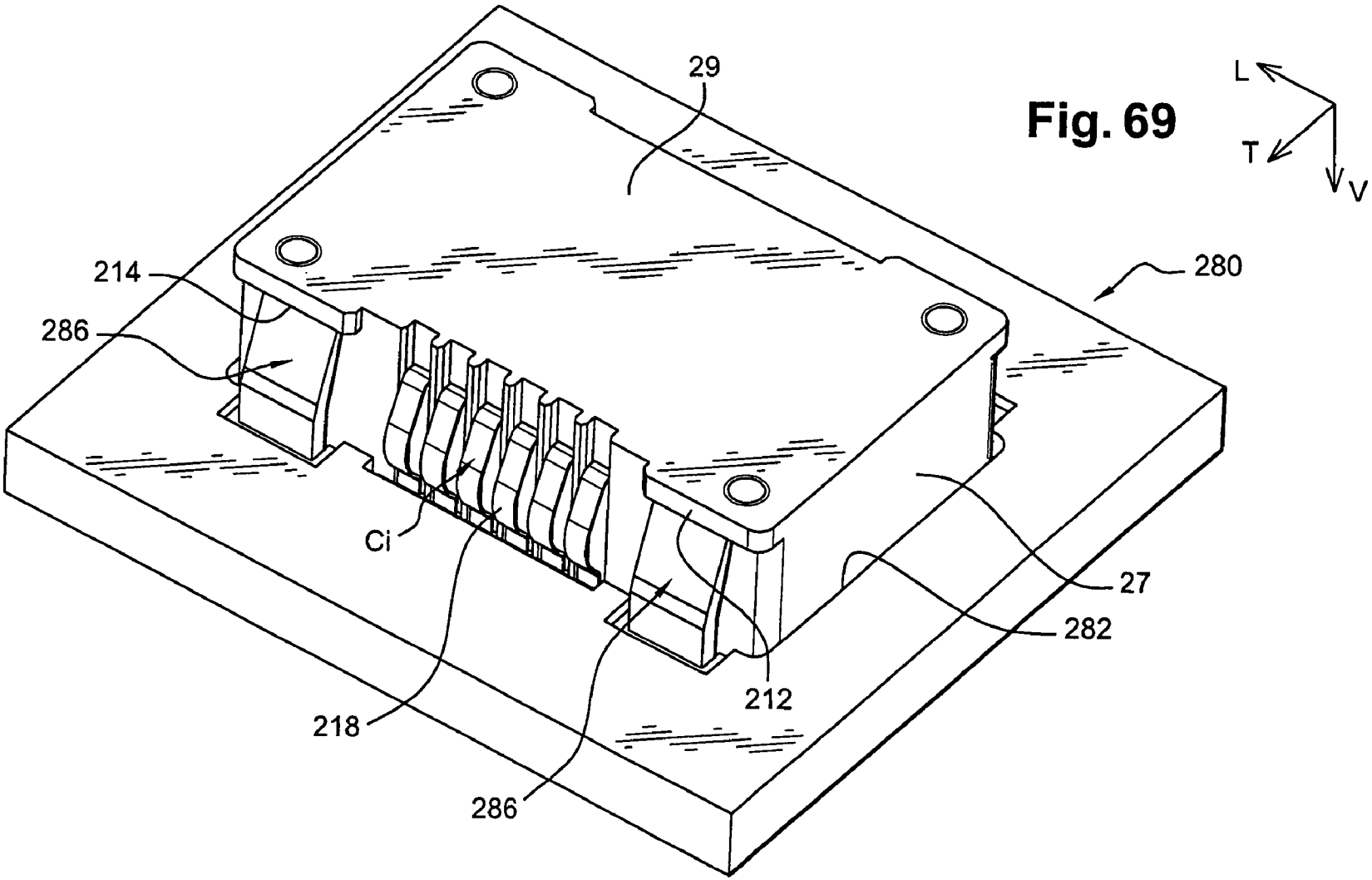
Figure 70:
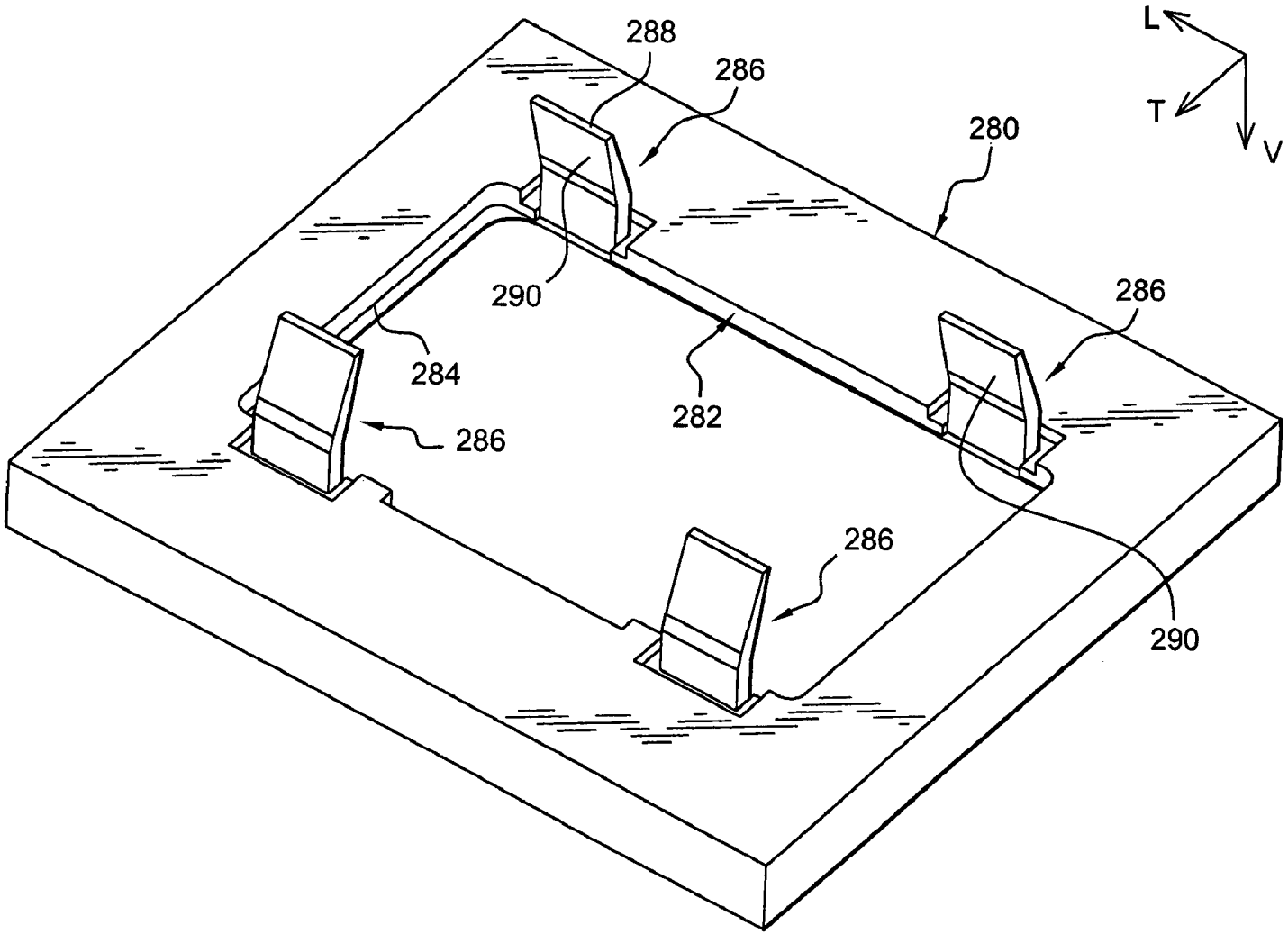
Figure 72:
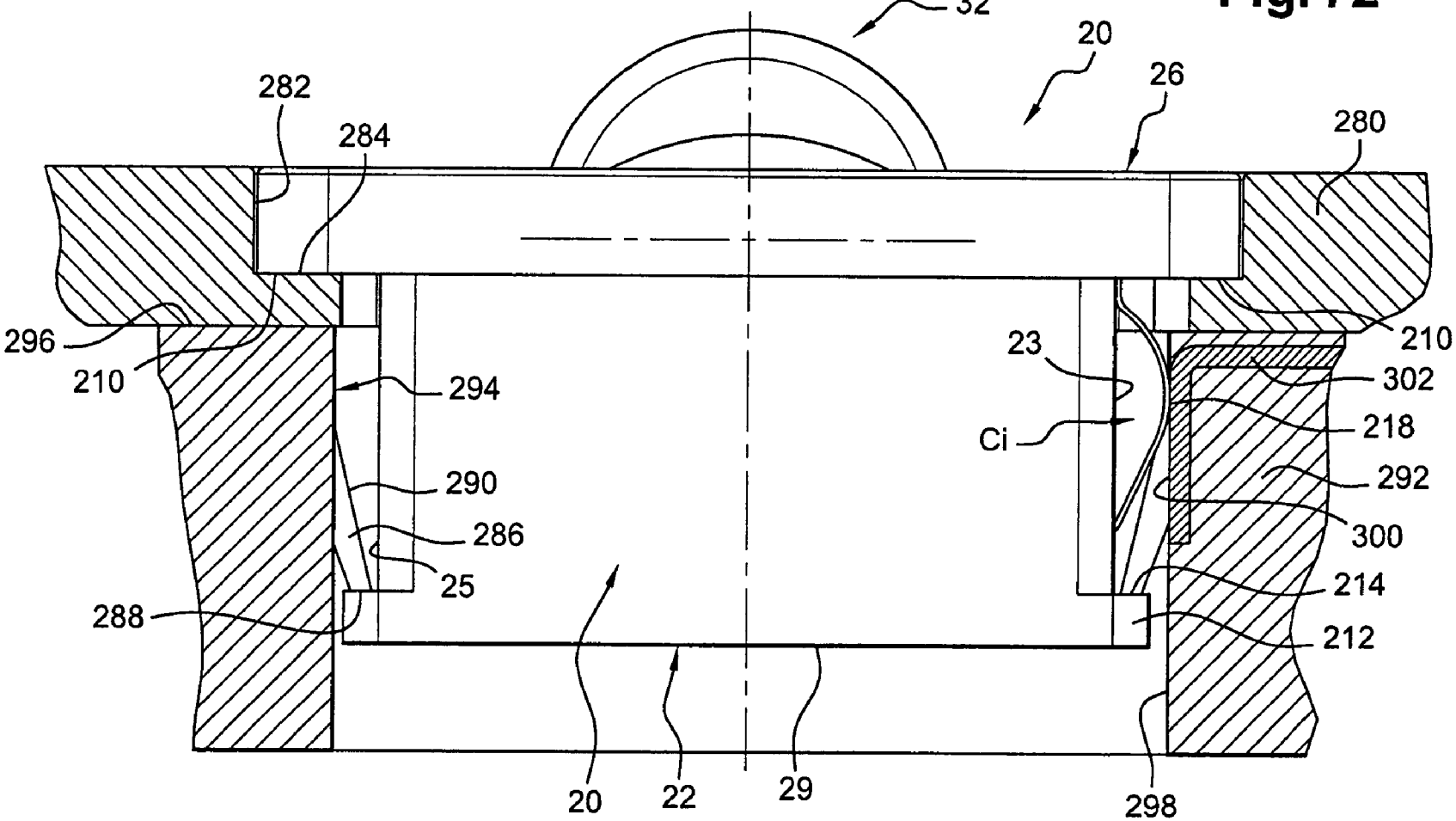

In the position illustrated on FIGS. 68, 69 and 72, the device 20 is fully locked and positioned with respect to the frame 280 (see also FIG. 54 on which the frame 280 has been represented).

Figure 71:
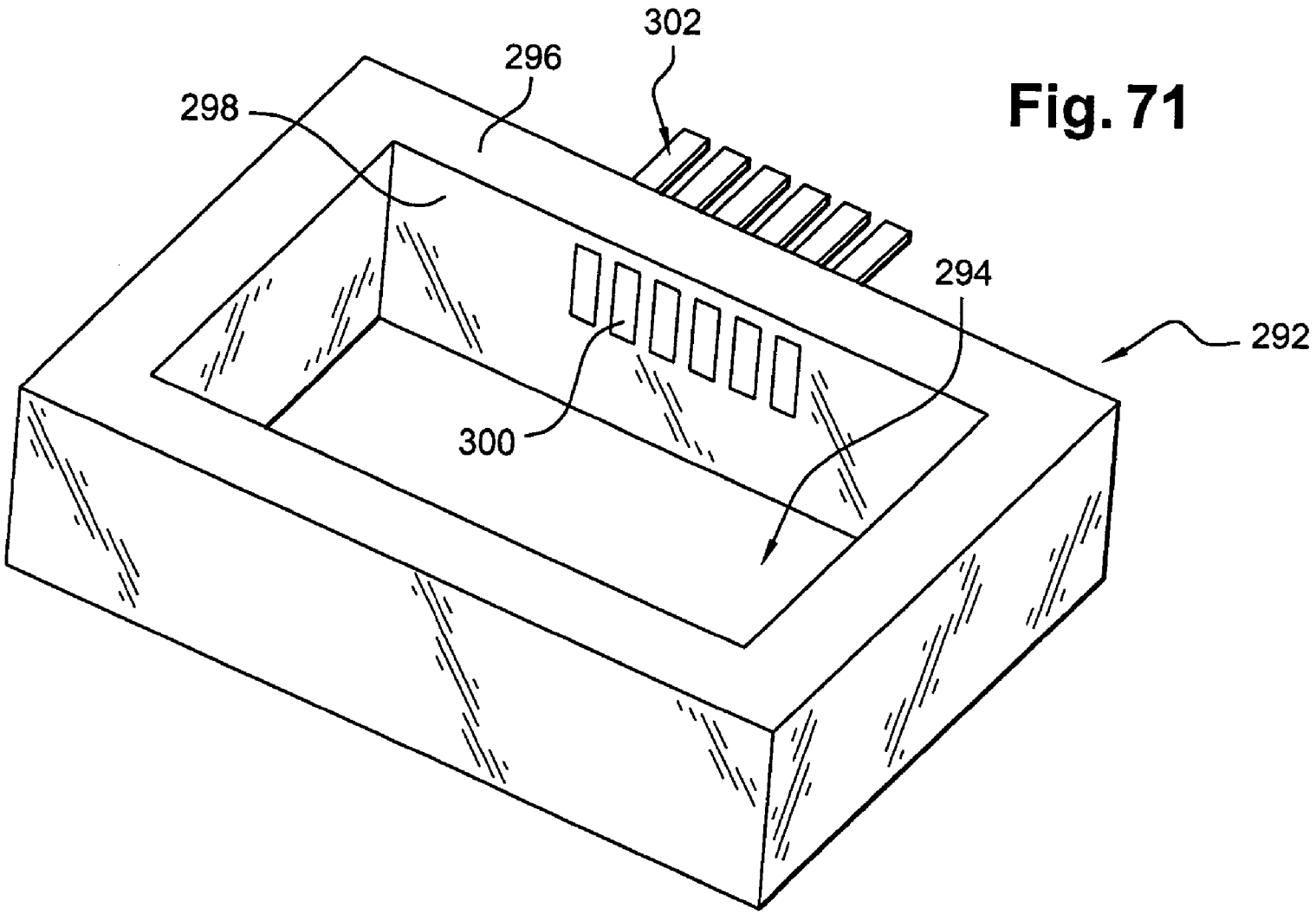

In order to ensure the electrical connection of the device 20 with the corresponding circuits of the equipment or electronic appliance, the latter may comprise a hollow body, a portion 292 of which is illustrated on FIGS. 71 and 72. The body 292 defines a rectangular parallepipedal vertical hole 294 which opens in its upper face 296 and which is adapted to receive the device 20.

The internal longitudinal face 298 of the central hole 294 comprises a series of conductive tracks 300, each of which being positioned and arranged to cooperate with a corresponding blade or terminal Ci-218 of the device 20 (see FIG. 72).

Each track 300 is preferably one face of a conductive metal strip 302 on which the plastic body 292 is overmoulded and which constitutes a fixed contact pin for electrical connection.

Figure 74:
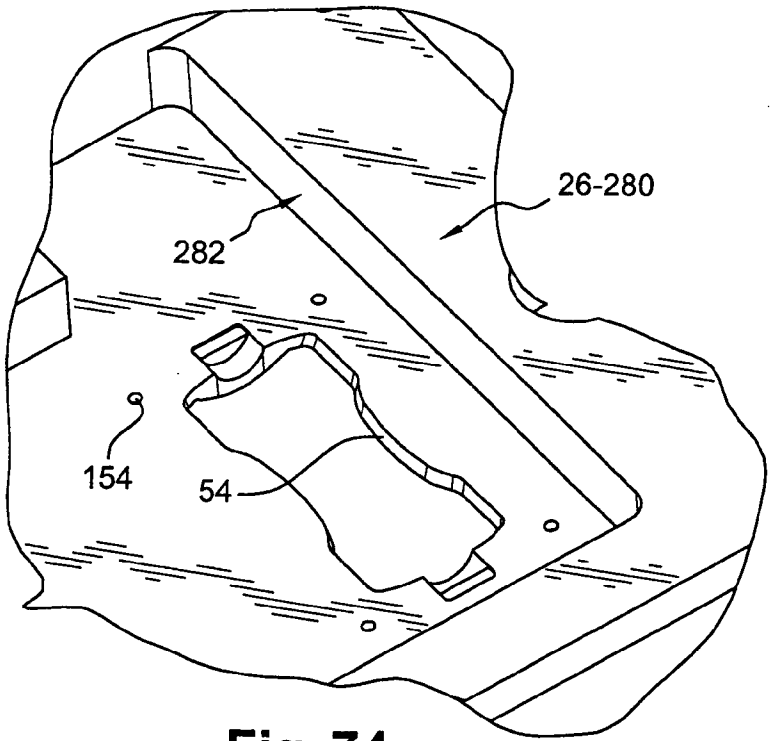
FIGS. 73 and 74 are isometric views showing the integration of the lid o the device in the housing of the equipment.
Figure 73:
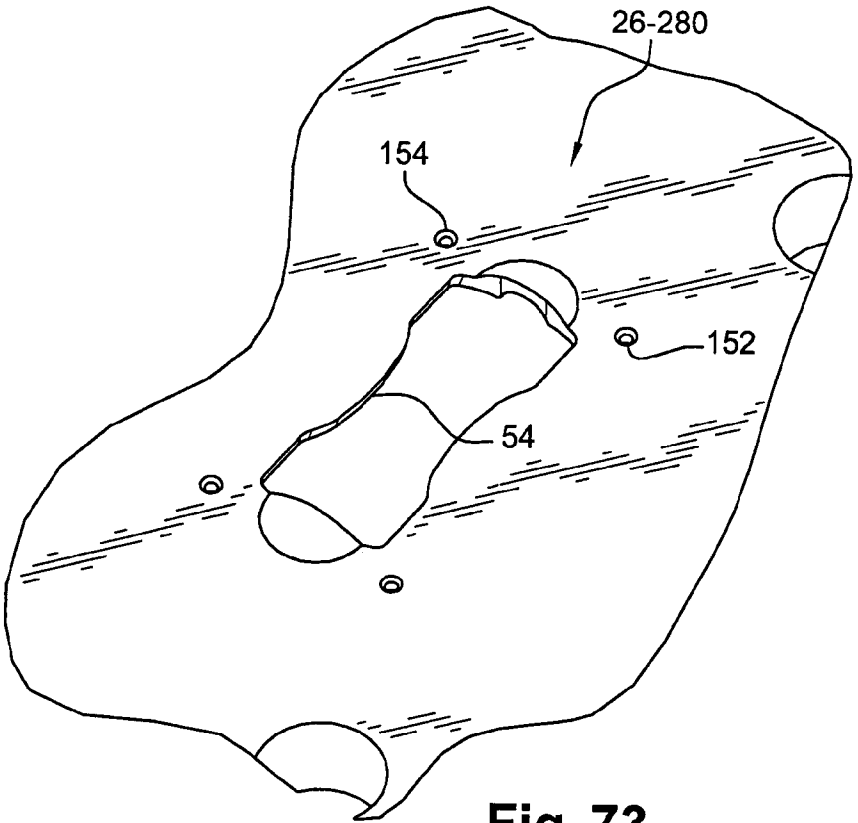

Finally, as illustrated in FIGS. 73 and 74, the lid 26 might be made by molding as a single piece with the upper wall or frame 280, thus simplifying assembly and also permitting to suppress the elastic locking arms 286.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A control which includes a housing, a drum having an exposed surface that has left and right drum surface end portions and that can be manually turned and depressed, the drum including a shaft that rotatably supports the drum on the housing, the control including a turning signal generator that is coupled to said drum and that generates signals indicating rotation of the drum, and the control including a depressable switch assembly that detects depressions of the drum and that includes left and right stationary contacts mounted on the housing and that includes a resilient trigger member with left and right branches that are each deflectable by downward depression of an end portion of the drum respectively against said left and right stationary contacts, wherein:

said resilient trigger member has a trigger member middle that is supported on said housing, and said trigger member right and left end portions each extends at an upward incline from said switch member middle toward a corresponding one of said drum surface end portions.

2. The control described in claim 1 wherein:

said housing has a cavity with an upwardly-facing bottom wall;

at least one of said stationary contacts is in the form of a wire with opposite ends mounted on said housing and with a wire section that lies above said bottom wall and under one of said trigger member end portions.

3. The control described in claim 1 wherein:

said trigger member end portions are each downwardly deflected by said drum surface end portions and said trigger member end portions are unsupported against downward deflections.

4. The control described in claim 1 wherein:

said housing includes a lower housing member with a cavity that receives a portion of said drum and that has an upper face, and a lid that has a lower face and that has an aperture through which an upper portion of said drum extends, said aperture closely surrounding but spaced from said drum to help keep dirt out of said cavity, and the control further comprises a sheet of elastomeric material clamped between said upper face of said lower housing member and said lower face of said lid, said sheet extending inwardly beyond walls of said lid aperture to engage said drum.

5. A control device that includes a housing, a shaft which is rotatably mounted on said housing to rotate about a primarily horizontal axis (X-X), and a manually rotatable driving drum supported on the shaft, the shaft configured to be connected to at least one rotary member of a signal generator of an electronic appliance, wherein the shaft is vertically movable and is tiltable about a transverse horizontal axis that is orthogonal to the longitudinal axis (X-X) of the shaft so as to selectively trigger a second trigger member to close a second switch when a vertical force (F2) is applied to one of two opposite ends of the drum, or trigger a third trigger member to close a second switch when a second vertical force (F3) is applied to the other of the two ends of the drum, wherein:

the shaft is mounted with respect to the housing so as to be moved down to trigger both said second and third trigger members when a downward force is applied to the center of the drum to establish a first switching path that passes through said second and third switches; and the drum rests on a central portion of a central member which bears upon the bottom of the housing, which ensures an elastic return function of the drum towards a high rest position of the drum, and which, from a rest position, is configured to be elastically deformable under the action of one of said forces for supplying one or more of a click of tactile and an auditory sensation indicating the sudden change of position.

6. Device according to claim 5, wherein the housing comprises a guide mechanism for guiding the opposite axial ends of the shaft in a vertical plane (PLM) perpendicular to the bottom of the housing.

7. Device according to claim 5, wherein the said central portion of the central element is a domed portion.

8. Device according to claim 5, further comprising illuminating means for the drum, arranged in the bottom of the housing, and in that the drum is totally or partially translucid or transparent in order to conduct the light transmitted by the illuminating means.

9. Device according to claim 5, further comprising a ratchet wheel rotationally linked to one lateral end of said driving drum and a fixed pawl supported by the plastics housing configured to generate one or more of an audio and tactile sensitive pulses when the drum is rotated.

10. Device according to claim 5, wherein the said central member is in the general shape of a star having branches of essentially radial orientation, which extends outwards from the said central portion.

11. Device according to claim 10, wherein the said central member has a design symmetry about its vertical central axis (Y-Y).

12. A control which includes a housing, a drum having an exposed surface that has left and right drum surface end portions and that can be manually turned and depressed, the drum including a shaft that rotatably supports the drum on the housing, the control including a turning signal generator that is coupled to said drum and that is configured to generate signals indicating rotation of the drum, and the control including a depressable switch assembly that detects depressions of the drum and that includes left and right stationary contacts mounted on the housing and that includes a resilient trigger member with left and right branches that are each deflectable by downward depression of an end portion of the drum respectively against said left and right stationary contacts, wherein:

said resilient trigger member has a trigger member middle that is supported on said housing, and said trigger member right and left end portions each extends at an upward incline from said switch member middle toward a corresponding one of said drum surface end portions, said housing includes a lower housing member with a cavity that receives a portion of said drum and that has an upper face, and a lid that has a lower face and that has an aperture through which an upper portion of said drum extends, said aperture closely surrounding but spaced from said drum to help keep dirt out of said cavity, and including;

a sheet of elastomeric material clamped between said upper face of said lower housing member and said lower face of said lid, said sheet extending inwardly beyond walls of said lid aperture to engage said drum.

13. A control device that includes a housing, a shaft which is rotatably mounted on the housing to rotate about a primarily horizontal axis, and a manually rotatable driving drum supported on the shaft, the shaft configured to be connected to at least one rotary member of a signal generator of an electronic appliance, wherein the shaft is vertically movable and is tiltable about a transverse horizontal axis that is orthogonal to the longitudinal axis of the shaft so as to selectively trigger a second trigger member to close a second switch when a vertical force is applied to one of two opposite ends of the drum, or trigger a third trigger member to close a second switch when a second vertical force is applied to the other of the two ends of the drum, wherein:

the shaft is mounted with respect to the housing so as to be moved down to trigger both said second and third trigger members when a downward force is applied to the center of the drum to establish a first switching path that passes through said second and third switches; and the drum rests on a central portion of a central member which bears upon the bottom of the housing, which ensures an elastic return function of the drum towards a high rest position of the drum, and which, from a rest position, is elastically deformable under the action of one of the forces for supplying one or more of a click of tactile and an auditory sensation indicating the sudden change of position, and the control device further comprises illuminating means for the drum, arranged in the bottom of the housing, and in that the drum is totally or partially translucid or transparent in order to conduct the light transmitted by the illuminating means.

14. A control device that includes a housing, a shaft which is rotatably mounted on the housing to rotate about a primarily horizontal axis, and a manually rotatable driving drum supported on the shaft, the shaft configured to be connected to at least one rotary member of a signal generator of an electronic appliance, wherein the shaft is vertically movable and is tiltable about a transverse horizontal axis that is orthogonal to the longitudinal axis of the shaft so as to selectively trigger a second trigger member to close a second switch when a vertical force is applied to one of two opposite ends of the drum, or trigger a third trigger member to close a second switch when a second vertical force is applied to the other of the two ends of the drum, wherein:

the shaft is mounted with respect to the housing so as to be moved down to trigger both said second and third trigger members when a downward force is applied to the center of the drum to establish a first switching path that passes through said second and third switches; and the drum rests on a central portion of a central member which bears upon the bottom of the housing, which ensures an elastic return function of the drum towards a high rest position of the drum, and which, from a rest position, is elastically deformable under the action of one of the forces for supplying one or more of a click of tactile and an auditory sensation indicating the sudden change of position, and the control device further comprises a ratchet wheel rotationally linked to one lateral end of said driving drum and a fixed pawl supported by the plastics housing configured to generate one or more of an audio and tactile sensitive pulses when the drum is rotated.

* * * * *